US007756443B2

(12) United States Patent
Okabe et al.

(10) Patent No.: US 7,756,443 B2
(45) Date of Patent: Jul. 13, 2010

(54) IMAGE FORMING APPARATUS AND DEVELOPING CARTRIDGE HAVING DRIVING INPUT AND GUIDE

(75) Inventors: Yasushi Okabe, Nagoya (JP); Naoya Kamimura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 561 days.

(21) Appl. No.: 11/614,359

(22) Filed: Dec. 21, 2006

(65) Prior Publication Data

US 2007/0147881 A1 Jun. 28, 2007

(30) Foreign Application Priority Data

Dec. 27, 2005 (JP) ..... 2005-376119
Apr. 26, 2006 (JP) ..... 2006-122215

(51) Int. Cl.
*G03G 15/08* (2006.01)
*G03G 21/18* (2006.01)

(52) U.S. Cl. ..... 399/119; 399/90; 399/113

(58) Field of Classification Search ..... 399/90, 399/111, 119, 110, 113
See application file for complete search history.

(56) References Cited

U.S. PATENT DOCUMENTS 5,875,374 A * 2/1999 Kikuchi et al. ..... 399/111
6,574,446 B2 * 6/2003 Kitayama ..... 399/111
6,708,011 B2 * 3/2004 Nomura et al. ..... 399/110
6,751,428 B2 * 6/2004 Okabe ..... 399/111
6,944,415 B2 * 9/2005 Nomura ..... 399/111
7,174,117 B2 2/2007 Okabe
7,369,791 B2 5/2008 Okabe
2002/0150404 A1 * 10/2002 Matsuzaka et al. ..... 399/111
2005/0201772 A1 * 9/2005 Ishii et al. ..... 399/90
2005/0254854 A1 * 11/2005 Deguchi ..... 399/111
2006/0067733 A1 * 3/2006 Kawasumi ..... 399/111

(Continued)

FOREIGN PATENT DOCUMENTS

EP 0827049 A2 3/1998

(Continued)

OTHER PUBLICATIONS

European Search Report, Application No. 06026636.8-1240/1804137, dated Mar. 24, 2009.

(Continued)

*Primary Examiner*—Susan S Lee
(74) *Attorney, Agent, or Firm*—Banner & Witcoff.com

(57) ABSTRACT

A system that provides a compact and functional image forming device that can securely supply a driving force to the developing cartridge is described. A developing cartridge is described that can be mounted to the image forming device in an insertable/removable manner. A passive coupling gear and cylinder externally project in the width direction of the collar member allowing secure supply of a driving force through connection of the passive coupling gear to the coupling input shaft. In addition, the amount of movement of the coupling input shaft to connect with the passive coupling gear can be minimized, thereby allowing for a miniaturization of the color laser printer. Furthermore, in addition to the original function, the function of being guided by the left guiding groove for the passive coupling gear and the function of being guided by the right groove for the cylinder can be added.

27 Claims, 27 Drawing Sheets

U.S. PATENT DOCUMENTS

| | | | | |
|---|---|---|---|---|
| 2006/0083545 | A1* | 4/2006 | Okabe et al. | 399/111 |
| 2006/0171738 | A1* | 8/2006 | Mori | 399/111 |
| 2007/0280727 | A1* | 12/2007 | Kawasumi | 399/111 |

FOREIGN PATENT DOCUMENTS

| | | | |
|---|---|---|---|
| EP | 1273980 | A2 | 1/2003 |
| EP | 1293848 | A2 | 3/2003 |
| JP | 10-105023 | | 4/1998 |
| JP | 2003-084645 | | 3/2003 |
| WO | 2006-079163 | A1 | 8/2006 |

OTHER PUBLICATIONS

Notice of Reason for Rejection for Japanese Application No. 2006-122215 dtd May 13, 2008.

* cited by examiner

21

BACK
LEFT
RIGHT
FRONT 194
195
196
198
199
161
70
71
50
165
2
144
187
145
189
22
23
121
192
193
Y
Z
X
184

IMAGE FORMING APPARATUS AND DEVELOPING CARTRIDGE HAVING DRIVING INPUT AND GUIDE

CROSS REFERENCE TO RELATED APPLICATIONS

This application claims priority from Japanese Patent Application Nos. 2006-122215 filed Apr. 26, 2006 and 2005-376119 filed Dec. 27, 2005, the entire contents of which are incorporated herein by reference.

FIELD

Aspects of the present invention relate to an image forming device such as a laser printer and a developing cartridge capable of being used with the image forming device.

BACKGROUND

Color image forming devices are known in which a number of developing cartridges are arranged in line in an insertable/removable manner. These developing cartridges supply toner to the surface of an image carrier of a photoconductor cartridge. The developing cartridges may be arranged in line in an insertable/removable manner. The combination of the image carriers and the developing cartridges and other components can be referred to generally as image forming devices (including but not limited to devices such as laser printers).

In one example of an image forming device, a developing cartridge includes a toner supply. The developing cartridge includes a toner storage and developer carrier that carries the toner. The toner is carried on the surface of a developer carrier. The toner is supplied to a static latent image present on the surface of the image carrier when the developer carrier contacts the surface of the image carrier. This occurs during the rotation of the developer carrier. Accordingly, the static latent image on the surface of the image carrier is developed to an image formed by the developing powder. Next, the developing powder is transferred to paper, resulting in an image in developing powder (or toner) formed on the paper.

In addition, the photoconductor cartridge is insertable to and/or removable from the color image formation device. While the photoconductor cartridge is installed in the color image forming device, a gear on the image carrier is directly engaged with a driving gear that is provided on the color image forming device body.

In at least one example, the developing cartridge is attached to the photoconductor cartridge by a guiding groove. Guiding projections may be provided on both lateral surfaces of the guiding groove. The guiding groove may be formed on a photoconductor cartridge frame. When installed and connected in this manner, a developing bias is applied to the developer carrier so that it carries the toner. The developing bias is provided from an electrode provided on the photoconductor cartridge frame. In addition, a developer carrier gear that is provided on the developer carrier is engaged with the gear of the image carrier. The developer carrier gear may be synchronized with the rotation of the photoconductor gear that is directly engaged to the driving gear. The driving gear may be provided on the body of the color image forming device. By this construction, the developer carrier rotates.

SUMMARY

This summary is provided to introduce a selection of concepts in a simplified form that are further described below in the Detailed Description. This summary is not intended to identify key features or essential features of the claimed subject matter.

Aspects of the invention provide an improved developing cartridge that exhibits an improved guiding structure. These and other aspects of the disclosure will be apparent upon consideration of the following detailed description of illustrative embodiments.

DETAILED DESCRIPTION

The various aspects summarized previously may be embodied in various forms. The following description shows by way of illustration of various combinations and configurations in which the aspects may be practiced. It is understood that the described aspects and/or embodiments are merely examples, and that other aspects and/or embodiments may be utilized and structural and functional modifications may be made, without departing from the scope of the present disclosure.

It is noted that various connections are set forth between elements in the following description. It is noted that these connections in general and, unless specified otherwise, may be direct or indirect and that this specification is not intended to be limiting in this respect.

1. THE OVERALL STRUCTURE OF THE COLOR LASER PRINTER

Figure 1:
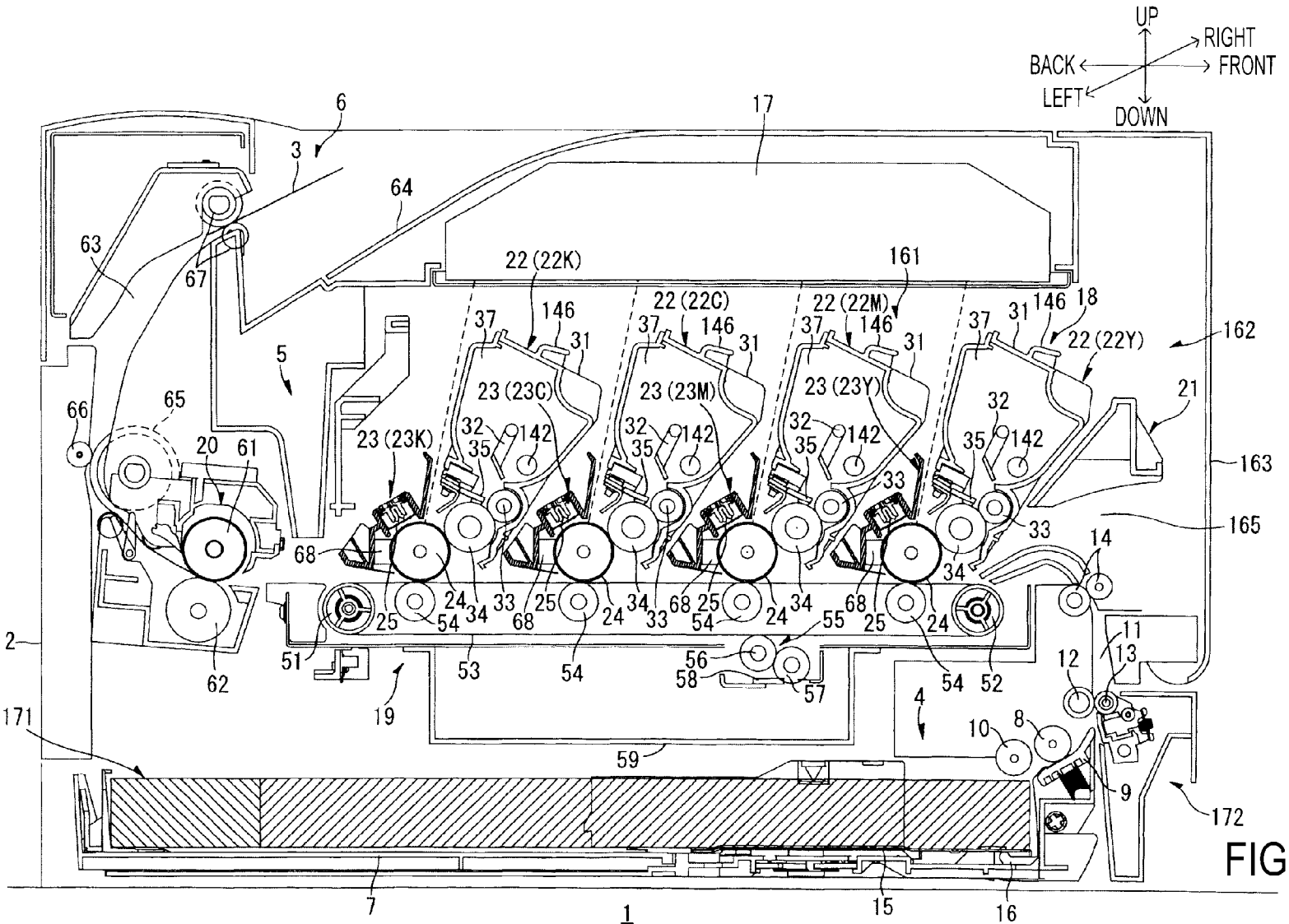
FIG. 1 is a lateral cross-sectional view that shows a portion of an illustrative embodiment of a color laser printer as an image forming device according to one or more aspects of the present invention.
Figure 2:
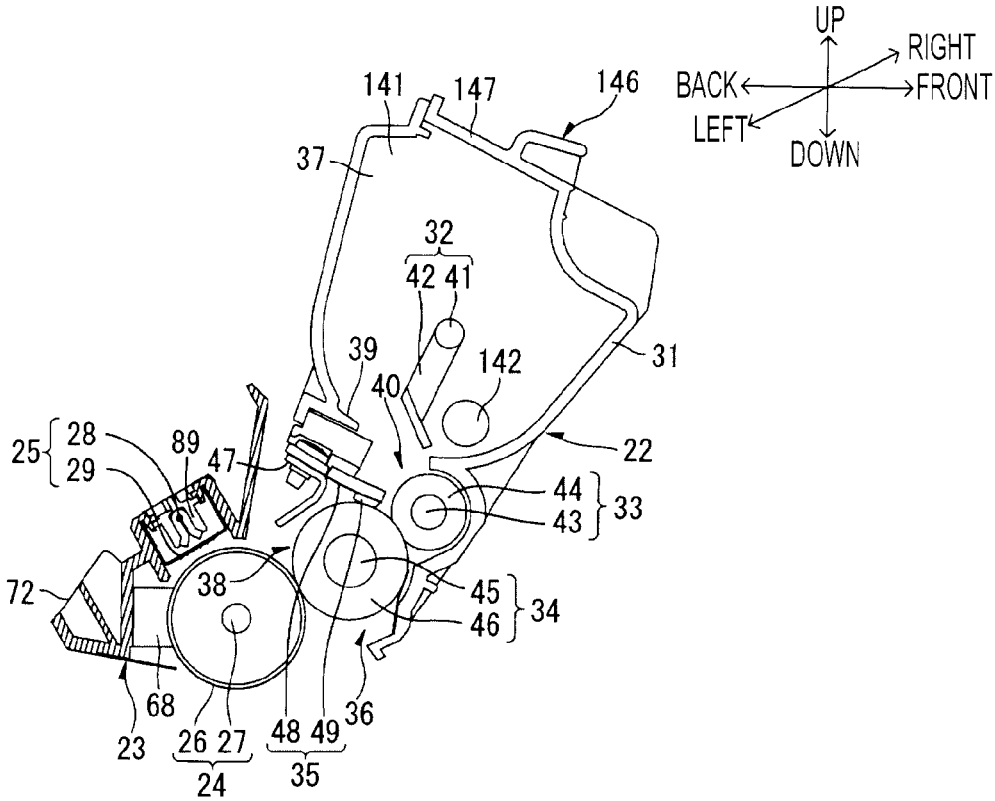
FIG. 2 is a lateral cross-sectional view that shows a portion of the drum subunit, in which the developing cartridge is mounted, of the color laser printer shown in FIG. 1 in accordance with aspects of the present invention.
Figure 3:
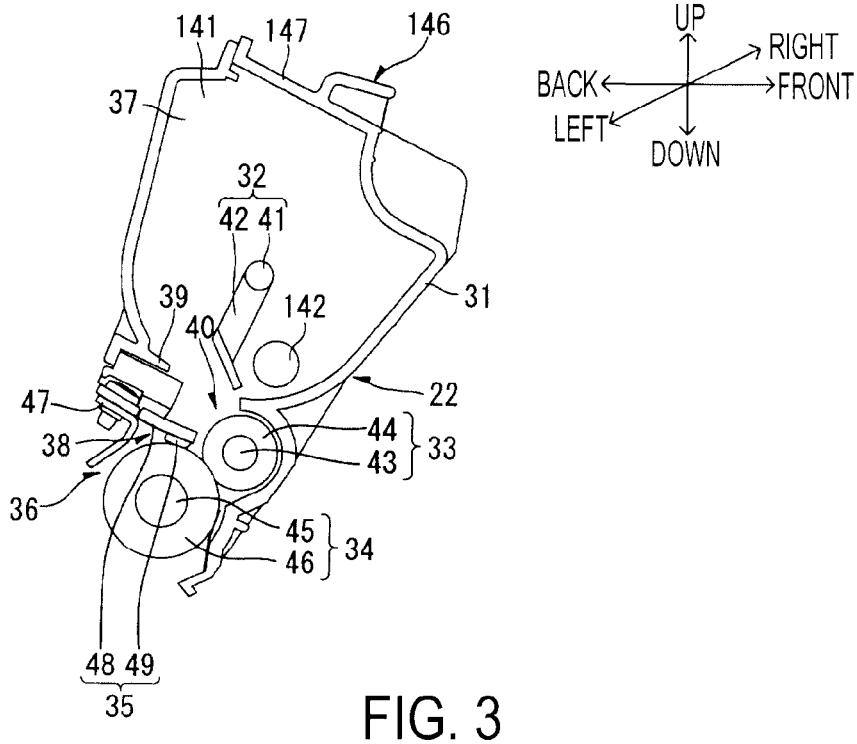
FIG. 3 is a lateral cross-sectional view that shows a portion of the developing cartridge shown in FIG. 2 in accordance with aspects of the present invention.

FIG. 1 is a lateral cross-sectional view that shows a portion of an embodiment of a color laser printer as an image forming device according to one or more aspects of the present invention. FIG. 2 is a lateral cross-sectional view that shows a portion of the drum subunit, in which the developing cartridge is mounted, of the color laser printer shown in FIG. 1. FIG. 3 is a lateral cross-sectional view that shows a portion of the developing cartridge shown in FIG. 2.

The color laser printer 1 shown in FIG. 1 is a transverse tandem-type color laser printer in which the multiple drum subunits 23 that are described in a later section are provided in parallel in the horizontal direction. The color laser printer 1 may also include a paper feed 4 that feeds paper 3, image formation portion 5 that forms the image on the fed paper 3, and a paper discharge portion 6 that discharges paper 3 where an image is formed in the main body casing 2. The main body casing 2 may be an image forming device body.

The color laser 1 may alternatively include an intermediate image transfer belt (where images from drum subunits 23 provide developer to an intermediate image transfer belt, that later transfers and image to a print medium) used with drum subunits 23 or a photosensitive belt that replaces drum subunits 23.

In the following explanation, the right side of the paper in FIG. 1 (the side in which the drum inserting/removing opening 162 is formed on the main body casing 2) is the front side of the laser printer 1, and the left side of the paper in FIG. 1 is the rear side of the color laser printer 1. In addition, the near side in the direction of the paper thickness in FIG. 1 is the left side and the far side in the direction of the paper thickness in FIG. 1 is the right side.

Furthermore, unless specifically mentioned, the following directions are the direction in the condition in which the developing cartridge 22 is installed in the main body casing 2.

(1) Paper Feed

Paper feed 4 is insertable/removable by sliding the paper feed 4 in the front/rear direction from the front of the tray container 171 of the main body casing 2 at the bottom of the main body casing 2. Paper feed 4 includes a paper feed tray 7 that holds paper 3, a separation roller 8, separation pad 9, and a paper feed roller 10. The paper feed tray 7, the separation roller 8, and the separation pad 9 are provided so that they face each other at the top front edge of the paper feed tray 7. The paper feed roller 10 is provided next to the separation roller 8.

The paper feed side pathway 11 of paper 3 is formed in an approximately U-shape. Paper 3 is fed towards the front. After paper 3 is flipped, paper 3 is discharged in a direction toward the rear side of the image forming device. As a result, the upstream edge of paper 3 is positioned adjacent to the separation roller 8 at the bottom. Also, the downstream edge of the paper 3 is positioned adjacent to the feed belt 53 in the paper feed 4.

Paper dust removing roller 12 and pinch roller 16 may be provided on the front top of the separation roller 8. The paper dust removing roller 12 and pinch roller 16 may also face each other. A pair of resist rollers 14 may be provided on top of paper dust removing roller 12 and pinch roller 13. The paper dust removing roller 12, pinch roller 13, and the pair of resist rollers 14 may be provided in the middle of the paper side feed pathway 11.

A paper pressing plate 15 that contacts the layers of paper 3 may be provided inside the paper feed tray 7. The paper pressing plate 15 may be supported at the rear edge in a movable manner so that the paper pressing plate 15 can move between a loading position (contacting a floor plate of the paper feed tray 7 where the front edge portion is positioned at the bottom of the paper feed tray 7), and the paper feed position (where the front edge portion of the paper pressing plate 15 is positioned at the top of the paper feed tray 7).

In addition, a lever 16 is provided at the front edge bottom of the paper feed tray 7. Lever 16 lifts the front edge of the paper pressing plate 15 upwards. Lever 16 is supported at the bottom of the front edge of the paper pressing plate 15. Lever 16 moves vertically.

With the movement of the lever 16, the front edge of the paper pressing plate 15 is lifted by the lever 16. Also, the paper pressing plate 15 moves upward into a paper feed position (from which paper is retrieved).

When the paper pressing plate 15 is positioned at the paper feed position, the paper 3 at the top on the paper pressing plate 15 is pressed by the paper feed roller 10. Paper 3 is then fed between the separation roller 8 and separation pad 9 by the rotation of the paper feed roller 10.

When the paper feed tray 7 is removed from the main body casing 2, the paper pressing plate 15 is positioned at the loading position. When the paper pressing plate 15 is positioned at the loading position, the paper 3 can be loaded in layers on the paper pressing plate 15.

Next, the fed paper 3 is sandwiched between the separation roller 8 and separation pad 9. When the separation roller 8 rotates, paper 3 is fed in individual sheets. The fed paper 3 then passes between the paper dust removing roller 12 and pinch roller 13. Here, paper dust on paper 3 is then removed. The paper 3 is then fed along the paper side feed pathway 11 towards the resist roller 14.

The resist roller 14 temporarily stops the forward movement of paper 3. Next, resist roller 14 rotates and then feeds the paper 3 to the feed belt 53.

(2) Image Forming Portion

The image forming portion 5 includes a scanner 17, a processing unit 18, a transfer portion 19, and a fixing portion 20.

(2-1) Scanner

The scanner 17 is arranged on the top of the main body casing 2. Although not shown in the drawing, scanner 17 may includes a laser emitter, a polygon mirror, multiple lenses, and a reflective mirror (or other known scanner parts). At the scanner 17, a laser beam emitted from the laser emitter is based on image data corresponding to each color used in the image forming device 1. The laser beam is then reflected by the rotating polygon mirror. The laser then passes through or is reflected by the multiple lenses or reflective mirror. The laser is then output in correspondence to each of the image carriers 24 relating to the color associated with each image carrier 24.

(2-2) Processing Unit

The processing unit 18 may be positioned below the scanner 17 and above the paper feed 4. The processing unit 18 may include a drum unit 21, and four developing cartridges 22 (with each developing cartridge 22 corresponding to one of the toner colors in the image forming device 1, respectfully).

(2-2-1) Drum Unit

The drum unit 21 may be mounted on the drum container 161 of the main body casing 2 from the front of the casing 2. The drum unit 21 may be inserted from the front of the casing 2 to the rear of the casing 2. Further, the drum unit may be subsequently removed.

This drum unit 21 may include a photoconductor cartridge and four drum subunits 23. Each of the drum subunits 23 may correspond to one of the toner colors, thereby forming an image carrier unit. More particularly, the drum subunit 23 includes four parts, which are a yellow drum subunit 23Y, a magenta drum subunit 23M, a cyan drum subunit 23C, and a black drum subunit 23K.

Each of the drum subunits 23 is arranged in parallel at intervals in the front and back direction. For instance, the drum subunits 23 may be arranged from the front to back in the following order: yellow drum subunit 23Y, magenta drum subunit 23M, cyan drum subunit 23C, and black drum subunit 23K.

Each of the drum subunits 23 includes (as described below) a left side frame 70, a right side frame 71, and a center frame 72 (see FIG. 4).

Each of the drum subunits 23, as shown in FIG. 2, may include a photosensitive drum as image carrier 24, a scorotron-type charger 25, and a cleaning brush 68.

The image carrier 24 is arranged in the width direction (left and right direction). The image carrier 24 may include a cylindrical drum body 26. The top surface of the cylindrical drum body 26 may be made of a positively charged photoconductive polycarbonate layer. The image carrier 24 may also include a drum shaft 27 arranged along the axis direction of the drum body 26.

The ends of the drum shaft 27 are inserted in the right side frame 71 and the left side plate 95 of the center frame 72 (see FIG. 4), respectively. Also, the ends of the drum shaft 27 are aligned by the side plate 121 (see FIG. 7).

Rotary supporting members 30 (see FIG. 9) fit snuggly onto both ends of image carrier 24 so that the drum body 26 and the drum shaft 27 cannot rotate relative to each other. The rotary supporting members 30 are supported by the outside periphery of the drum shaft 27. By doing so, the drum body 26 is supported by the drum shaft 27 in a rotatable manner. During the image formation, a driving force from a motor (in main body casing 2) is transmitted to the image carrier 24. In response, the image carrier 24 rotates.

A scorotron-type charger 25 faces the image carrier 24 with a diagonal gap on the top rear of the image carrier 24. The scorotron-type charger 25 is supported by the center frame 72. This scorotron-type charger 25 includes a discharging wire 28 that faces the image carrier 24. Between the discharging wire 28 and the image carrier 24 is a gap. A grid 29 is provided between the discharging wire 28 and the image carrier 24.

A wire electrode 80 (see FIG. 5) is connected to the discharging wire 28. The grid electrode 81 (see FIG. 5) is connected to the grid 29.

During image formation, a high voltage is applied to the discharging wire 28 via the wire electrode 80 from the high voltage substrate in the main body casing 2. The discharging wire 27 performs corona discharging at the same time a voltage is applied to the grid 29 via the grid electrode from the high voltage substrate. As a result, the surface of the image carrier 24 is uniformly positively charged while the electric charge supplied to the image carrier 24 is controlled.

A cleaning brush 68 contacts the image carrier 24 at the rear of the image carrier 24. The cleaning brush 68 is supported by the center frame 72. During the image formation, a cleaning bias is applied to the cleaning brush 68 from the high voltage substrate via the cleaning electrode (see FIG. 5).

(2-2-2) Developing Cartridge

As shown in FIG. 1, the developing cartridges 22 are arranged so that they can be attachable/removable from the drum subunits 23 that correspond to each color. The developing cartridges 22 may include four parts, which are a yellow developing cartridge 22Y that is insertably/removably mounted on the yellow drum subunit 23Y, a magenta developing cartridge 22M that is insertably/removably mounted on the magenta drum subunit 23M, and a cyan developing cartridge 22C that is insertably/removably mounted on the cyan drum subunit 23C, and a black developing cartridge 22K that is insertably/removably mounted on the black drum subunit 23K.

As shown in FIG. 3, each of the developing cartridges 22 may include a developing frame 31 (as an example of a casing), an agitator 32, and a supplying roller 33 (provided in the developing frame 31), a developer carrier 34 (an example of a developing powder carrier), and a layer thickness limiting blade 35.

Figure 11:
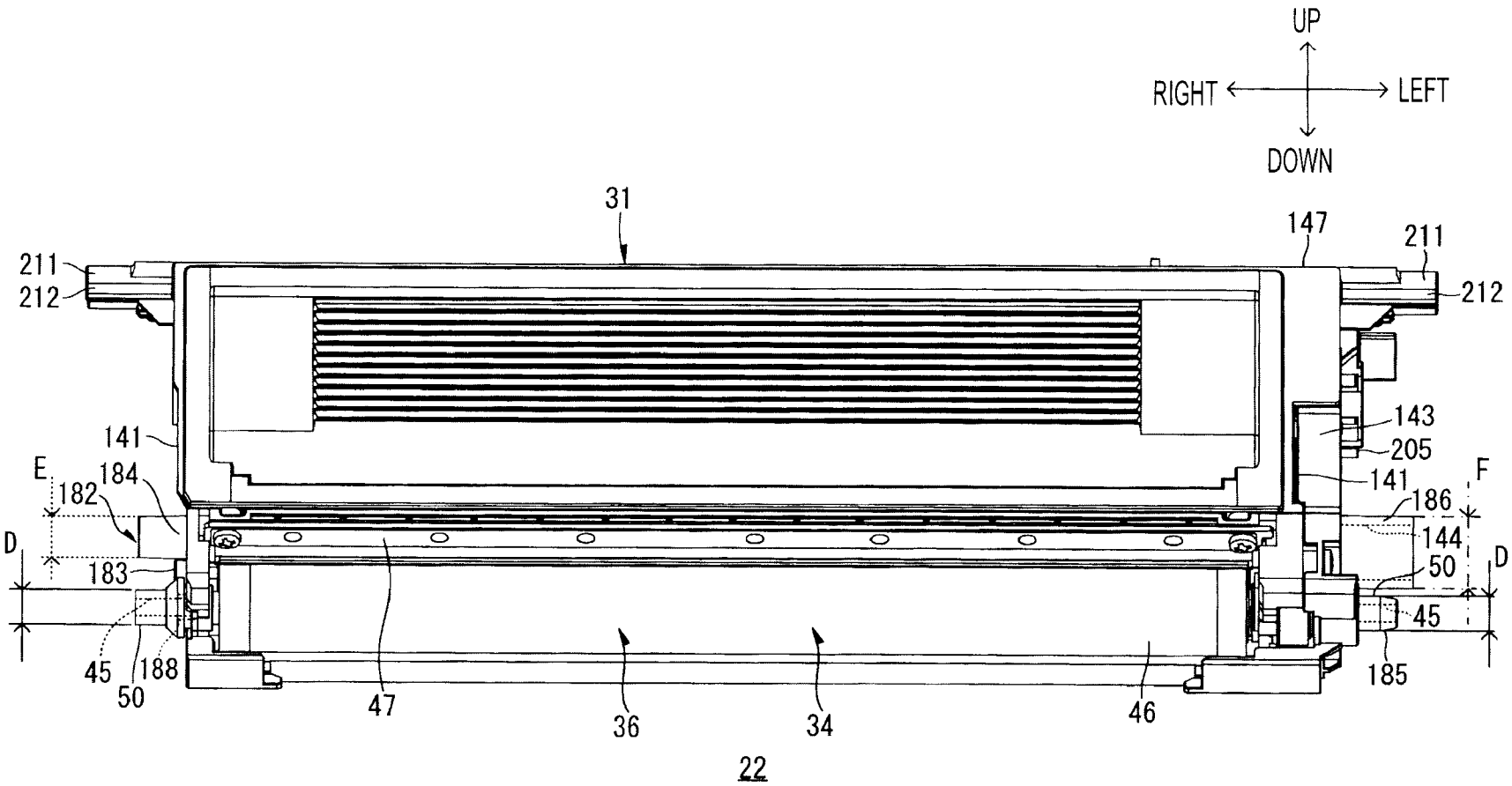
FIG. 11 is a back view of the developing cartridge in accordance with aspects of the present invention.

The developing frame 31 may be formed in a box shape in which an opening 36 opens at the bottom edge (see FIG. 11). The developing frame may be divided into a toner container 37 and a developing chamber 38 with a partition 39. A connecting hole 40 that connects the toner container 37 and developing chamber 38 may be provided on the partition 39.

Toner that corresponds to each color is contained in the toner containers 37, respectively. More specifically, the yellow developing cartridge 22Y may contain yellow toner, the magenta developing cartridge 22M may contain magenta toner, the cyan cartridge 22C may contain cyan toner, and the black developing cartridge 22K may contain black toner.

A positively charged polymerization toner with a non-magnetic single component may be used as the toner that corresponds to each color. The particles of the polymerization toner may be approximately spherical in shape. The main component of the toner may be a binding resin that can be obtained by copolymerizing styrene monomers such as styrene and acrylic monomers including but not limited to acrylic acid, alkyl (C1-C4) acrylate, and alkyl (C1-C4) metaacrylate (using publicly known polymerization methods such as suspension polymerization). The toner base particle may be formed by adding one or more coloring agents (to provide the various colors of the toner), a charge control agent, and wax. An additive may be added to improve flowability of the toner.

Coloring agents (for instance, yellow, magenta, cyan and black) are blended as coloring agents. In addition, a charge control resin (which can be obtained by the copolymerization of ionic monomers having an ionic function group such as an ammonium salt), monomers (that can be copolymerized with ionic monomers such as styrene monomers), and acrylic monomers may be blended as a charge control agent. In addition, inorganic powders may be blended as an additive. These inorganic powders may include metal oxide powders, such as silica, aluminum oxide, titanium oxide, strontium titanate, cerium oxide or magnesium oxide and carbide powders and metallic salt powders.

Windows 142 for detecting the remaining amount of toner contained in the toner container 37 are provided on the toner container 37. The windows are located on both sidewalls 141. The windows face each other over the toner container 43 (see FIG. 17).

An agitator 32 is provided in the toner container 37. The agitator 32 includes a rotary shaft 41. The rotary shaft 41 may be supported by both sidewalls 141 of the developing frame 31 so that the rotary shaft 41 can rotate. The agitator 32 may also include an agitating member 42 that is provided in the axis direction of the agitator rotary shaft 47. The agitating member 47 may extend externally from the rotary shaft in the direction of the diameter of the developing frame 31. During the image formation, a driving force is transmitted from a motor (not shown) to the rotary shaft 41. In response, the agitating member 42 revolves in the toner container 37.

The supplying roller 33 is provided in the developing chamber 38 below the connection hole 40. The supplying roller 33 includes a metallic supplying roller shaft 43 that is supported by both sidewalls 141 of the developing frame 31 so that the supplying roller 33 can rotate. The supplying roller 33 also includes a sponge roller 44 that may be made of a conductive sponge. The sponger roller 44 may also encircle the supplying roller shaft 43. During image formation, a driving force is transmitted from a motor to the supplying roller shaft 43 via the passive coupling gear 144 (see FIG. 12). In response, the supplying roller 38 rotates.

The developer carrier 34 is arranged diagonally against the diagonal back bottom of the developing chamber 38 relative to the supplying roller 33. This developer carrier 34 includes a metallic developer carrier shaft 45. The metallic developer carrier shaft 45 is supported by both sidewalls 141 of the developing frame 31 so that the carrier shaft 45 can rotate. The carrier shaft 45 is also supported by a rubber roller 46. The rubber roller 46 may be made of conductive rubber that covers the developer carrier shaft 45.

More specifically, the rubber roller 46 may have a two-layer structure that includes a rubber roller layer that is made of a conductive urethane rubber, a silicon rubber or EPDM rubber containing carbon microparticles, etc., and a coating layer that is coated on the surface of the rubber roller layer. A main component of the rubber roller layer may be a resin with superior anti-abrasive performance such as urethane rubber, a urethane resin, or a polyimide resin. In addition, a feed coil 155 (see FIG. 5) as a feeder of the developer carrier electrode 82 may be used with the developer carrier shaft 45 when the developing cartridge 22 is inserted in the drum sub-unit 23.

The developer carrier 34 can be arranged so that the rubber roller 46 and sponge roller 44 contact each other with pressure relative to the supplying roller 33. In addition, the developer carrier 34 can be arranged so that the developer carrier 34 is exposed downstream from the opening 36 of the developing chamber 38 (see FIG. 11).

During image formation, a driving force is transmitted from a motor (not shown) to the developer carrier shaft 45. In response, the developer carrier 34 rotates. In addition, a developing bias is applied from the high voltage substrate (not shown) via the developer carrier electrode 82 and feed coil 155.

The layer thickness limiting blade 35 contacts an upper side of the developer carrier 34 with pressure in the developing chamber 38. The layer thickness limiting blade 35 includes a blade 48 that includes a metal plate spring member and a pressing portion 49 with a semi-circular cross-section. The pressing portion 49 is provided on the unattached end of the blade 48. The pressing portion 49 may be made of insulating or conductive silicone rubber or urethane rubber.

The anchored end of the blade 48 is fastened to the partition 39 by a fastening member 47. The blade 48 may be elastic. Because of this elasticity of the blade 48, the pressing portion 49 provided on the loose end of the blade 48 is evenly pressed against the top of rubber roller 46 of the developer carrier 34.

(2-2-3) Developing Operation at the Processing Unit

As shown in FIG. 3, the toner contained in the toner container 37 moves downward to the connection hole 40 at least in part because of the weight of the toner. While being agitated by the agitator 32, the toner is discharged through the connection hole 40 toward the developing chamber 38.

Next, the toner is discharged from the connection hole 40 to the developing chamber 38. From the developing chamber 38, the toner is supplied to the supplying roller 33. The toner supplied by the supplying roller 33 is conveyed to the developer carrier 34 by the rotation of the supplying roller 33. During rotation of supplying roller 33, a positive frictional charge is generated between the supplying roller 33 and the developer carrier 34 where the developing bias is applied.

The toner supplied to the developer carrier 34 enters between the pressing portion 49 of the layer limiting blade 35 and the rubber roller 46 of the developer carrier 34. The supply of the toner is assisted by the rotation of the developer carrier 34. The toner is transported on the surface of the rubber roller 46 as a thin layer with a relatively constant thickness.

As shown in FIG. 2, in the drum subunits 23, the scorotron-type charger 25 generates a corona discharge. The scorotron-type charger 25 charges the surface of the image carrier 24 with a uniform positive charge.

The surface of the image carrier 24 is uniformly positively charged by the scorotron-type charger 25 as the image carrier 24 is rotated. Next, the surface of the image carrier 24 is exposed by the high speed scanning of the laser beam from the scanner 17. The scanning imparts an electrostatic lateral image that corresponds to the image to be formed on the paper 3.

When the image carrier 24 contacts the developer carrier 34, the toner on the surface of the developer carrier 34 is transferred to the surface of the image carrier 24 in the shape of the latent electrostatic image provided by the scanning of the laser. The exposed portion where the electric potential is low is due to the exposure by the laser beam on the surface of the uniformly positively charged image carrier 24. Using this process, the electrostatic latent image of the image carrier 24 is developed to be a visible image. The toner image by the reversal development is performed for each color on the surface of the image carrier 24.

The remaining toner that remains on the image carrier 24 after toner transfer to the paper is collected by the developer carrier 34. The paper dust from the paper 3 that is remains on the image carrier 24 is then collected by the cleaning brush 68.

(2-3) Transfer Portion

Referring to FIG. 1, the transfer portion 19 is arranged in the main body casing 2 above the paper feed 4 and below the processing unit 18, along the front and back direction. This transfer portion 19 includes a driving roller 51, a driven roller 52, a feed belt 53, a transfer roller 54, and a cleaning portion 55.

The driving roller 51 and driving roller 52 face each other with a gap in the front and back direction. The driving roller 51 is arranged on the back side of the black drum subunit 23K. The driven roller 52 is arranged on the front side of the yellow drum subunit 23Y.

The feed belt 53 may be an endless belt. The feed belt 53 is made of a resin film such as a conductive polycarbonate and polyimide. Conductive particles (such as carbon) may be on or in the resin film. The feed belt 53 is conveyed between the driving roller 51 and the driven roller 52.

During image formation, a driving force is transmitted from a motor. The driving force is provided to the driving roller 51. In response, the driving roller 51 rotates. Then, the feed belt 53 is then conveyed between the driving roller 51 and the driven roller 52 at the transferring position. The transferring position is where the feed belt 53 contacts the image carrier 24 of each of the drum subunits 23. The feed belt 53 rotates in the opposite direction from the image carrier 24 at the same time the driven roller 52 is driven.

The transfer rollers 54 are arranged along the path of the feed belt so that the transfer rollers contact an opposite side of the feed belt 53 from the image carriers 24. Each of the transfer rollers 54 has a metal roller shaft with a rubber roller, which is made with conductive rubber. In addition, each of the transfer rollers 54 is arranged at the transferring position and contacts the feed belt 53 so that each transfer roller 54 is driven and rotates in the same direction as the revolving direction of the feed belt 53. During image formation, a transfer bias is applied from the high voltage substrate.

The cleaning portion 55 is provided below the feed belt 53. The cleaning portion 55 includes a primary cleaning roller 56, a secondary cleaning roller 57, a scraping blade 58, and a toner storage 59.

The primary cleaning roller 56 contacts the bottom of the feed belt 53. The bottom of the feed belt 53 is on the opposite side from the top of the feed belt 53 (where the image carrier 24 and the transfer roller 54 contact the feed belt 53). During image formation, the primary cleaning bias is applied to the primary cleaning roller 56 from the high voltage substrate.

The secondary cleaning roller 57 contacts the primary cleaning roller 56 on the bottom side of the primary cleaning roller 56. At this location, the secondary cleaning roller 57 rotates in the same direction as the rotation direction of the primary cleaning roller 56. Also, during image formation, a secondary cleaning bias is applied to the secondary cleaning roller 57 from the high voltage substrate.

The scraping blade 58 contacts the bottom of the secondary cleaning roller 57.

The toner storage 59 is arranged below the primary cleaning roller 56 and the secondary cleaning roller 57 so that toner storage 59 accumulates the toner dropped from the secondary cleaning roller 57.

The paper 3 fed by the paper feed 4 is carried by the feed belt from the front side to the back side so that paper 3 passes through the transfer positions at each of the drum subunits 23 in sequence. The toner images in each color on the image carrier 24 of each of the drum subunits 23 are transferred in sequence to paper 3. Accordingly, a color image is formed on the paper 3.

In other words, for example, after a yellow toner image on the surface of the image carrier 24 of the yellow drum subunit 23Y is transferred to the paper 3, the magenta toner image (on the surface of the image carrier 24 of the magenta drum subunit 23M) and the cyan toner image (on the surface of the image carrier 24 of the cyan drum subunit 23C) are transferred in layers. Next, a black toner image on the surface of the image carrier 24 of the black drum subunit 23K is transferred to the paper 3. The result is a color image formed on paper 3.

During the transfer operation, the toner attached on the surface of the feed belt 53 is transferred at the cleaning portion 55. First, the toner is transferred from the surface of the feed belt 53 to the primary cleaning roller 56 by the primary cleaning bias. Next, the toner is transferred to the secondary cleaning roller 57 by the secondary cleaning bias. The toner transferred to the secondary cleaning roller 57 is next scraped by the scraping blade 58. The toner then falls from the secondary cleaning roller 57 and accumulates in the toner storage 59.

(2-4) Fixing Portion

The fixing portion 20 is arranged on the rear side of the black drum subunit 23K so that the fixing portion 20 faces the transfer position where the image carrier 24 and the feed belt 53 contact each other in the front and back direction. This fixing portion 20 includes a heating roller 61 and pressurizing roller 62.

The heating roller 61 includes a metal tube (where a releasing layer is formed on the metal tube's surface) and a halogen lamp arranged in the axis direction of the heating roller 61. The surface of the heating roller 61 is heated to the fixing temperature by the halogen lamp.

The pressurizing roller 62 is arranged below the heating roller 61 and facing the heating roller 61. The pressurizing roller 62 presses the bottom of the heating roller 61. The paper 3 having the color image is conveyed to the fixing portion 20. As paper 3 passes between the heating roller 61 and the pressurizing roller 62, the thermal fixing of the toner on the paper 3 is performed.

(3) Paper Discharge Portion

At the paper discharge portion, the upstream side edge of the paper discharging side feed pathway 63 for the paper 3 is adjacent to the bottom of the fixing portion 20. The downstream side edge of the paper discharging side feed pathway 63 is adjacent to the top of the paper discharge tray 64. The paper discharging side feed pathway 63 is formed in an approximately U-shape from the side. Here, the paper 3 is fed towards the back, reversed, and then discharged to the front.

At the middle of the paper discharge side feed pathway 63, a feed roller 65 and pinch roller 66 face each other. In addition, a pair of paper discharge rollers 67 is provided on the downstream edge of the paper discharge side feed pathway 63.

Further, a paper discharge tray 64 is provided on the paper discharge portion 6. The paper discharge tray 64 is formed such that the top wall of the main body casing 2 gradually sags from the front to the back. Accordingly, the discharged paper 3 can be loaded in layers.

The paper 3 from the fixing portion 20 is carried along the paper discharging side feed pathway 63 by the feed roller 65 and the pinch roller 66. The paper 3 is then discharged into the paper discharge tray 64 by the paper discharge roller 67.

2. DRUM UNIT

Figure 4:
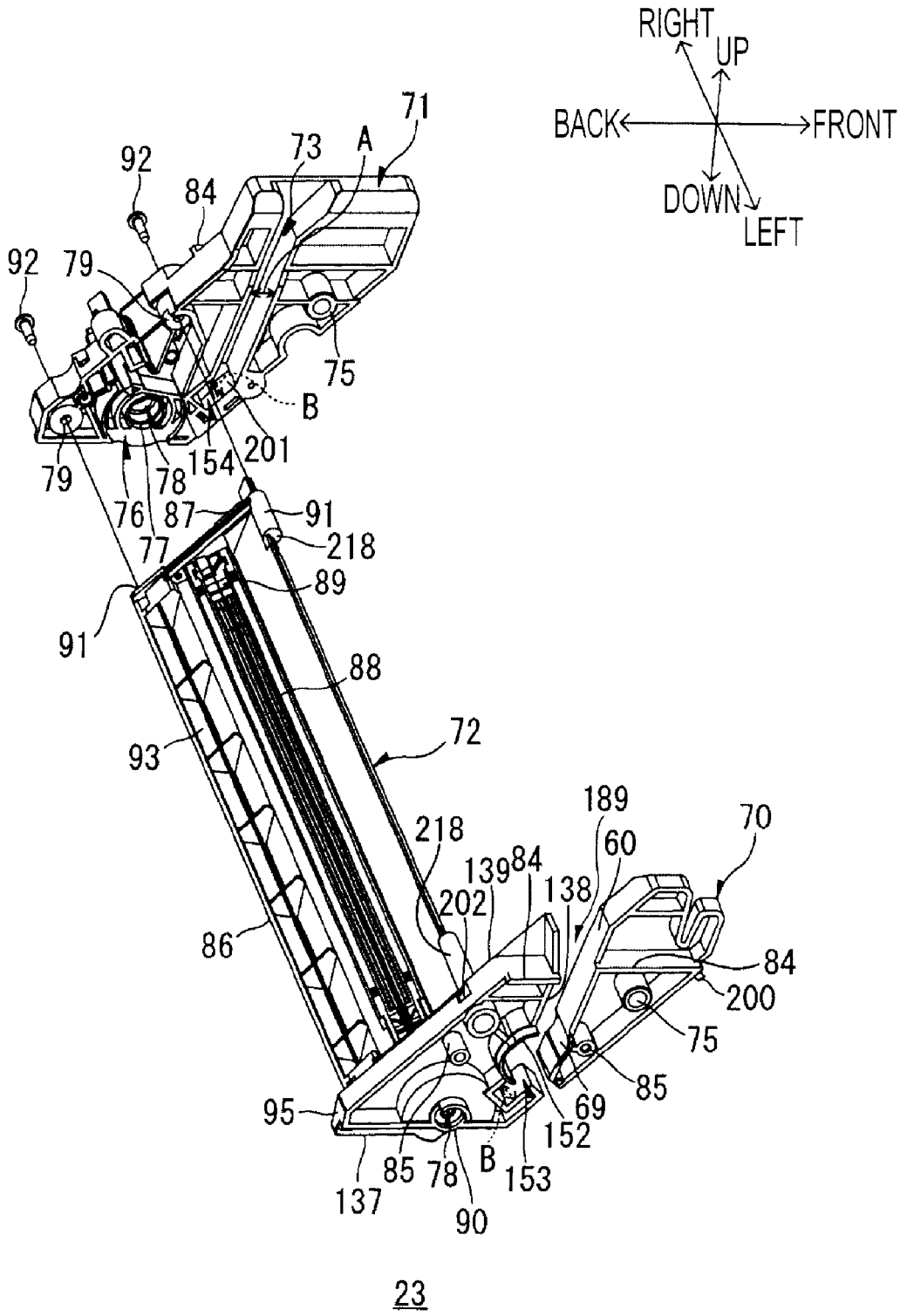
FIG. 4 is an exploded perspective view of the drum unit 26 in accordance with aspects of the present invention.
Figure 5:
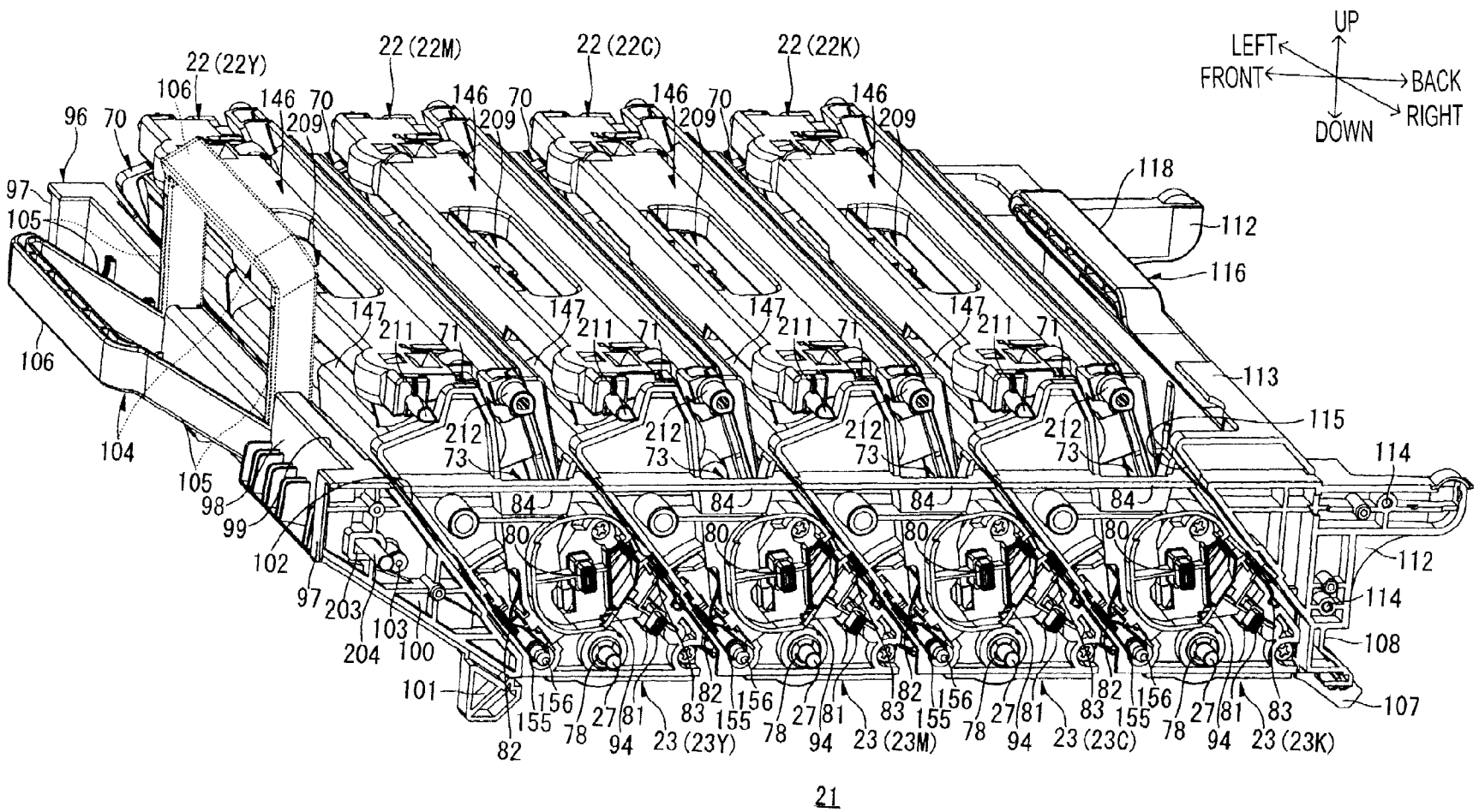
FIG. 5 is a right lateral perspective view that shows the condition in which a front beam, four drum subunits and a rear beam are arranged in parallel in accordance with aspects of the present invention.
Figure 6:
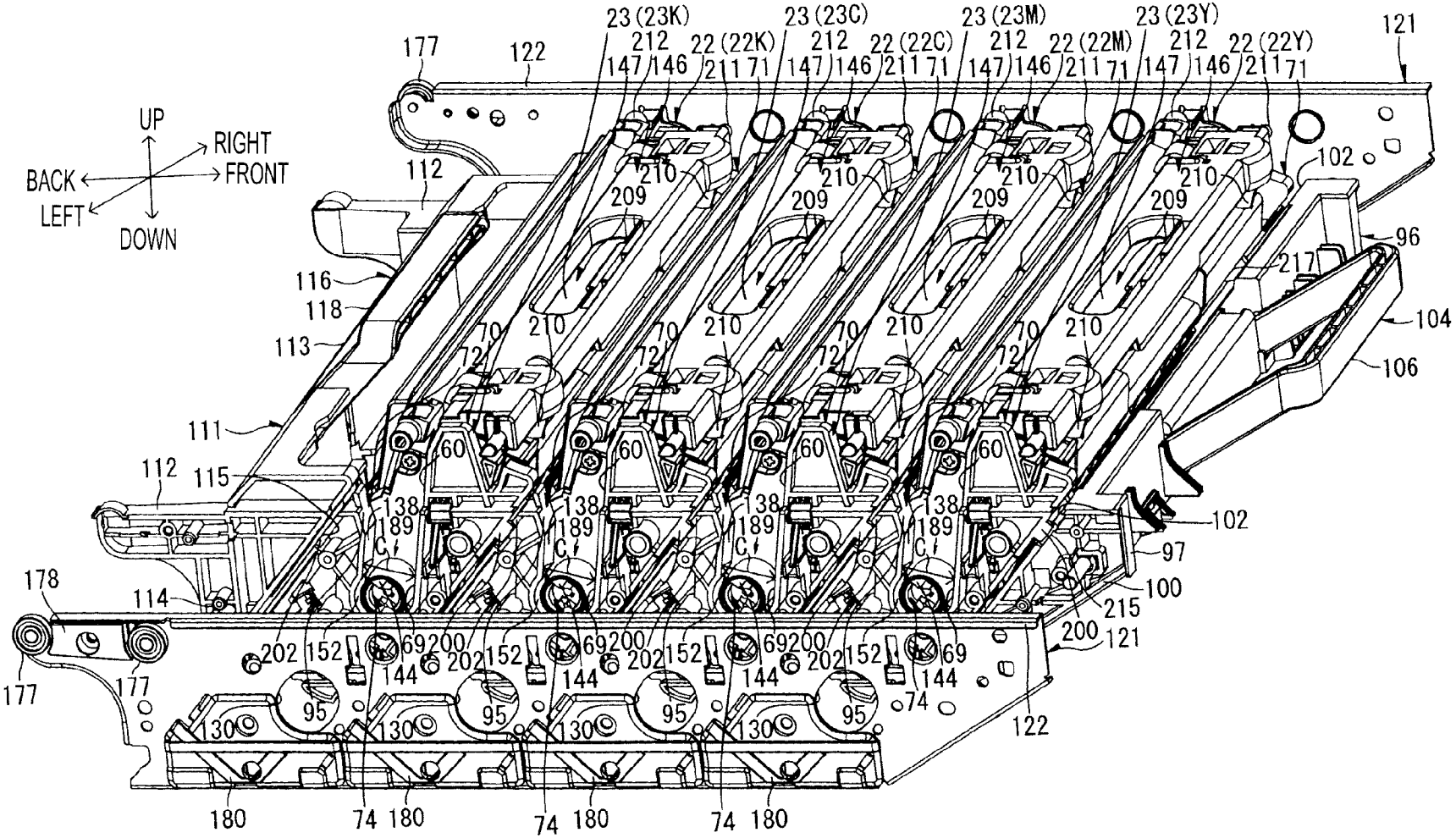
FIG. 6 is a left lateral perspective view that shows the condition in which a front beam, four drum subunits and a rear beam are arranged in parallel and a pair of side plates is assembled in accordance with aspects of the present invention.

FIG. 4 is an exploded perspective view of the drum unit 26. FIG. 5 is a right lateral perspective view that shows four drum subunits and a rear beam being arranged in parallel. FIG. 6 is a left lateral perspective view that shows a front beam, four drum subunits, and a rear beam being arranged in parallel and a pair of side plates.

Figure 7:
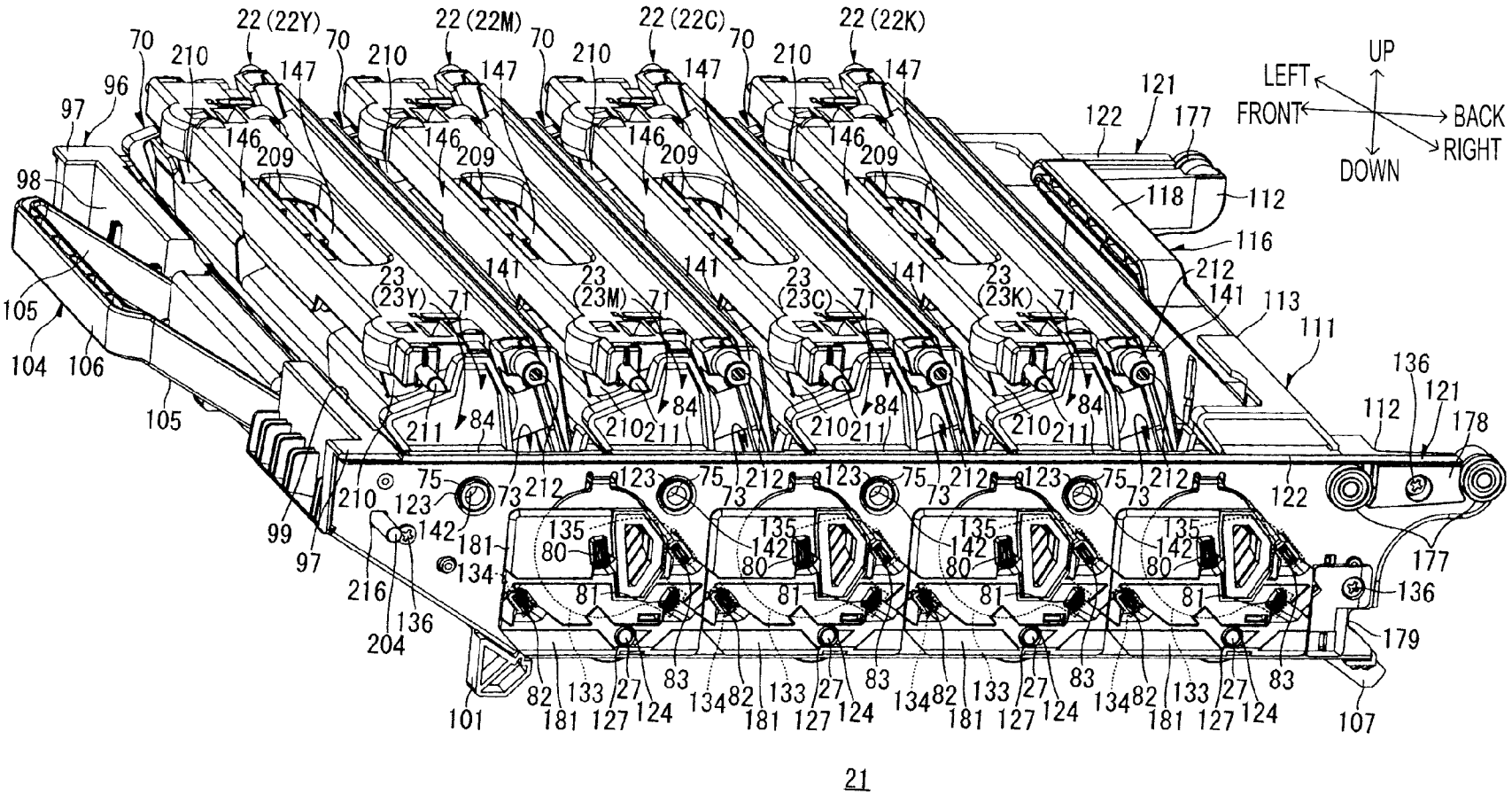
FIG. 7 is a right lateral perspective view of the drum unit in accordance with aspects of the present invention.
Figure 8:
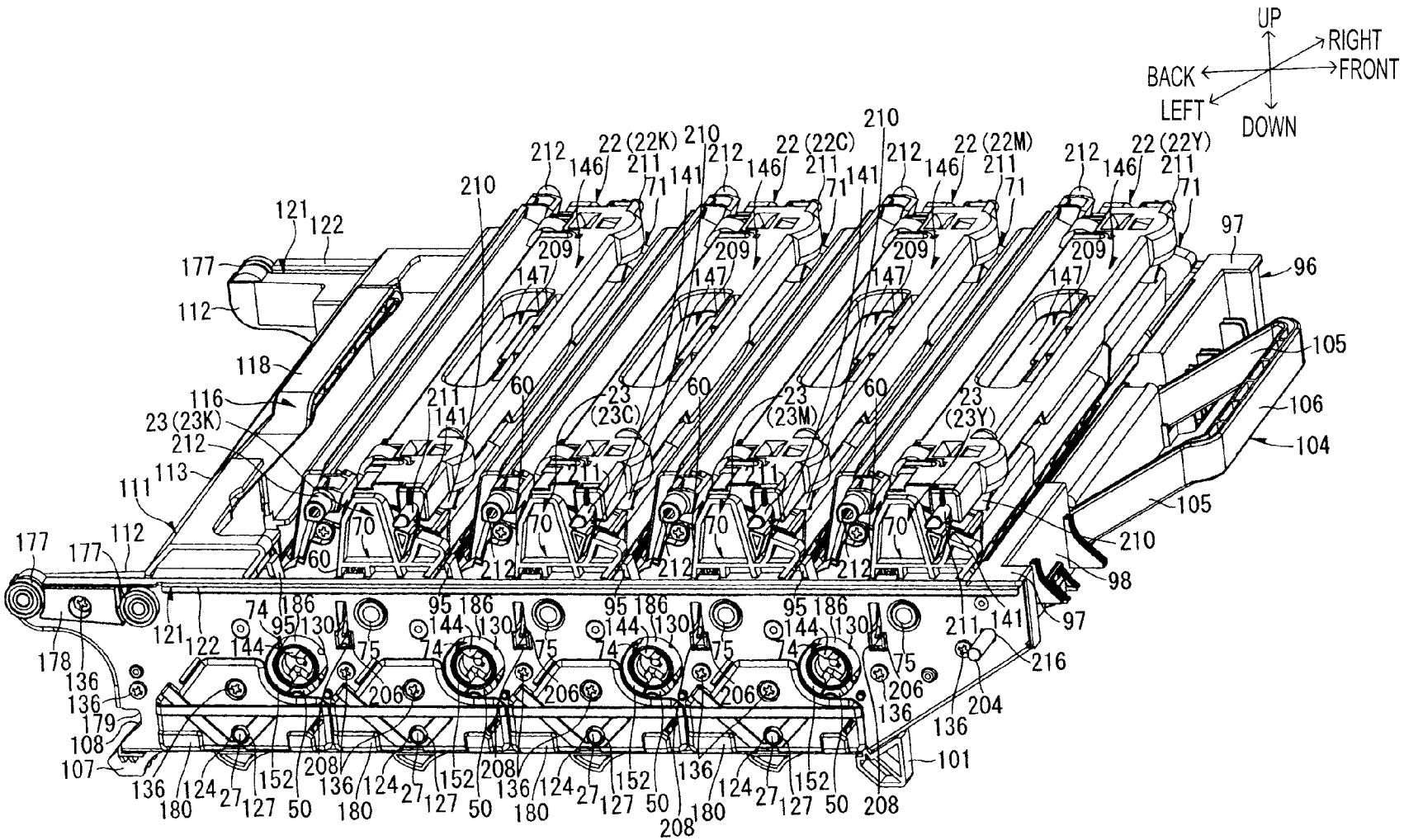
FIG. 8 is a left lateral perspective view of the drum unit in accordance with aspects of the present invention.
Figure 9:
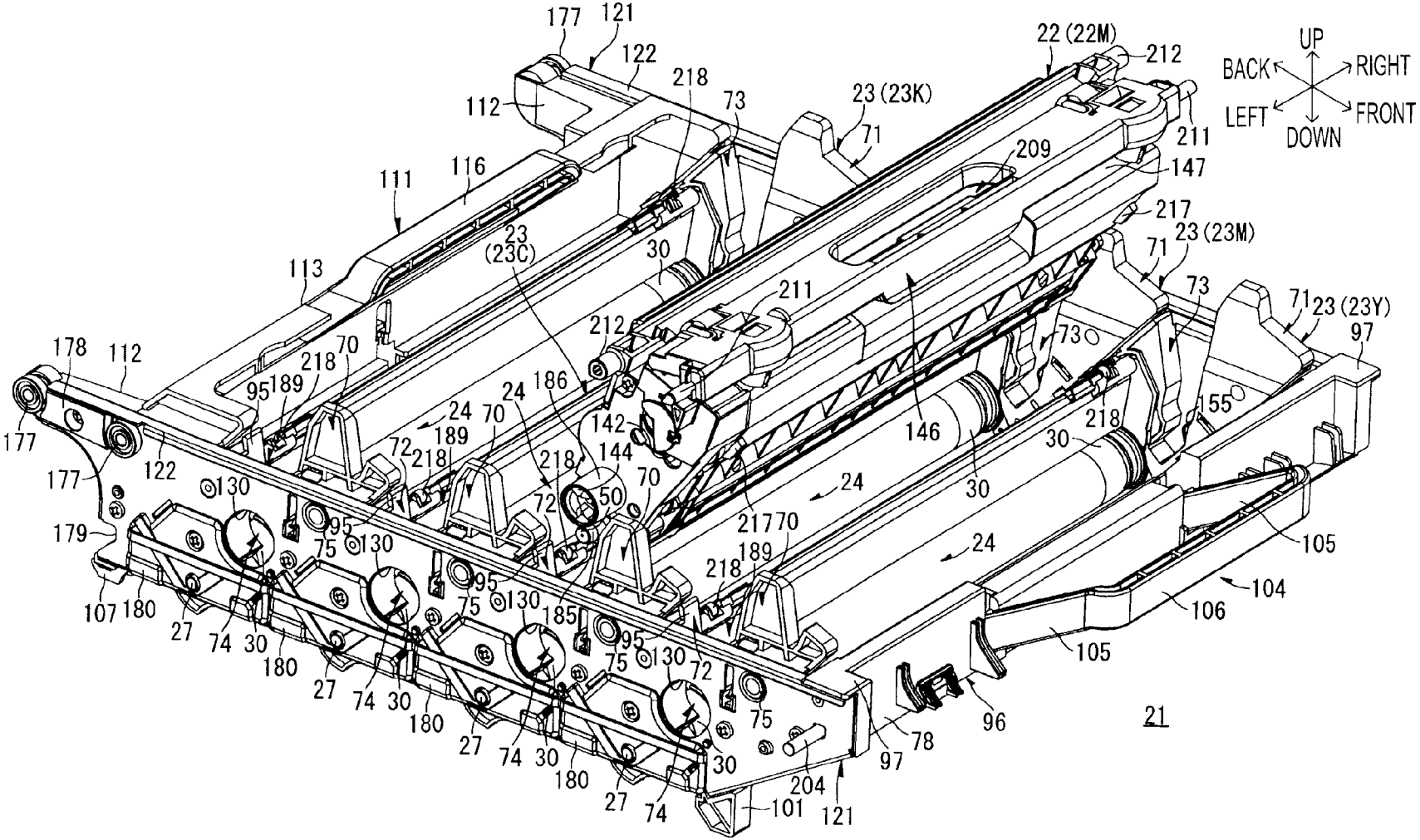
FIG. 9 is a left lateral perspective view that shows the installation of one of the developing cartridge to the drum unit in accordance with aspects of the present invention.
Figure 10:
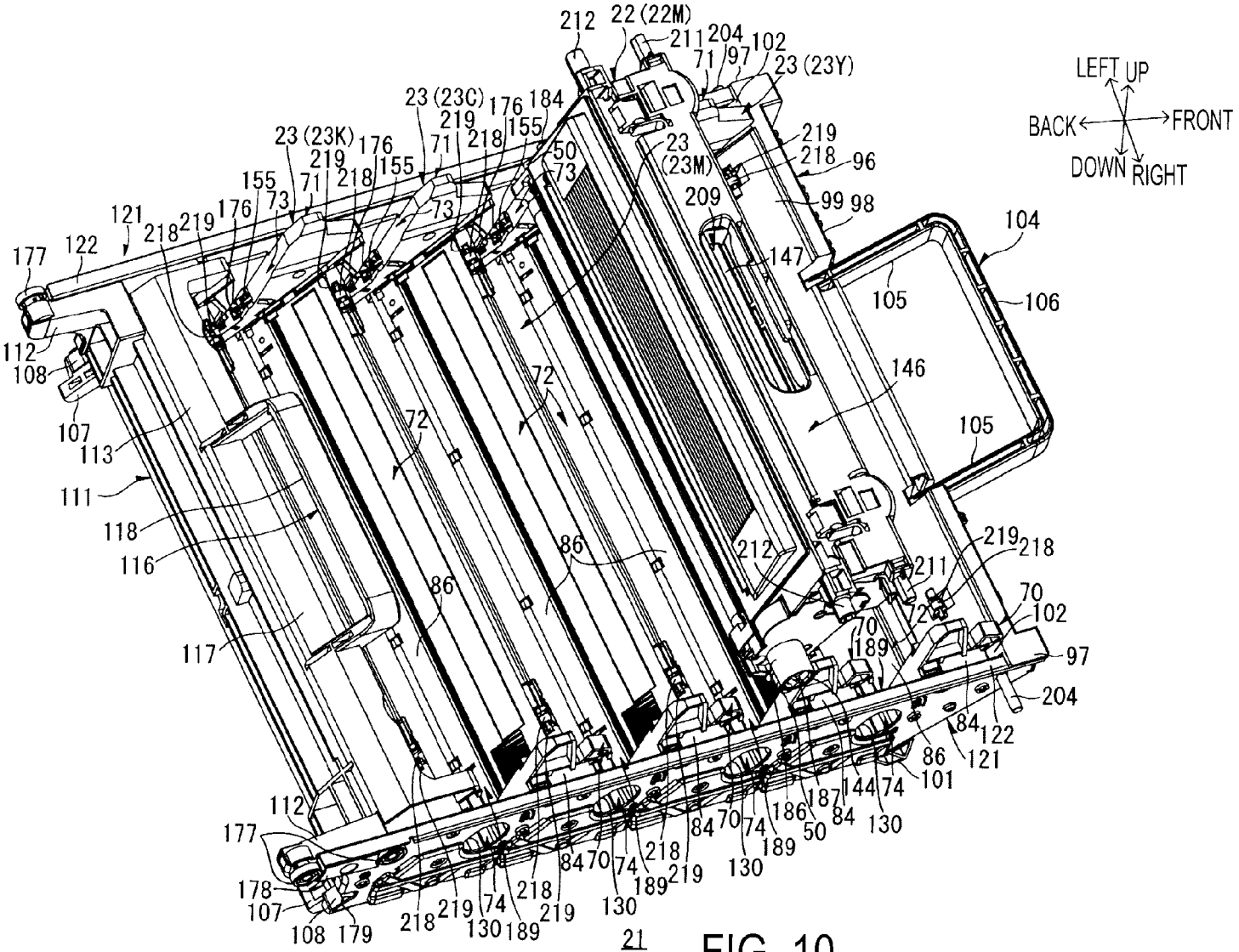
FIG. 10 is a left lateral view that is viewed from an upper perspective (compared to the perspective of FIG. 9), which shows the installation of one of the developing cartridge to the drum unit in accordance with aspects of the present invention.

FIG. 7 is a right lateral perspective view of the drum unit 21 (the developing cartridge is being installed). FIG. 8 is a left lateral perspective view of the drum unit 21 (the developing cartridge is being installed). FIG. 9 is a left lateral perspective view that shows the installation of one of the developing cartridge to the drum unit 21. FIG. 10 is a left lateral view that is viewed from the upper position compared to FIG. 9, where FIG. 10 shows the installation of one of the developing cartridge to the drum unit 21.

Figure 12:
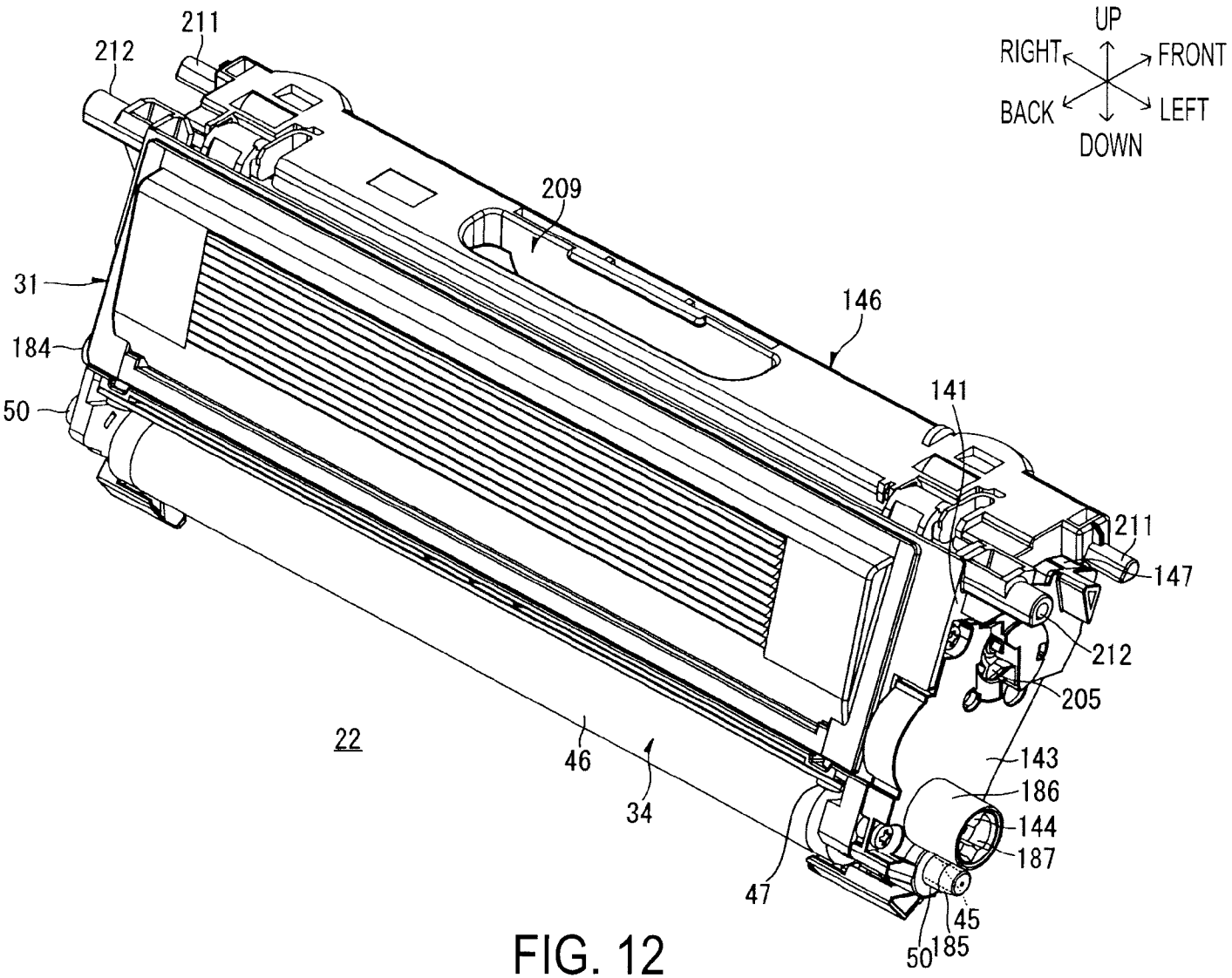
FIG. 12 is a left lateral perspective view of the developing cartridge showing the back lateral surface of the developing cartridge in accordance with aspects of the present invention.
Figure 13:
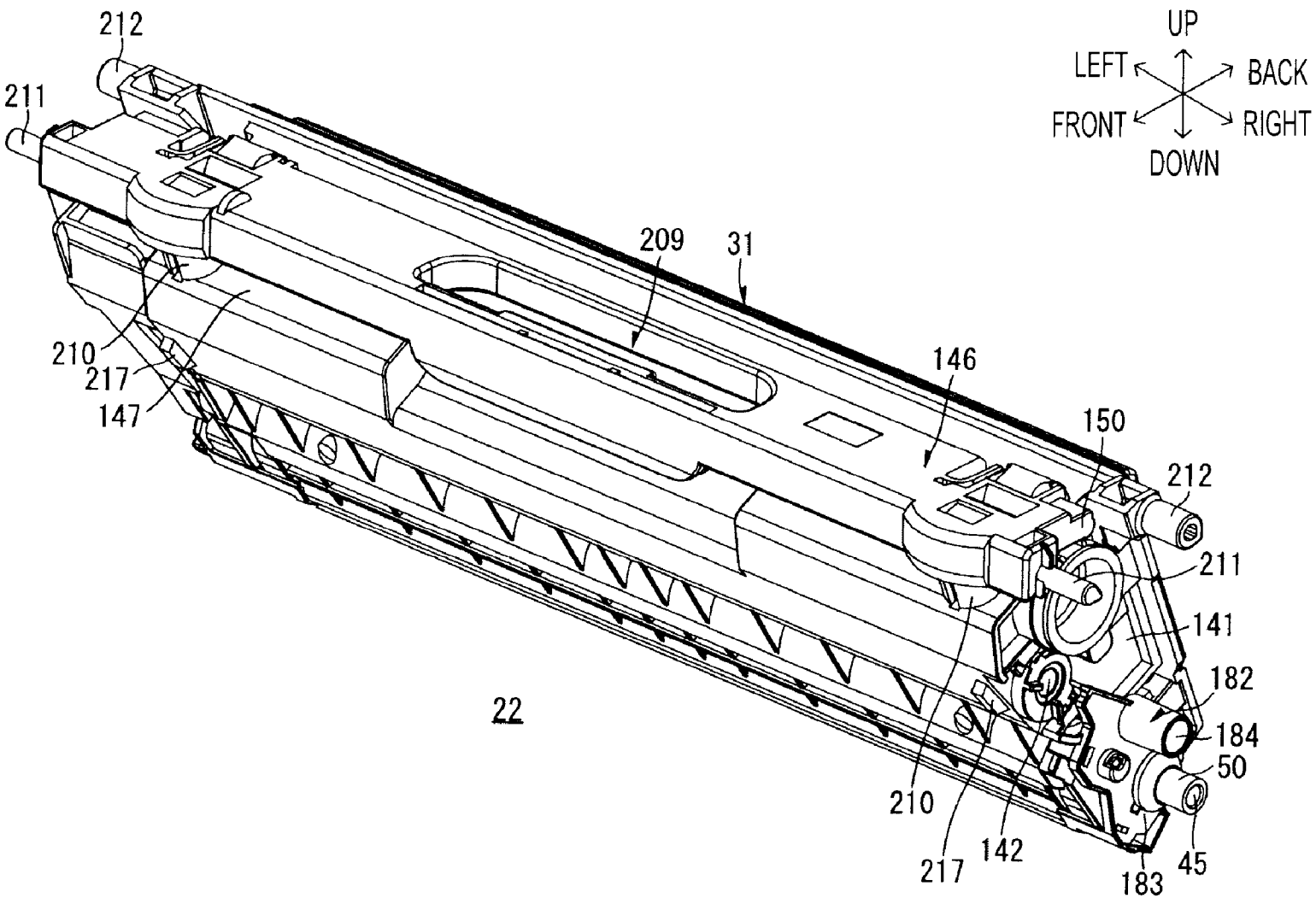
FIG. 13 is a right lateral perspective view of the developing cartridge showing the front lateral surface of the developing cartridge in accordance with aspects of the present invention.
Figure 14:
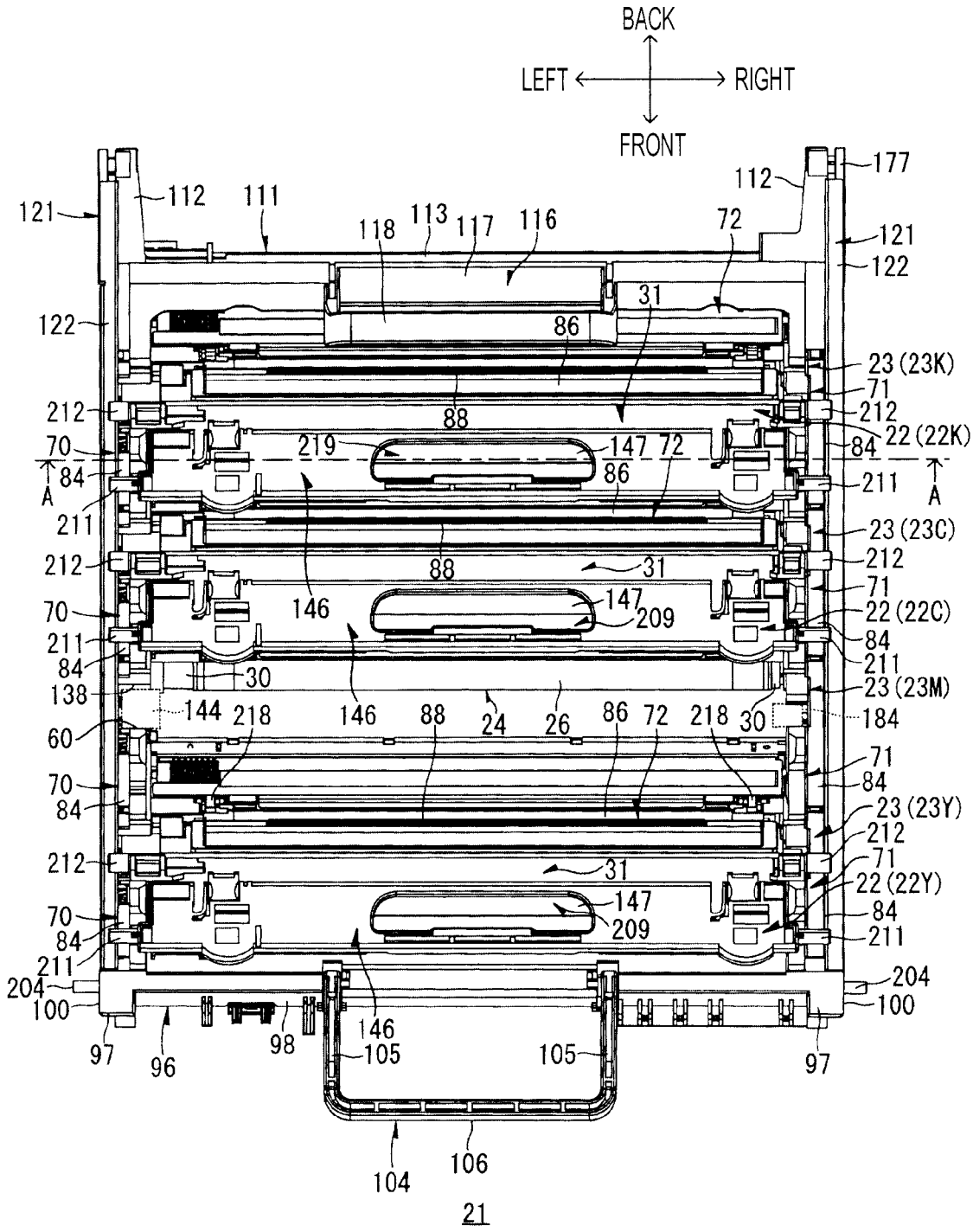
FIG. 14 is a plane view of the drum unit in which one of the developing cartridges is removed in accordance with aspects of the present invention.
Figure 15:
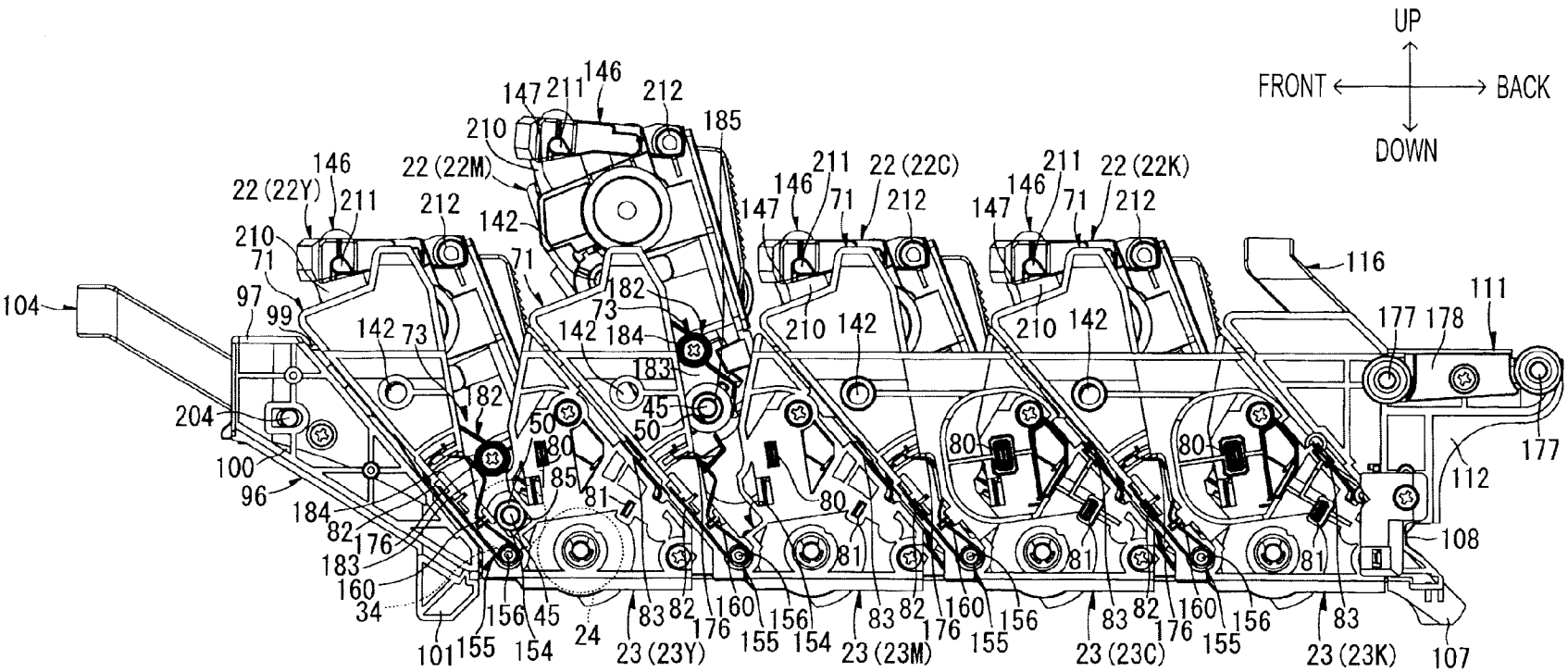
FIG. 15 is a right lateral view of the drum unit shown in FIG. 14, in which the side plate is removed and the right guiding groove of the two front side drum subunits is exposed for explanation in accordance with aspects of the present invention.
Figure 16:
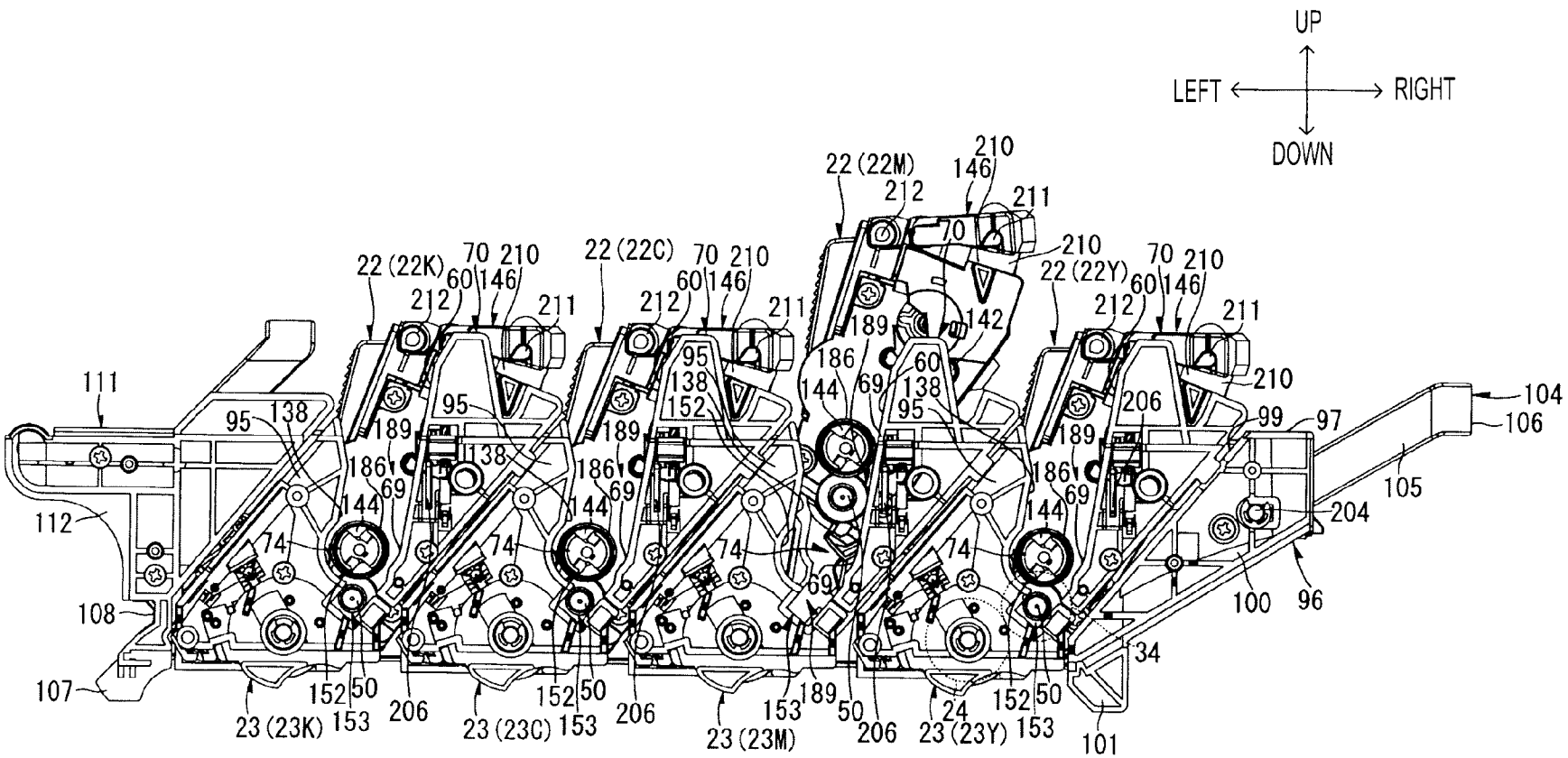
FIG. 16 is a left lateral view of the drum unit shown in FIG. 14, in which the side plate is removed in accordance with aspects of the present invention.
Figure 17:
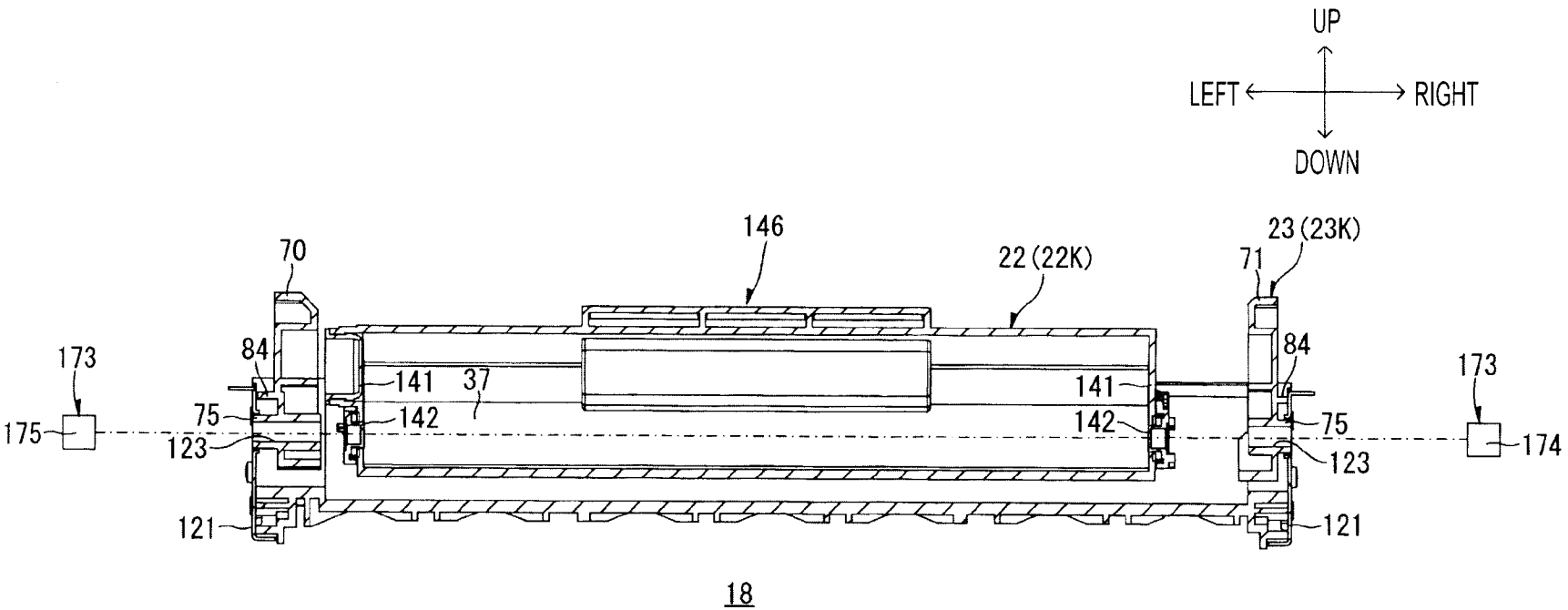
FIG. 17 is a cross-sectional view that is cut across the line A-A in FIG. 14 in accordance with aspects of the present invention.

FIG. 11 is a back view of the developing cartridge. FIG. 12 is a left lateral perspective view of the developing cartridge showing the back lateral surface of the developing cartridge. FIG. 13 is a right lateral perspective view of the developing cartridge showing the front lateral surface of the developing cartridge. FIG. 14 is a plane view of the drum unit 21 in which one of the developing cartridges is removed. FIG. 15 is a right lateral view of the drum unit 21 shown in FIG. 14, in which the side plate is removed and the right guiding groove of the two front side drum subunits 23 is exposed for explanation. FIG. 16 is a left lateral view of the drum unit 21 shown in FIG. 14, in which the side plate is removed. FIG. 17 is a cross-sectional view that is cut across the line A-A in FIG. 14.

Figure 22:
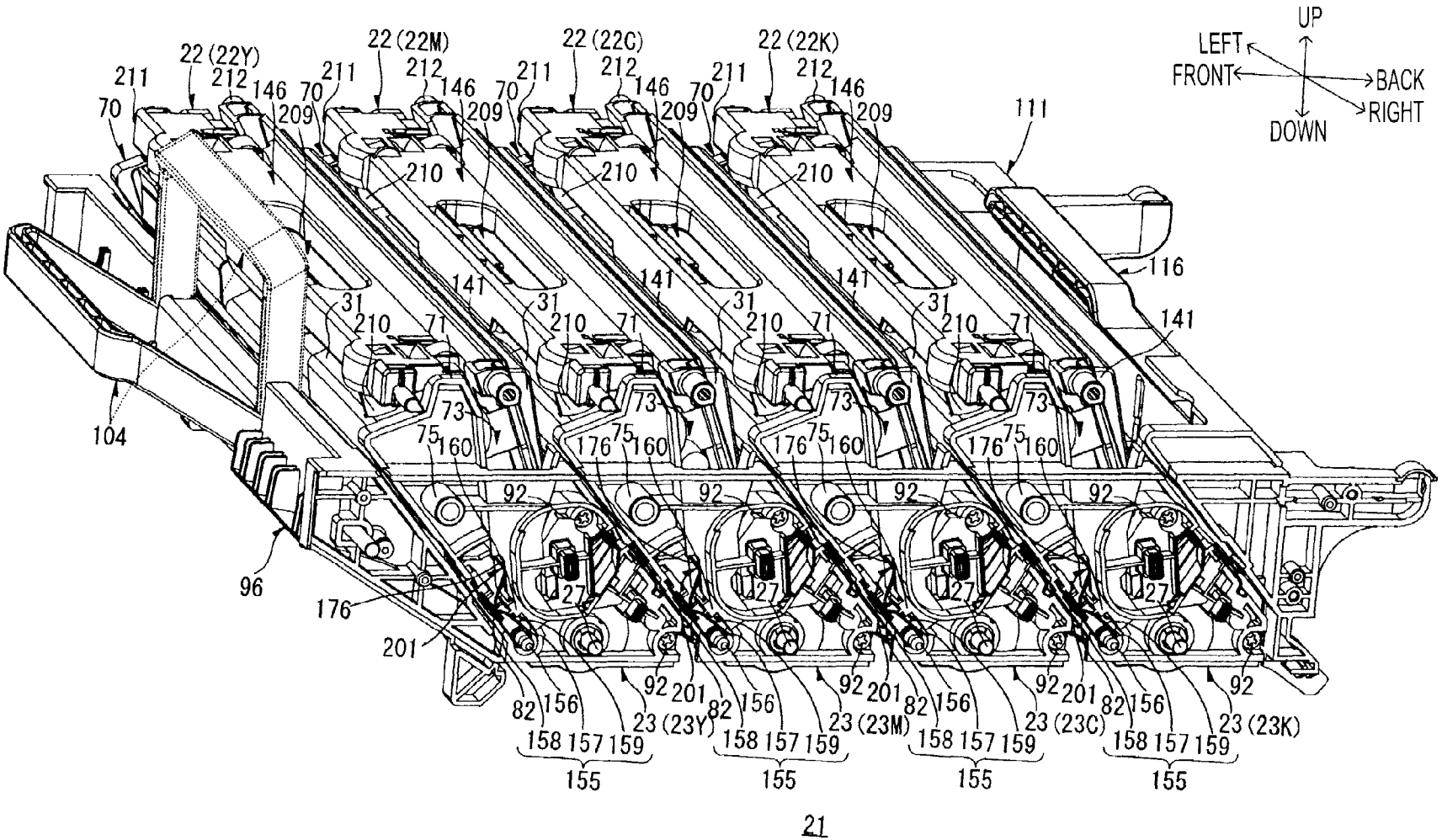
FIG. 22 is a right lateral view showing the condition in which a front beam, four drum subunits, and a rear beam are arranged in parallel in accordance with aspects of the present invention.
Figure 23:
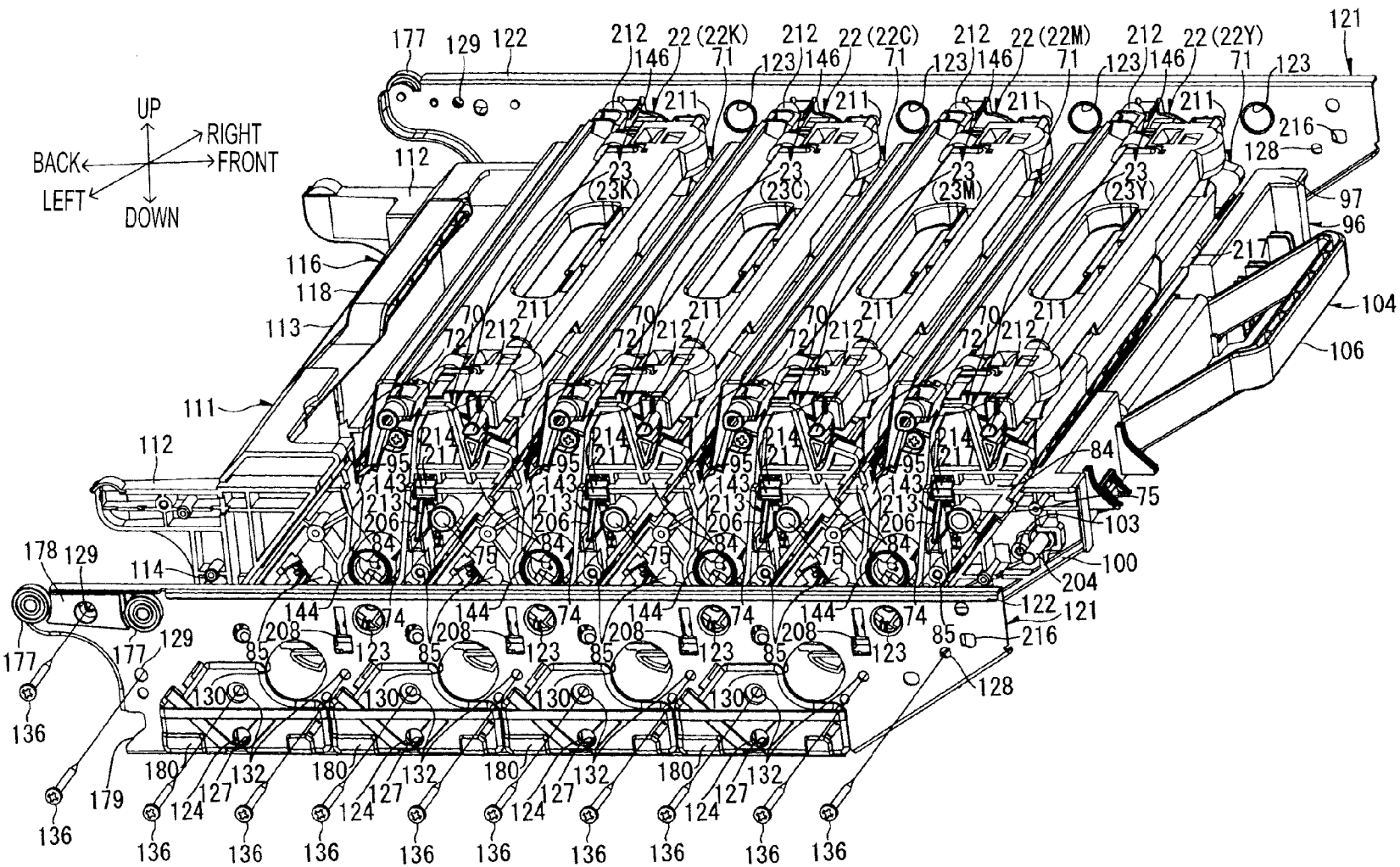
FIG. 23 is a right lateral view showing the condition in which a front beam, four drum subunits and a rear beam are arranged in parallel, and a pair of side plates are assembled in accordance with aspects of the present invention.

FIG. 22 is a right lateral perspective view that shows the front beam, four drum subunits 23, and the rear beam being arranged in parallel. FIG. 23 is a left lateral perspective view that shows the condition in which the front beam, four drum subunits 23, and the rear beam are arranged in parallel and a pair of side plates is assembled.

Next, the drum unit is described in detail by referring to the FIGS. 4 to 17 and FIGS. 22 and 23.

The drum unit 21, as shown in FIG. 6, may include four drum subunits 23 (corresponding to each color), a front beam 96, and rear beam 111 that are arranged on both sides along the front and back direction of the four drum subunits 23. The drum subunits are arranged in parallel along the front and back direction. FIG. 6 also shows a pair of side plates 121 that sandwich the front beam 96, four drum subunits 23, and rear beam 111 from the sides in the width direction.

The drum unit 21 (including four drum subunits 23, front beam 96, rear beam 111 and a pair of side plates 121) can be inserted/removed by sliding from the drum housing space 162 in the main body casing 2 (see FIG. 1).

(1) Drum Subunit

As shown in FIG. 4, the drum subunit 23 may include a left side frame 70 and right side frame 71 that face each other. A center frame is between the left side frame 70 and right side frame 71.

(1-1) Side Frame

The left side frame 70 and right side frame 71 are made of a resin material. The left side frame 70 has an approximate triangle shape. When viewed from the side, the left side frame 70 becomes narrower from the top to bottom. The right side frame 71 is in an approximate parallelogram shape. When viewed from the side, the right side frame 71 inclines from the front top to the rear bottom.

A right guiding groove 73 is formed on the internal wall of the right side frame 71. The right guiding groove 73 functions as the powered portion guiding groove.

The right guiding groove 73 is formed on the internal wall of the right side frame 71. The right guiding groove 73 extends from the rear side upper edge of the right side frame 71 to near the front side bottom edge of the right side frame 71. The right guiding groove 73 extends approximately along the top-bottom direction. The right guiding groove 73 has a concave shape with a squared U-shaped cross-section when viewed from the internal wall of the right side frame 71 in the width direction. The top edge of the right guiding groove 73 is open. The top of the right guiding groove 73 has a wide width as well. Moving downward, the right guiding groove 73 has a constant groove width A (see the double ended arrow in FIG. 4). The right guiding groove 73 bends in front of the bottom edge towards the diagonal bottom rear. The lowest portion 154 of the right guiding groove 73 corresponds to the position of the developer carrier shaft 45 where the developer carrier 34 contacts the image carrier 24 when the developing cartridge 22 is installed in the drum subunit 23. The groove width B (see the dotted arrow in FIG. 4) at the deepest portion 154 is smaller than the above-described groove width A. A collar member 50 (which is an alignment portion for the developing cartridge) and a cylindrical portion 184 (see FIG. 11) of the powered member 182 (which is the powered portion) slide in right guiding groove 73.

A notch 201 is formed on the groove wall on the front side at the bent position of the right guiding groove 73 described above. The right guiding groove 73 extends through the right side frame 71 via this notch 201.

A boss 75 is formed on the front upper side relative to the right guiding groove 73 on the right side frame 71. The boss 75 is also formed at the position that faces the boss 75 of the left side frame 70. Bosses 75 are formed in a cylinder shape that externally projects in the width direction from the external wall of the right side frame 71 and left side frame 70. The bosses 75 are arranged so that, while the developing cartridge 22 is mounted on the drum subunit 23, the windows 142 of the developing cartridge 22 align with bosses 75 (see FIG. 13).

In addition, as shown in FIG. 5, a supporting shaft 156 is formed on the bottom front edge of the right lateral surface of the right side frame 71. The supporting shaft 156 is formed in a cylinder shape. The supporting shaft 156 projects from the right lateral side of the right side frame 71 to the outside in the width direction (right side).

Furthermore, as shown in FIG. 4, a drum support 76 that supports the image carrier 24 is formed on the bottom edge of the right side frame 71. The drum support 76 is concave with a cylindrical shape from the internal wall surface of the right side frame 71 towards the outside in the width direction. The drum support 76 includes a receptacle 77 that receives the shaft insertion tube 90 of the center frame 72 described below.

At the center of the receptacle 77, a shaft insertion hole 78 penetrates the right side frame 71 in the thickness direction.

In addition, two screw insertion holes 79 are formed on the rear edge of the right side frame 71. The two screw insertion holds 79 penetrate in the thickness direction. The two screw insertion holes 79 permit screws 92 to connect right side frame 71 to the center frame 72. One of the screw insertion holes 79 is formed at the bottom edge of the rear edge of the right side frame 71. The other screw insertion hole 79 is formed in the middle of the top-to-bottom direction of the rear edge of the right side frame 71.

Convex strips 84 extend along the front and back direction. The convex strips 84 are formed on the left side frame 70 and right side frame 71 at the top of the bosses 75. These convex strips 84 project outwardly in the width direction from the external wall of the left side frame 70 and the right side frame 71. The convex strips 84 are formed in a long narrow strip shape along the front and back direction.

In addition, the left side frame 70 is, as described above, an approximate triangle shape when viewed from the side. A front side perpendicular wall 60 that extends in the approximate top and bottom direction is formed on the left side frame 70. A front concave portion 69 is formed on the bottom edge of the front perpendicular wall 60. The front concave portion 69 is formed in an approximate arc shape when viewed from the side in which the front perpendicular wall 60 sags to the front side. The left side frame 70 then continues from the front perpendicular wall 60. In addition, the top edge of the front perpendicular wall 60 and the rear edge of the top surface of the left side frame 70 are connected with an inclined surface that extends towards the diagonal front top.

A screwing portion 85 is provided at the bottom edge of the left side frame 70. The screwing portion 85 allows a screw 136 to attach the left side frame 70 to the side plate 121. This screwing portion 85 is formed in a tube shape that externally projects from the outside wall of the left side frame 70 in the width direction.

Moreover, an alignment projection 200 frontally projects from the front side surface of the left side frame 70. The alignment projection 200 is formed below the front edge of the convex strip 84 at the front lateral surface of the left side frame 70.

A sidewall opening 213 is formed between the boss 75 and front perpendicular wall 60 of the left side frame 70. The sidewall opening 213 is formed as a narrow rectangular shape, when viewed from the side, and extends along the top and bottom direction as shown in FIG. 23 (not shown in FIG. 4). A lever supporting shaft 214 having a cylinder shape is supported between the front edge and rear edge of the sidewall opening 213, on the top edge of the sidewall opening 213.

A lever 206 is supported by the lever supporting shaft 214 in a movable manner.

The lever 206 is formed in an approximate reverse L-shape, when viewed as a vertical cross-section. The level 206 has two edges over the lever moving shaft 207 that is inserted in the lever supporting shaft 214. One end of level 206 projects to the right side from the sidewall opening 213. The other end of level 206 projects to the left from the sidewall opening 213.

As shown in FIG. 5, a wire electrode 80, a grid electrode 81, a developer carrier electrode 82, and a cleaning electrode 83 are supported in right side frame 71. These elements penetrate the right side frame 71 in the thickness direction and externally project from the outside wall of the right side frame 71 in the width direction.

The wire electrode 80 is arranged at the approximate center in the front and back and top and bottom directions on the right side frame 71, above the shaft insertion hole 78.

The grid electrode 81 is arranged at the middle in the top and bottom direction on the rear edge of the right side frame 71. The grid electrode 81 is arranged on a diagonal to the upper rear of the shaft insertion hole 78.

The developer carrier electrode 82 is arranged in the middle in the top and bottom direction on the front edge of the right side frame 71. The developer carrier electrode 82 is also located along a diagonal to the upper front of the shaft insertion hole 78. In addition, a feed coil 155 is connected to the developer carrier electrode 82.

As shown in FIG. 22, the feed coil 155 may include a winding portion 157. The winding portion 157 includes a conductive wire material such as metal wire. The feed coil 155 is wound one time or greater with winding portion 157. The winding portion 157 may also include one arm 158 and another arm 159 that project away from each other in the tangential line direction from the winding portion 157.

The feed coil 155 is arranged so that winding portion 157 is inserted to the supporting shaft 156 of the right side frame 71. Also, one arm 158 is arranged along the front edge of the right side frame 71 towards the diagonal upper front. The unattached edge of arm 158 is connected to the developer carrier electrode 82. The other arm 159 extends in front of one arm 158 in the diagonal upper front direction. The other arm 159 is latched by a hook 160 when viewed as a vertical cross-section (provided above the supporting shaft 156 at the approximate center in the top and bottom direction). The other arm 159 bends towards the rear from the position latched by the hook 160. The other arm 159 forms an approximate arch shape, when viewed from the side, from the latched portion by the hook 160 to the unattached end. The above-described convex portion 176 forms an approximate arch shape and projects from the notch 201 of the right guiding groove 73 into the right guiding groove 73, when viewed from the side and when the feed coil 155 is assembled with the right side frame 71.

As shown in FIG. 5, the cleaning electrode 83 is arranged at the middle in the top and bottom direction of the rear edge of the right side frame, above the grid electrode 81, and diagonal to the upper rear of the shaft insertion hole 78.

A peripheral fitting wall 94 externally projects in a semicircle shape in the width direction by surrounding the wire electrode 80 on the external wall of the right side frame 71.

(1-2) Center Frame

As shown in FIG. 4, the center frame 72 may be formed from resin material independently from the left side frame 70 and right side frame 72. Center frame 72 includes a center plate 86 (that extends in the width direction), a right side plate 87, and a left side plate 95 (that are provided on both edges of the center plate 86 in the width direction in an integrated manner). The right side frame 71 and the combination of the left side plate 95 and the left side frame 70 function as a pair of guiding walls.

The center plate 86 has a narrow plate shape when viewed from the top. The center plate 86 includes a charger retainer 88 (which keeps the scorotron-type charger 25 along the width direction), which is provided at the middle of the center plate 86 in the top-bottom direction.

A discharge wire 28 is located on the charger retainer 88 along the width direction. A grid 29 is held below the wire 28 (see FIG. 2). In addition, a wire cleaner 89 that holds the discharge wire 28 is held in the width direction on the charger retainer 88 in a slidable manner.

A brush holder 93 holds cleaning brush 68 below the charger retainer 88 on the center plate 86.

The cleaning brush 68 extends along the width direction in the brush holder 93 (see FIG. 2).

In addition, an alignment roller 218 is provided on both edges in the width direction at the top edge of the center plate 86. The alignment roller 218 is supported by the roller supporting shaft 219. The roller supporting shaft 219 is provided along the width direction of both edges in the width direction of the top edge of the center plate so that the roller supporting shaft 219 can freely rotate (see FIG. 10).

The right side plate 87 and the left side plate 95 extend forward by bending from the center plate 86 at both edges in the width direction of the center plate 86. The right side plate 87 and left side plate 95 are formed in an approximate triangle shape with the narrow side on the top when viewed from the side. A shaft insertion tube 90 (in which drum shaft 27 is inserted) is provided at the front edge.

A screwing portion 91 is provided at the top and bottom edge of the right side plate 87. The screwing portion 91 allows the screw 92 to be screwed in order to assemble the right side frame 72 to the center frame 72. The screwing portion 91 is formed in a tube shape that externally projects from the outside wall of the right side plate 87 in the width direction.

The left side plate 95 is larger than the right side plate 87. The left side plate 95 has an approximate right angled triangle-shape. The left side plate 95 may include a base wall 137 (extending in the front and rear direction), a rear side perpendicular wall 138 (extending upwards in an approximately vertical direction from the front edge of the base wall 137), and an inclined wall 139 (connecting the rear edge of the base wall 137 and the top edge of the rear side perpendicular wall 138). The top edge of the rear side perpendicular wall 138 and the top edge of the inclined wall 139 may be connected by an inclined surface that extends in the diagonally upper rear direction.

A rear side concave portion 152 is formed at the approximate center of the rear side perpendicular wall 138. So as to be continuous with the rear-side perpendicular wall 138, the concave portion 152 is formed in an approximate arc shape, when viewed from the side, so that the rear side perpendicular wall 138 is concave to the rear.

The groove-shaped deepest portion 153 is continuously concave from the bottom edge of the rear side concave portion 152 in the diagonally bottom rear direction. The groove-shaped deepest portion 153 is formed on the rear side perpendicular wall 138. The groove width of the deepest portion 153 is the same as the groove width B described above. In addition, the deepest portion 153 corresponds with the position of the developer carrier shaft 45 (where the developer carrier 34 contacts the image carrier 24 when the developing cartridge 22 is being installed in the drum subunit 23).

In a first example, the combination of the concave portions 152 and 69 may be used to create a seated position to which the developer cartridge 22 may be guided. In other examples, only one or neither of the concave portions 152 and 69 may be used to create the same position at which the developer cartridge 22 may be seated.

In a first aspect, the left and right side frames 70 and 71 may be part of a unit that contains the image carrier 24. In another aspect, the left and right side frames 70 and 71 may be separate from the image carrier 24. Here, the developer cartridge 22 may be first positioned in the left and right side frames 70 and 71. Next, the combination of the left and right side frames 70 and 71 and the developer cartridge 22 may be moved to a location where the developer carrier 22 contacts the image carrier 24. For instance, the left and right side frames 70 and 71 may be part of drum subunit 23, where seating the developer cartridge 22 brings the developer carrier 34 into contact with the image carrier 24. Alternatively, a drum subunit 23 may not have drums associated with the drum subunit 23, but rather the drums may be located within a printer body separate from the drum subunit with left and right side frames 70 and 71. Here, the developer cartridge 22 may be positioned with respect to the side frames 70 and 71. After being positioned, the subunit and developer cartridges 22 may then be positioned so that the developer cartridges 22 contact the image carriers 24.

A concave alignment portion 202 may be provided at the position approximately one third from the top edge of the inclined wall 139, in the top and bottom direction on the inclined wall 139.

Although not shown in the drawing, a drum support 76 that supports the image carrier 24 is formed on the left side plate 95. At the center of drum support 76, a shaft insertion hole 78 penetrates in the thickness direction of the left side plate 95.

A screwing portion 85 that allows the screw 136 (see FIG. 23) to be screwed in order to assemble each of the side plates 121 to the drum subunit 23 is provided above the shaft insertion tube 90 of the left side plate 95. This screwing portion 85 is formed in a tube shape that externally projects from the outside wall of the left side plate 95 in the width direction. In addition, the convex strip 84 that extends along the front and rear direction is formed on top of the left side plate 95.

(1-3) Assembly of the Drum Subunit

As shown in FIG. 4, the right side frame 71 is arranged on the right side in the width direction of the center frame 72. Then the shaft insertion tube 90 is fit into the receptacle 77 so that the shaft insertion tube 90 is located on top of the shaft insertion hole 78 at the drum support 76 of the right side frame 71 in the width direction. At the same time, the screwing portion 91 of the center frame 72 is arranged so that the screwing portion 91 is located on top of the screw insertion hole 79 of the right side frame 71 in the width direction. Then the screws 92 are inserted to each of the screw insertion holes 79. Next, the screws 92 are attached by screwing into each of the screwing portions 91. By doing so, the right side frame 71 is assembled on the right side of the center frame 72.

In addition, as shown in FIG. 5, when the right side frame 71 is assembled on the right side in the width direction of the center frame 72, the wire electrode 80 and the grid electrode 81 (provided on the right side frame 71 on the right) are connected to the discharge wire 28 and the grid 29 of the center frame 72, respectively. The cleaning electrode 83 is connected to the cleaning brush 68.

As shown in FIG. 4, while the right side frame 71 is assembled on the right side in the width direction of the center frame 72, the left side frame 70 is not assembled to the center frame 72 and the right side frame 71. Instead, the left side frame 70 is assembled to the side plate 121 (described below). When the center frame 72 (to which the right side frame 71 is assembled) is assembled with the side plate 121 (to which the left side frame 70 is assembled), the drum subunit 23 is completed. This assembly is described below.

As shown in FIG. 6, when the drum subunit 23 is completed, the rear side perpendicular wall 138 of the left side plate 95 and the front side perpendicular wall 60 of the left side frame 70 face each other in the front and rear direction of the center frame 72. At this time, a certain facing distance C (see solid arrow in FIG. 6) is configured between the rear side perpendicular wall 138 and the front side perpendicular wall 60. Also, the gap between the rear side perpendicular wall 138 and the front side perpendicular wall 60 forms the left guiding groove 189 as the driving input portion guiding groove. The right guiding groove 73, the left side guiding groove 189, the right side frame 71 (where the right guiding groove 73 is formed), the left side frame 70 (where the left guiding groove 189 is formed), and the center frame 72 function as the guiding portion.

In addition, the facing distance C (hereinafter referred to as groove width C of the left guiding groove 189) is set to be larger than the groove width A (of FIG. 4) of the right side groove 73. Next, an internal coupling insertion portion 74 in a circular shape, when viewed from the side, is formed by locating the rear side concave portion 152 of the left side plate 95 and the front side concave portion 69 of the left side frame 70 together by facing with each other so that the approximate arc portions, when viewed from the side, are put together.

As shown in FIG. 9, the image carrier 24 is held in the drum subunit 23. In other words, the drum main body 26, where the rotary supporting member 30 is inserted so the drum main body 26 does not relatively rotate, is arranged between the right side plate 87 and the left side plate 95 so that the drum main body 26, the right side plate 87, and the left side plate 95 are in parallel with the scorotron-type charger 25 leaving a gap. Next, as shown in FIG. 4, the drum shaft 27 is inserted into each of the shaft insertion tubes 90 of the center frame 72 and each of the shaft insertion holes 78 of the right side frame 71. Next, each of the shaft insertion tubes 90 is fastened so that the shaft insertion tubes 90 do not relatively rotate. The drum shaft 27 supports the rotary support 30 (which supports the drum body 26 in a relatively non-rotatable manner). Also, the image carrier 24 is held by the drum subunit 23.

(2) Front Beam

As shown in FIG. 5, the front beam 96 is arranged on the front of the four drum subunits 23 that are arranged in parallel along the front and back direction. The front beam 96 is installed between a pair of side plates 121 as shown in FIG. 6.

The front beam 96 includes a pair of frontal sidewalls 97 that face each other in the width direction, and a frontal front wall 98 and the frontal rear wall 99 that are installed between the pair of frontal sidewalls 97. The front beam 96 may be formed in an integrated manner as being made of a resin material.

Each of the frontal sidewalls 97 includes a front sidewall base 100 in an approximate parallelogram plate shape, when viewed from the side, and a frontal sidewall leg 101 that extends downward from the bottom edge of the frontal sidewall base 100. A front screwing portion 103 (where the screw 136 is screwed and described below) for assembling the side plate 121 is provided on the external wall of the frontal sidewall base 100.

In front of the front screwing portion 103 of each of the frontal sidewalls 97, a bearing hole 203 is formed so that the front beam 96 can penetrate in the width direction. An alignment shaft 204 is inserted into the bearing hole 203 so that both of its edges project externally in the width direction from each of the frontal sidewalls 97.

The rear edge surface that continues from the frontal sidewall base 100 to the frontal sidewall leg 101 is formed as the front side inclined surface 102 that inclines from the front top to the rear bottom on the frontal sidewall 97. A concave alignment portion 215 is provided on the top edge at the left edge of the front side inclined surface 102 (see FIG. 6).

The frontal front wall 98 has an approximately narrow rectangular plate shape, when viewed from the front. The frontal front wall 98 extends in the width direction. The frontal front wall 98 is arranged along the top and bottom direction between a pair of frontal sidewalls 97.

A near-side graspable portion 104 is provided at the center in the width direction of the frontal front wall 98. This near-side graspable portion 104 includes a pair of graspable side plates 105 (arranged to face each other with a gap in the width direction) and a graspable center plate 106 (installed between the graspable side plates 105).

The base of each of the graspable side plates 405 (the end that is not connected to the graspable center plate 106) of the near-side graspable portion 104 moves between the stowed position (shown as a broken line) in a standing position and the operation position (shown as a solid line). The base of each of the graspable side plates 405 is in an inclined position along the approximately horizontal direction while being rotatably supported by the alignment shaft 204 in a rotatable manner.

The near-side graspable portion 104 is arranged so that the center in the width direction matches the center of the front beam 96 in the width direction.

As shown in FIG. 10, the frontal rear wall 99 has a narrow rectangular plate shape, when viewed from the back, which extends in the width direction. The frontal rear wall 99 is arranged on the back of the frontal front wall 98. This frontal rear wall 99 is installed between each of the frontal sidewalls 97 so that frontal rear wall 99 inclines from the front top to the rear bottom along the front-side inclined surface 102 of each of the frontal sidewalls 97.

The above-described alignment rollers 218 and alignment projection 219 are provided at an approximate center position in the top and bottom direction on both edges of the frontal rear wall 99. The alignment projection 219 is arranged so that the alignment projection 219 is mostly embedded in the frontal rear wall 99. Also, each of alignment rollers 218 is arranged so that a portion of each of alignment rollers 218's circumference is projected from the frontal rear wall 99 when viewed from the side.

(3) Rear Beam

The rear beam 111 is arranged on the back side of the four drum subunits 23. The rear beam is also located between a pair of the side plates 121.

As shown in FIG. 5, the rear beam 111 may include a pair of rear sidewalls 112 that are arranged so that the pair of rear sidewalls 112 face each other in the width direction. Also, the rear beam 111 may include a rear installed wall 113 arranged between the pair of rear sidewalls 112. The rear beam 111 may be formed from a resin material and be integrated with the pair of rear sidewalls 112 and the rear installed wall 113.

The rear sidewall 112 may have an approximately triangular plate shape with the narrow side at the bottom, when viewed from the side. The rear sidewall 112 may also have two rear screwing portions 114 where the screws 136 for assembling the side plate 121 are provided at the top edge and the approximate center. Below the rear screwing portion 114 (provided at the approximate center of the rear sidewall 112), a rear sidewall leg 107 is formed. A rear sidewall notch 108 (that is concave towards the front) is formed between the rear screwing portion 114, which is formed at the approximate center, and the rear sidewall leg 107. In addition, the front edge of the rear sidewall 112 is formed as the rear side inclined surface 115 that inclines from the top front to the rear bottom.

The rear installation wall 113 has a narrow rectangular plate shape, when viewed from the front, which extends along the width direction. The rear installation wall 113 is arranged along the top and bottom direction between the pair of rear sidewalls 112.

A far-side graspable portion 116 is provided at the center in the width direction of the rear installation wall 113. As shown in FIG. 10, the far-side graspable portion 116 may include a graspable concave portion 117 in which the top edge of the rear installation wall 113 sags in a concave shape towards the bottom when viewed from the back. The far-side graspable portion 116 may also include a rear handle 118 having an approximate square U shape when viewed from the back, which is connected to the top edge of the rear installation wall 113. Accordingly, the far-side graspable portion 116 may then be located over the graspable concave portion 117 in the width direction.

This far-side graspable portion 116 is arranged so that the center in the width direction matches the center in the width direction of the rear beam 111.

(4) Side Plates

As shown in FIG. 6, a pair of side plates 121 is provided so that the side places 121 can sandwich the front beam 96, four drum subunits 23, and rear beam 111 from both sides in the width direction.

Each of the side plates 121 is made of a material with a lower linear expansion coefficient than the linear expansion coefficient of the resin material for forming the drum subunits 23. For example, the side plates 121 may be made of a metal or fiber reinforced resin, and preferably, is made of metal.

As shown in FIG. 23, each of the side plates 121 has an approximately narrow rectangular shape that extends in the front and back direction when viewed from the side. Each of the side plates 121 is formed so that the front edge faces the front beam 96, and the rear edge faces the rear beam 111, relative to the front beam 96, four drum subunits 23 and rear beam 111. The front beam 96, four drum subunits 23, and rear beam 111 may be arranged in parallel along the front and back direction, during the assembly of the drum unit 21. In addition, the top edge faces the convex strip 84 of the left side plate 95, the left side frame 70 and the right side frame 71 of the center frame 72 of the drum subunit 23. The bottom edge faces the bottom edge of the left side plate 95, left side frame 70 and right side frame 71 of the center frame 72 of the drum subunit 23.

The top edge of each of the side plates 121 is externally bent in the width direction so that the top edge's cross-section is an L shape. A flange 122 is formed, which is externally bent in the width direction and externally extends in the width direction in the front and back direction. On the rear edge of each of the side plates, two rollers 177 are provided in a rotatable manner. These two rollers 177 are arranged in the front and back direction at a distance by sandwiching a spacer 178. The front roller 177 is arranged below the flange 122 with a gap in the top and bottom direction relative to the flange 122. The rear roller 177 is arranged with a gap relative to the rear edge of the flange 122.

Furthermore, a notch 179 is formed at the bottom edge of the rear edge of each of the side plates 121. This notch 179 is formed in a U-shape when viewed from the side, such that the notch 179 continues to the rear edge of each of the side plates 122 and sags forward.

Four light transmission holes 123 that accept the bosses 75 of each of the drum subunits 23 are formed on the top edge of each side plate 121, under a condition in which each side plate 121 is assembled to the drum subunit 23.

Each of the light transmission holes 123 are formed on the top edge of each side plate 121 at intervals along the front and rear direction. These light transmission holes 123 are formed as round holes that penetrate in the thickness direction at a position where each window 142 (see FIG. 12) of the developing cartridge faces each boss 75 of each drum subunit 23 in the width direction (see FIG. 4) under the condition in which each of the developing cartridges 22 are installed in each of the drum subunits 23.

A shaft hole 124, where an edge in the axis direction of the drum shaft 27 of each drum subunit 23 is inserted, is formed at the bottom edge of each of the side panels 121.

A pair of latching holes (not shown) is formed on the rear top and front top diagonal to each of the shaft holes 124 of each side plate 121. A wire spring 127 is latched onto these latching holes. More specifically, the wire spring 127 is made of a V-shaped wire that sags downwards, when viewed from the side. Also, both edges of the top side are bent externally in the width direction, and are latched to the latching holes. The front part of the wire spring 127 is exposed from the shaft hole 124 so that front part of the wire spring 127 inclines from the rear bottom to the front top, when viewed from the side, so that the 3 o'clock position and 6 o'clock position of the shaft hole 124 are connected.

Furthermore, a front side screw insertion hole 128 for inserting a screw 136 is formed on the front edge of each side plate 121 by facing the front screwing portion 103 of the front sidewall base 100, under the condition in which each of the side plates is assembled to the front beam 96. In addition, a shaft exposing hole 216 is formed at the front top, diagonally to the front side screw insertion hole 128 of each side plate 121.

Moreover, two each of the rear side screw insertion holes 129 for inserting screws 136 are formed on the rear edge of each of the side plates 121 so that they face the rear screwing portion 114 of the rear sidewall 112 under the condition that each side plate 121 is assembled with the rear beam 111. Of these rear side screw insertion holes 129, a group of the rear side screw insertion holes 129 are formed approximately at the center in the front and rear direction of the spacer 178.

In addition, on the left side plate 121, an outward coupling insertion hole 130 that faces the passive coupling gear 144 of each of the developing cartridges 22 in the width direction is formed such that in which each of the side plates 121 is assembled to the drum subunit 23 and the developing cartridge 22 is mounted on the drum subunit 23.

Four outward coupling insertion holes 130 are formed at the center in the top and bottom direction of the side plate 121 along the front and back direction at intervals. These outward coupling insertion holes 130 are formed as round holes that penetrate in the thickness direction. These insertion holes 130 are formed at the position where they face the coupling inward insertion holes 74 (formed on the left lateral surface of the drum subunit 27) in the width direction in which the side plate 121 is assembled to the drum subunit 23 and the developing cartridge 22 is mounted on the drum subunit 23.

Four lever transmission holes 208 that receive the other end of the lever 206 of each of the drum subunits 23 (projected to the left from the sidewall opening 213) are formed on the left side plate 121, on the back of each light transmission hole 123 under the condition in which the left side plate 121 is assembled to the drum subunit 23.

Four lever transmission holes 208 are formed at the top edge of the left side plate 121 along the front and rear direction at intervals. These lever transmission holes 208 are formed with a convex shape when viewed from the side. The lever transmission holes 208 face each other in the thickness direction at the position where the detection gear 205 of the developing cartridge 22 and the sidewall opening 213 of the drum subunit 23 face each other when the developing cartridge 22 is mounted on each of drum subunits 23.

Middle screw insertion holes 132 to insert screws 136 are formed on each of the side plates 121 and face the screwing portion 85 of the drum subunit 23 when each of the side plates 121 is assembled to the drum subunit 23.

One each of the middle screw insertion holes 132 is arranged on the front and back positions of each coupling outward insertion hole 130 and 8. Each is formed in the side plates 121.

As shown in FIG. 7, on the right side plate 121, a center opening 133 to externally expose the wire electrode 80 and grid electrode 81 (provided on each of the right side frames 71 in the width direction relative to the right side plate 121) is formed under the condition in which each of the side plates 121 are assembled to the drum subunit 23.

Four center openings 133 are formed at intervals along the front and back direction. These center openings 133 are formed as large openings (which allow the peripheral fitting wall 94 that includes wire electrode 80 (see FIG. 5) to be fitted in and allow the grid electrode 81 to be inserted).

On the right side plate 121, front openings 134 are formed in front of each of the center openings 133 in order to externally expose the developer carrier electrode 82 in the width direction relative to the right side plate 121, when each of the side plates 121 is assembled to the drum subunit 23. Four front openings 134 are formed facing the developer carrier electrode 82 in the width direction in correspondence to each of the center openings 133 when each of the side plates 121 is assembled to the drum subunit 23.

On the right side plate 121, rear openings 135 are formed behind each of the center openings 133 in order to externally expose the cleaning electrode 83 in the width direction relative to the right side plate 121, when each of the side plates 121 is assembled to the drum subunit 23. Four rear openings 135 are formed facing the cleaning electrode 83 in the width direction in correspondence to each of the center openings 133 when each of the side plates 121 are assembled to the drum subunit 23.

(5) Assembly of the Drum Unit

First, the four drum subunits 23 are arranged to be adjacent with each other in the front and back direction. As shown in FIG. 6, to arrange the four drum subunits 23 to be adjacent with each other in the front and back direction, the alignment projection 200 of the left side frame of the drum subunit 23 in back is fit into the alignment concave portion 202 on the left side plate 95 of the center frame 72 of the drum subunit 23 in front. Also, the front edge surface of the right side frame 71 of the drum subunit 23 in back is allowed to contact the rear edge surface of the right side frame 71 of the drum subunit 23 in front. By doing so, each of the drum subunits 23 is arranged to be adjacent with each other in the front and back direction while each is inclined from the front top to the rear bottom.

Next, the front beam 96 is arranged to be adjacent to the drum subunit 23 at the far front. Also, the rear beam 111 is arranged to be adjacent to the drum subunit 23 at the far back. To arrange the front beam 96 to be adjacent to the drum subunit 23 at the far front, the front edge surfaces of the left side frame 70 and the right side frame 71 of the drum subunit 23 at the far front are brought into contact with the front inclined surface 102 of the front beam 96. At this time, the alignment projection 200 of the left side frame 70 of the drum subunit 23 at the far front fits into the alignment concave portion 21 that is formed on the front inclined surface 102. In addition, in order to arrange the rear beam 111 to be adjacent to the drum subunit 23 at the far back, the rear edge surfaces of the left side plate 95 and right side frame 71 of the drum subunit 23 at the far back are brought into contact with the rear inclined surface 115 of the rear view beam 111.

And as shown in FIG. 23, each of the side plates 121 is arranged on both sides in the width direction of the front beam 96, the four drum subunits 23 and rear beam 111 (which are arranged along the front and rear direction). Next, each of the side plates 121 is assembled to the front beam 96, the four drum subunits, and the rear beam using screws 136.

To assemble the left side plate 121 on the left side in the width direction of the front beam 96, the four drum subunits 23 and rear beam 111, the front screw insertion hole 128 of the left side plate 121 is arranged to face the left side front screwing portion 103 of the front beam in the width direction. Next, the rear side screw insertion hole 129 of the left side plate 121 is placed so that the screw insertion hold 129 faces the left side rear screwing portion 114 of rear beam 111. Finally, the middle screw insertion hole 132 of the left side plate 121 is arranged so that the middle screw insertion hole 132 faces the screwing portion 85 of each of the drum subunits 23 in the width direction.

Next, the internal wall of the left side plate 121 is brought into contact with the convex strip 84 of the left side frame 71 and the convex strip 84 of the center frame 72 of each drum subunit 23. The left edge in the axis direction of the drum shaft 27 is inserted into each of the shaft holes 124 of the left side plate 121. At the same time, the boss 75 of the right side frame 71 on the left of each drum subunit 23 is fit into each of the light transmission holes 123 of the left side plate 121 so that the boss 75 is externally exposed in the width direction. Fitting the boss 75 of the right side frame 71 on the left of each drum subunit 23 limits the rotation centered about the drum shaft 27 relative to the left side plate 121 of each of the drum subunits 23.

The screws 136 are inserted into the front screw insertion holes 128. The screws 136 are then screwed into the front screwing portion 103. Next, the screws are inserted into the rear screw insertion holes 129 and screwed into the rear screwing portion 114. Finally, the screws 136 are inserted into each of the middle screw insertion holes 132 and screwed into each of screwing portions 85. As shown in FIGS. 8 and 9, by doing so, the left side plate 121 is assembled on the left side of the front beam 96, the four drum subunits 23, and rear beam 111.

As shown in FIG. 7, to assemble the left side plate 121 on the right side in the width direction of the front beam 96, the four drum subunits 23, and rear beam 111, the front screw insertion hole 128 of the right side plate 121 is arranged to face the right side front screwing portion 103 (see FIG. 5) of the front beam in the width direction. Next, the rear side screw insertion hole 129 of the right side plate 121 is placed so that the rear side screw insertion hole 129 faces the right side rear screwing portion 114 (see FIG. 5) of rear beam 111.

Next, the internal wall of the right side plate 121 is brought into contact with the convex strip 84 of the right side frame 71 and the convex strip 84 of the center frame 72 of each drum subunit 23. The right edge in the axis direction of the drum shaft 27 is inserted into each of the shaft holes 124 of the right side plate 121. At the same time, the boss 75 of the right side frame 71 on the right of each drum subunit 23 is fit into each of the light transmission holes 123 of the right side plate 121 so that the boss 75 is externally exposed in the width direction. In addition, the peripheral fitting wall 94 of each drum subunit 23 is fitted to the center opening 133 of the right side plate 121. Fitting the boss 75 of the right side frame 71 on the right of each drum subunit 23 limits the rotation centered about the drum shaft 27 relative to the right side plate 121 of each of the drum subunits 23.

Then, the screws 136 are inserted into the front screw insertion holes 128, and screwed into the front screwing portion 103. The screws 136 are then inserted into the rear screw insertion holes 129 and screwed into the rear screwing portion 114. By doing so, the right side plate 121 is assembled on the right side of the front beam 96, the four drum subunits 23 and rear beam 111.

In the drum unit 21 assembled as above, both ends in the axis direction of the drum shaft 27 are supported between the left side plate 95 and right side frame 71 of the center frame 72 in each of the drum subunits 23. As shown in FIGS. 7 and 8, the ends of drum shaft 27 are inserted into the shaft hole 124 of each of the side panels 121.

The end in the axis direction of the drum shaft 27 is pressed in the direction opposite to the exposed portion, at the shaft hole 124 of the wire spring 127, relative to the hole center of the shaft hole 124. In other words, the drum shaft 27 is pressed diagonally in the upper rear direction, by the above-described wire spring 127. By doing so, both ends in the axis direction of the drum shaft 27 are pressed by the wire spring 127 and come in contact with the peripheral border of the shaft hole 124. Thus, both ends in the axis direction of the drum shaft 27 are aligned between the pair of side plates 121.

In addition, the alignment shaft 204 of the front beam 96 is inserted into the shaft exposure hole 216. Both ends in the axis direction are externally exposed in the width direction from each of the side plates 121.

As shown in FIG. 8, the rear edge of the rear sidewall notch 108 on each of the rear sidewalls 112 is not exposed, when viewed from the side, relative to the rear edge of the notch 179 on each of the side plates 121.

In the drum unit 21 assembled as above, each of the outward coupling insertion holes 130 formed on the left side plates 121 face the inward coupling insertion portion 74 on the left side of each of the drum subunits 23 in the width direction.

Moreover, a left cap 180 (see the hatched area in the drawing) is arranged in correspondence to each of the drum subunits 23 on the lower half of the left side plate 121 of the drum unit 21. Each of the left caps 180 is formed as a sheet with a convex shape when viewed from the side. Each of the left caps 180 is made of insulating rubber or sponge. Each of the left caps 180 plugs a latching hole (not shown) to latch the wire spring 127. Plugging the latching hole prevents foreign objects from entering through the latching hole, while exposing the drum shaft 27, shaft hole 124, outward coupling insertion hole 130, and screw 136.

As shown in FIG. 7, in the drum unit 21, the grid electrode 81 and wire electrode 80 are externally exposed in the width direction from each of the center openings 133 that are formed on the right side plate 121. The developer carrier electrode 82 is externally exposed in the width direction from each of the front openings 134. A cleaning electrode 83 is externally exposed in the width direction from the rear opening 135.

A right cap 181 (see the hatched area in the drawing) corresponds to each of the drum subunits 23 on the lower half of the right side plate 121 of the drum unit 21. Each of the right caps 181 is formed as a sheet form with a convex shape when viewed from the side. Each of the right caps 181 is made of insulating rubber or sponge. Each of the right caps 181 plugs the center opening 133, front opening 134, and rear opening 135, thereby preventing foreign objects from entering, while exposing the drum shaft 27, developer carrier electrode 82, wire electrode 80, grid electrode 81 and cleaning electrode 83.

In addition, the left cap 180 and right cap 181 have insulation properties. These insulating properties prevent the power supplied to each of the electrodes from leaking via the side plates 121.

Using the procedures, the drum subunits 23 and drum unit 21 are assembled. As described above, the left side frame 70 cannot be assembled with the other parts (right side frame 71 and center frame 72). Rather, the drum subunit 23 can be completed by assembling the center frame 72 (where the right side frame 71 is assembled) to the side plate 121 (where the left side frame 70 is assembled in advance).

As shown in FIG. 23, each of the left side frames 70 is arranged on the inside in the width direction relative to the left side plate 121. Also, the internal wall of the left side plate 121 contacts the convex strip 84 of each of the left side frames 70. Also, boss 75 of each left side frame 70 is fit into each of the light transmission holes 123 of the left side plate 121 so that the boss 75 is externally exposed in the width direction.

Next, the screwing portion 85 of each of the left side frames 70 faces the center screw insertion hole 132 that is located in front of each of the outward coupling insertion holes 130 on the left side plate 121. The screw 132 is inserted into the center screw insertion hole 132 and screwed into the screwing portion 85. By doing so, each of the left side frames 70 is assembled to the left side plate 121. Next, the left side plate 121 (where each of the left side frames 70 is assembled), front beam 96, rear beam 111, and the right side plate 121 are assembled on each of the center frames 72 (where the right side frame 70 is assembled) as described above.

In contrast, as shown in FIG. 6, by arranging a multiplicity of drum subunits 23 and fitting the alignment projection 200 into the concave alignment portion 202, the left side frame 70 of the drum subunit 23 can be assembled on the left side plate 95 of the drum subunit 23 in front. The side plate 121 can be assembled after installation of the multiple drum subunits 23 is completed, thereby allowing relatively easy assembly of the drum unit.

3. DEVELOPING CARTRIDGE

FIGS. 11 to 13 show how the developing cartridge is constructed.

(1) Developing Cartridge

As shown in FIG. 11, in the developing cartridge 22, the developer carrier 34 is arranged so that the developer carrier 34 is exposed downward from the opening 36 at the bottom edge of the developing frame 31. In addition, the developer carrier shaft 45 of the developer carrier 34 is supported by both sidewalls 141 of the developing frame 31 in a rotatable manner. The developer carrier shaft 45 is arranged so that both ends of the developer carrier shaft 45 in the axis direction extend to both sidewalls 141 in the width direction. Furthermore, collar members 50 cover both ends of the developer carrier shaft 45. The collar member 50 is formed in a hollow tube having a certain external diameter D (see the solid arrow in FIG. 11). The external diameter D is the same as or slightly smaller than the groove width B of the deepest portions 153 and 154 (see FIG. 4). In addition, an inclined collar surface 185 is formed between the left side edge surface in the width direction and the peripheral surface of the collar 50. The collar 50 is provided on the left end of the developer carrier 45 as an inclined surface. The collar 50 is chamfered to connect the above components.

A conductive feed member 182 is provided on the right side plate 141 of the developing cartridge 22. The feed member 182 includes a bearing 183 and a cylinder 184 that externally (to the right) extend in the width direction from the top edge of the bearing 183. The cylinder 184 is formed in a hollow tube shape having a certain external diameter E (see the broken line in FIG. 11). The cylinder 184 externally extends to the right in the width direction. The external (right side) edge surface in the width direction of the cylinder 184 is positioned on the right side (in the left and right direction) as compared to the external (right side) edge surface in the width direction of the collar member 50 on the right side in the width direction. Furthermore, the external diameter E is larger than the external diameter D of the collar 50 and the groove width B (see FIG. 4) of the deepest portions 153 and 154. The external diameter E is approximately the same or slightly smaller than the groove width A of the right guiding groove 73 (see FIG. 4). The feed member 182 is attached on the developing frame 31 by the screw inserted in the axis direction (left and right direction) relative to the cylinder 184 (see FIG. 15).

As shown in FIG. 13, the bearing 183 is formed in a thin rectangular plate shape when viewed from the side. A bearing hole 188 penetrates the bearing 183 in the thickness direction at the bottom edge. The bottom edge of the bearing 183 is positioned between the right sidewall 141 and the collar member 50 in the left and right direction. The developer carrier shaft 45 is inserted into the bearing hole 188 of the bearing 183. The developer carrier shaft 45 is supported in a rotatable manner by both sidewalls 141 as well as bearing 183.

As shown in FIG. 12, a releasing projection 212 is formed at the rear edge of the top edge of both sidewalls 141 of the developing frame 31. The releasing projection 212 is formed in a hollow tube that externally projects in the width direction from both sidewalls 141.

In addition, as shown in FIG. 13, an alignment projection 217 is formed on the position near the window 142 on both edges in the left and right direction of the front wall of the developing frame 31.

The alignment projection 217 is a trapezoid shape when viewed from the side. The alignment projection 217 projects from the front wall of the developing frame 31.

Windows 142 for detecting the remaining amount of toner are located in both sidewalls 141 of the developing frame 31. These windows 142 permit the detection light (for optically detecting the remaining amount of toner in the toner container 37) transmit in the width direction. The amount of toner is determined using an optical sensor 173. Optical sensor 173 includes a light emitting element 174 and light receiving element 175 (see FIG. 17).

As shown in FIG. 12, a gear mechanism (not shown) (covered by a gear cover 143) is provided on the left sidewall 141 of the developing cartridge 22. This gear mechanism includes a passive coupling gear 144 that externally projects (to the left side) in the width direction from the gear cover 143. The gear mechanism also includes a gear train (not shown) that interacts with the passive coupling gear 144.

The passive coupling gear 144 is cylindrical. A coupling insertion indentation 187 (having a figure eight shape when viewed from the side) is formed in a concave manner on the left edge from the left edge towards the right. Cogs (not shown) are located on the circumference of the right edge. The diameter of the passive coupling gear 144 is larger than the external diameter E of the cylinder 184 (see FIG. 11).

As shown in FIG. 11, the passive coupling gear 144 faces the cylinder 184 of the feed member 182 in the width direction. More specifically, the center axis of the passive coupling gear 144 aligns with the center axis of the cylinder 184 in the front-back and top-bottom directions.

In addition, the passive coupling gear 144 has a larger diameter than that of the cylinder 184. The passive coupling gear 144 projects externally in the width direction from the collar member 50. The left edge surface of the passive coupling gear 144 projects so that the left edge surface is positioned slightly inside (right side) relative to the external (left side) edge in the width direction of the left guiding groove 189, when the developing cartridge 22 is installed in the drum subunit 23.

A cylinder cover 186 is located on the gear cover 143 corresponds to the passive coupling gear 144. The cylinder cover 186 and the passive coupling gear 144 function as the driving input portion. The cylinder cover 186 is a hollow cylinder having an external diameter F (see dotted arrow in the drawing). The cylinder cover 186 projects from the left surface of the gear cover 143 towards the left. The external diameter F of the cylinder cover 186 is slightly larger than the external diameter of the passive coupling gear 144. In other words, the external diameter F is larger than the external diameter E of the cylinder 184. In addition, the external diameter F of the cylinder cover 186 is larger than the groove width A of the right guiding groove 73. The external diameter F is approximately the same or slightly smaller than the groove width C of the left guiding groove 189 (see FIG. 6). As shown in FIG. 12, the cylinder cover 186 covers the circumference of the passive coupling gear 143. The left edge surface of the cylinder cover 186 is level with the left edge surface of the passive coupling gear 144. The cylinder cover 186 is open toward the left side.

As described in a later section, the coupling input shaft 145 (see FIG. 18)(which is a driving rotator provided in the main body casing 2) is connected to the passive coupling gear 144 so that the coupling input shaft 145 and the passive coupling gear 144 do not rotate relative to each other. A driving force from the motor (not shown) is transmitted to the coupling input shaft 145.

The gear train (not shown) includes an agitator driving gear that engages the rotary shaft 41 of the agitator 32. The gear train also includes a supplying roller driving gear that engages with the supplying roller shaft 43 of the supplying roller 33. The gear train further includes a developer carrier driving gear that engages the developer carrier shaft 45 of the developer carrier 34. Finally, the gear train includes detection gear 205 and other gears. These gears of the gear train engage with the passive coupling gear 144 via intermediate gears, etc.

The detection gear 205 is supported in a rotatable manner by the detection gear supporting shaft (not shown). The detection gear supporting shaft externally projects (to the left side) in the width direction from the left sidewall 141 on the diagonal to the upper front of the passive coupling gear 144.

This detection gear 205 is formed as a gear with missing cogs. The cog and missing cog portions (not shown) are provided on the right edge. On the left surface, a detected projection (not shown) is formed, where the detected projection is provided along the periphery of the detection gear 205 and projects towards the left side.

This detected projection (not shown) corresponds to the information on the developing cartridge 22. Here, the information on the developing cartridge 22 is whether or not the developing cartridge 22 is new or old or the information on the number of printable pages for the developing cartridge 22.

When the drum unit 21 (in which the developing cartridge 22 is mounted) is installed in the main body casing 2, a driving force from the motor is transmitted to the cogs of the detection gear 205 via the input coupling shaft 145 and the passive coupling gear 144. In response, the detection gear 205 rotates.

Along with the rotation of the detection gear 205, the detected projection (not shown) of the detection gear 205 contacts one end of the lever 206 (see FIG. 23). The level 206 is provided in the drum subunit 23. Because of the detected projection, the lever 206 moves around the lever moving shaft 207. Also, the other end of the lever 206 projects to the left from the lever transmission hole 208 of the side plate 121 (see FIG. 8). The other end of the lever 206 is detected by the detection sensor (not shown) provided in the main body casing 2. The detection results of the detection sensor (not shown) are, for example, the number of detections of the lever 206 and the time that is required for a single detection, and the CPU (not shown but in the main body casing) determines the information regarding the developing cartridge 22.

A developing cartridge graspable portion 146 is provided on the developing frame 31. The developing cartridge graspable portion 146 is formed in a long thin plate in the left and right direction. The developing cartridge graspable portion 146 is provided on the top wall 147 of the developing frame 31.

In addition, the rotation shaft (not shown) is inserted on the rear edge of the developing cartridge graspable portion 146. The rotation shaft is supported by the rear edge of the top wall 147 of the developing frame 31 via the rotary shaft (not shown).

The developing cartridge graspable portion 146 has a graspable long hole 209 in an approximate rectangular shape (when viewed from the side) at its center in the left and right direction.

As shown in FIG. 13, both edges in the left and right direction on the front edge of the developing cartridge graspable portion 146 and both edges in the left and right direction on the front edge of the top wall 147 that face with them are connected by a flexible member 210. The flexible member 210 may be, for example, a coil spring, a plate spring, or a spring (for instance, a coil spring). The front edge of the developing cartridge graspable portion 146 is pressed in the direction away from the front edge of the top wall 147.

A pressing projection 211 extends beyond the front edge of the developing cartridge graspable portion 146.

(2) Installation of the Developing Cartridge to the Drum Unit

As shown in FIG. 9, to install the developing cartridges 22 for the various colors into the drum subunits 23, the developing cartridge 22 is mounted down onto the drum subunit 23.

More specifically, as shown in FIG. 15, the collar member 50 of the right edge in the axis direction of the developer carrier shaft 45 of the developing cartridge 22 and the cylinder 184 of the feed member 182 are inserted in the right guiding groove 73 (having been formed in the right side frame 71 of the drum subunit 23). At the same time, as shown in FIG. 16, the collar member 50 (on the left edge in the axis direction of the developer carrier shaft 45), passive coupling gear 144, and the cylinder cover 186 (that covers the circumference of the passive coupling gear 144) are inserted into the left guiding groove 189 formed between the left side frame 70 and the left side plate 95 of the center frame 72 of the corresponding drum subunit 23. Then, developing cartridge 22 is pushed downward into the drum subunit 23 so that the cylinder 184 slides along the right guiding groove 73. Also, cylinder cover 186 (covering passive coupling gear 144) slides along the left guiding groove 189. The insertion/removal direction of the developing cartridge 22 to/from the drum subunit 23 is in the top and bottom direction, as described above.

As shown in FIGS. 15 and 16, when the collar members 50 on both edges in the axis direction of the developing shaft 45 contact the deepest portion 154 of the right guiding groove 73 and the deepest portion 153 of the left guiding groove 189, then the developing cartridge 22 is mounted on the corresponding drum subunit 23.

As shown in FIG. 15, at this time, the collar member 50 on the right side in the axis direction and the groove wall that forms the groove width at the deepest portion 154 contact each other. As shown in FIG. 16, the collar member 50 on the left side in the axis direction and the groove wall that forms the groove width at the deepest portion 153 contact each other.

Each of the developing cartridges 22 contacts the alignment roller 218 of the drum subunit 23 (see FIG. 9). The alignment projection 217 also contacts the alignment roller 218 (see FIG. 10) of the front beam 96. In addition, the rubber roller 46 of the developer carrier 34 contacts the surface of the image carrier 24, as shown in FIG. 2.

The developing cartridge 22 is aligned with the drum subunit 23 when it is installed in the drum subunit 23, through the contact of the collar member 50 with the deepest portions 153 and 154, the contact of the alignment projection 217 with the alignment roller 218, and the contact of the developer carrier 34 with the image carrier 24.

More specifically, as shown in FIG. 16, the collar member 50 contacts the groove walls that face each other at the deepest portions 153 and 154 (see FIG. 15). Therefore, the developing cartridge 22 is aligned relative to the drum subunit 23 in the direction that faces each of the groove walls of the deepest portions 153 and 154 (namely, the direction that connects the diagonal to the upper rear and the diagonal to the lower front).

When the alignment projection 217 contacts the alignment roller 218, the developing cartridge 22 is aligned, relative to the drum subunit 23, in the direction that connects the diagonal to the upper rear and the diagonal to the lower front.

When the developer carrier 34 contacts the image carrier 24, the developing cartridge 22 is aligned in the direction where the developer carrier 34 contacts the image carrier 24, in the direction that connects the diagonal to the lower rear and the diagonal to the upper front.

As a result, the developing cartridge 22 is aligned relative to the drum subunit 23 in the top and bottom direction.

In addition, as shown in FIG. 15, when the developing cartridge 22 is installed in the corresponding drum subunit 23, the cylinder 184 of the feed member 182 of the developer carrier shaft 45 contacts the convex portion 176 of the feed coil 155 (that is connected to the developer carrier electrode 82 provided on the right side frame 71).

Furthermore, as shown in FIG. 17, when the developing cartridge 22 is installed on the corresponding drum subunit 23, the left window 142 that is embedded in the left sidewall 141 of the developing frame 31 faces the boss 75 (formed in the left side frame 70) and the light transmission hole 123 (formed in the left side plate 121). In addition, the right window 142 that is embedded in the right sidewall 141 of the developing frame 31 faces the boss 75 (formed in the right side frame 71) and the light transmission hole 123 (formed on the right side plate 121), in the width direction, so that the detection light can be transmitted. This alignment allows light to be transmitted through the developing frame.

In addition, as shown in FIG. 8, the passive coupling gear 144 (that projects from the gear cover 143 on the left sidewall 141 of the developing frame 31) faces the coupling internal insertion portion 74 (located on the left side frame 70) and the coupling external insertion hole 130 (located on the left side plate 121), in the width direction. Here, the coupling input shaft 145 provided on the main body casing 2 (see FIG. 18) can pass through freely in the forward and backward directions.

When all the developing cartridges 22 are inserted in the drum subunit 23, the near-side graspable portion 104 of the front beam 96, the developing cartridge graspable portion 146 of each of the developing cartridges 22, and the far-side graspable portion 116 of the rear beam 111 overlap each other in the front and rear directions as shown in FIG. 14.

Furthermore, when all the developing cartridges 22 are inserted in the drum subunit 23, each of the developing cartridges 22 can be withdrawn upwards, by inserting fingers into the graspable long hole 209 to grab the developing cartridge graspable portion 146 and then pulling upwards.

As shown in FIG. 1, after all the developing cartridges 22 are installed in the drum subunit 23 as described above and the drum unit 21 is installed in the drum housing 161 of the main body casing 2, then a color image can be formed on the paper 3 through the above-described image formation operation.

4. MAIN BODY CASING

FIG. 18 is a schematic view that shows the top view of the inside the laser printer shown in FIG. 1 in order to explain the operation in which the passive coupling gear is connected to the coupling input shaft. FIG. 19 is a left side perspective view of the coupling input shaft and around the arm in order to explain the contact condition between the coupling input shaft and the arm in FIG. 18.

The main body casing 2 has an approximately rectangular box shape (with a front opening when viewed from the side) and a drum housing 161 (housing the drum unit 21) is formed within the main body casing 2. In addition, a drum insertion/removal opening 162 that connects to the drum housing 161 is formed on the front wall of the main body casing 2.

A front cover 163 to open/close the drum insertion/removal opening 162 is provided on the front wall of the main body casing 2. This front cover 163 is supported by the hinge (not shown) provided at the bottom edge of the drum insertion/removal opening 162 of the main body casing 2 in a rotatable manner. By this arrangement, the hinge allows the front cover 163 to open and close the main body casing 2. By doing so, when front cover is closed using the hinge as the point of support, the drum insertion/removal opening 162 is closed by the front cover 163. When the front cover 163 is open using the hinge as the point of support, then the drum insertion/removal opening 162 is opened so that the drum unit 21 can be inserted/removed to/from the drum housing 161 from the front, via the drum insertion/removal opening 162.

A roller (not shown) and a rail (not shown) are provided in the drum housing 161. This rail (not shown) extends in the front and rear direction at the internal wall of both walls 165 that face the main body casing 2 in the width direction. The walls 165 face each other in the width direction. In addition the roller (not shown) is provided on the internal wall of both walls 165 in a rotatable manner above the front edge of each rail (not shown) with a slight gap from each rail.

Therefore, when the hook 122 of the side plate 121 is guided by the roller (not shown) and roll 177 is guided on the rail (not shown) the drum unit 21 is smoothly inserted/removed in the front and rear direction to/from the drum housing 161.

In addition, an alignment bar (not shown), which is installed between the internal walls of both sidewalls 165, is provided at the rear edge of the drum housing 161. An alignment mechanism (not shown) is provided near the roller (not shown) at the front edge of the drum housing 161. This alignment mechanism (not shown) selectively applies a backward (direction of the drum unit 21 installation) or a forward (direction of the drum unit 21 removal) pressure against the drum unit 21 that is contained in the drum housing 161 depending on the opening/closing of the front cover 163.

More specifically, when drum unit 21 is installed in the drum housing 161 and the front cover is closed, the alignment shaft 204 of the drum unit 21 (see FIG. 7) is pressed backward by the alignment mechanism (not shown). In addition, by doing so, the notch 179 of each side plate 121 (see FIG. 7) contacts the alignment bar (not shown) of the drum housing 161, and therefore the drum unit 21 is aligned inside the drum housing 161 by the alignment mechanism (not shown) and the alignment bar (not shown).

When the front cover 163 is open, the alignment mechanism (not shown) presses the alignment shaft 204 (see FIG. 7) of the drum unit 21 forward. The notch 179 is released from the alignment bar (not shown). Next, the alignment of the drum unit 21 in the drum housing 161 is released. Now, the drum unit 21 can be removed from the drum housing 161.

The drum unit 21 is inserted/removed to/from the drum housing 161 by grasping the near-side graspable portion 104 at the operation position. In addition, when the near-side graspable portion 104 rotates to the stowed position, the front cover 163 can be closed. It is acceptable to interlock the rotation of the near-side graspable portion 104 with the opening/closing of the front cover 163.

A tray housing 171 containing the paper tray 7 is formed below the drum housing 161 of the main body casing 2. In addition, a tray insertion/removal opening 172 that connects to the tray housing 171 is formed at the front wall of the main body casing 2.

The paper tray 7 is mounted in the tray housing 171 so that the paper tray 7 can slide along the front and rear direction. When pulling the paper tray 7 toward the front when the paper tray 7 is mounted on the tray housing 171, the paper tray 7 can be removed from the tray housing 171.

Furthermore, as shown in FIG. 18, the left sidewall 165 may include an external wall 192 that forms the external (left side) surface in the width direction and an internal wall 193 that forms the internal (right side) surface in the width direction.

A coupling input shaft 145 (connected to the passive coupling gear 144) may be provided on the left side of the developing cartridge 22 so that the developing cartridge 22 can move forward and backward in the width direction. An arm 194 that moves the coupling input shaft 145 forward and backward in the width direction (left and right direction) may be provided between the external wall 192 and internal wall 193 in the width direction.

The arm 194 includes an arm portion 195 (extending in the front and rear direction) and a cam 196 (provided at the rear edge of the arm portion 195 in an integrated manner).

As shown in FIG. 19, a long hole 197 that extends in the front and rear direction (where the coupling input shaft 145 is inserted) is provided on the cam 196. A thick retreating area 198 (thick in the width direction) is provided around the rear edge of the long hole 197. A thin advancing area 199 (thin in the width direction) is provided around the front edge of the long hole 197.

The arm 194 is supported so that the arm 194 can move in the front and rear direction along the internal wall 193 under the condition in which the coupling input shaft 145 is inserted in the long hole 197 at the rear edge. In addition, the arm 194 moves in the front and rear direction by interlocking with the opening/closing of the front cover 163.

Figures 18A, 18B, 18C, 18D:
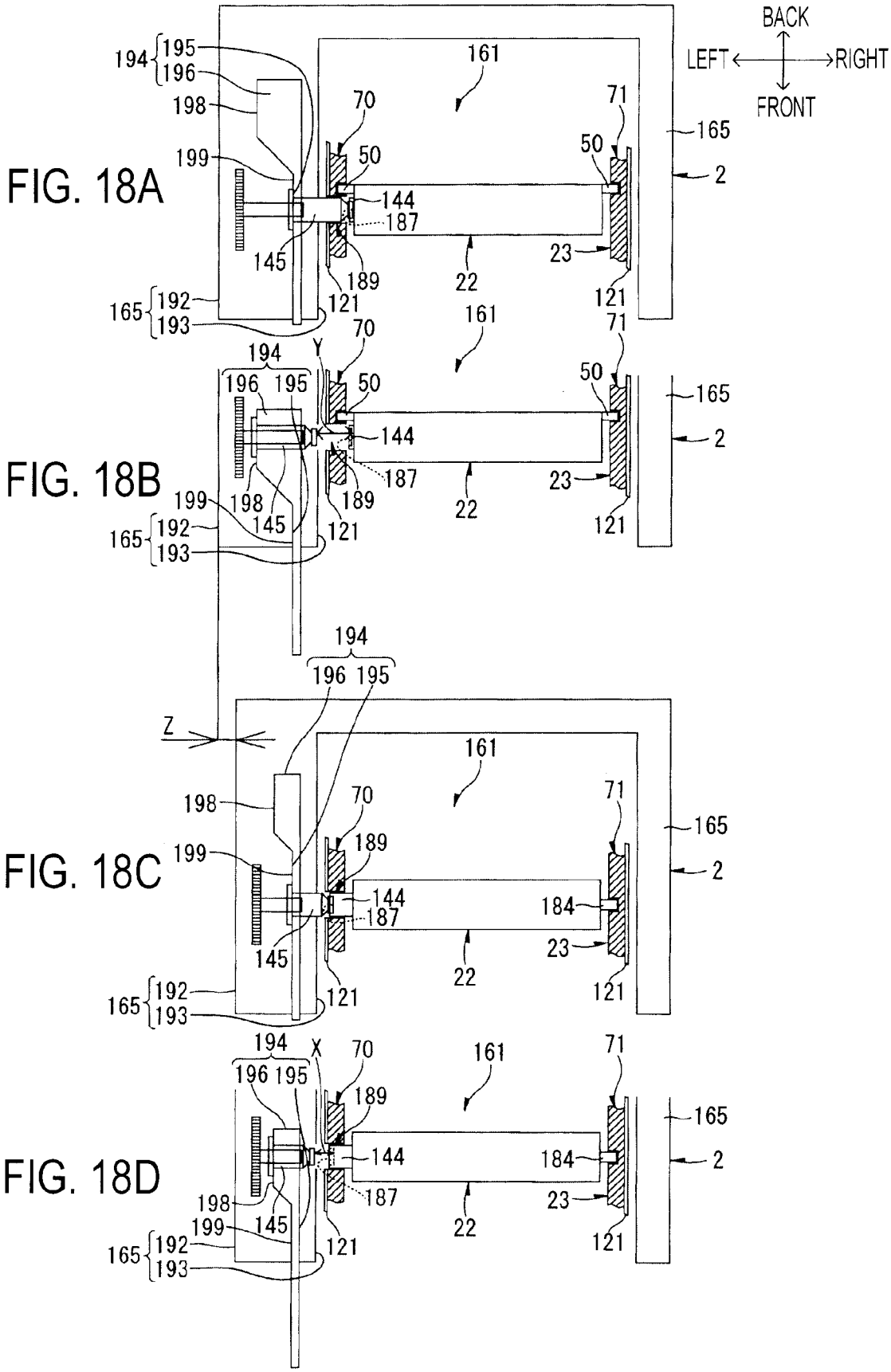
FIGS. 18A-18D show a schematic views that show the top views of the inside the laser printer shown in FIG. 1 in accordance with aspects of the present invention.

As shown in FIGS. 18B and 18D, the coupling input shaft 145 faces the coupling insertion hole 187 of the passive coupling gear 144 of the drum unit 21. A rotary driving force from a motor (not shown) provided in the main body casing 2 is applied to the coupling input shaft 145. In addition, this coupling input shaft 145 is always pressed internally (right side) in the width direction (for example, toward the coupling insertion hole 187).

Figure 19B:
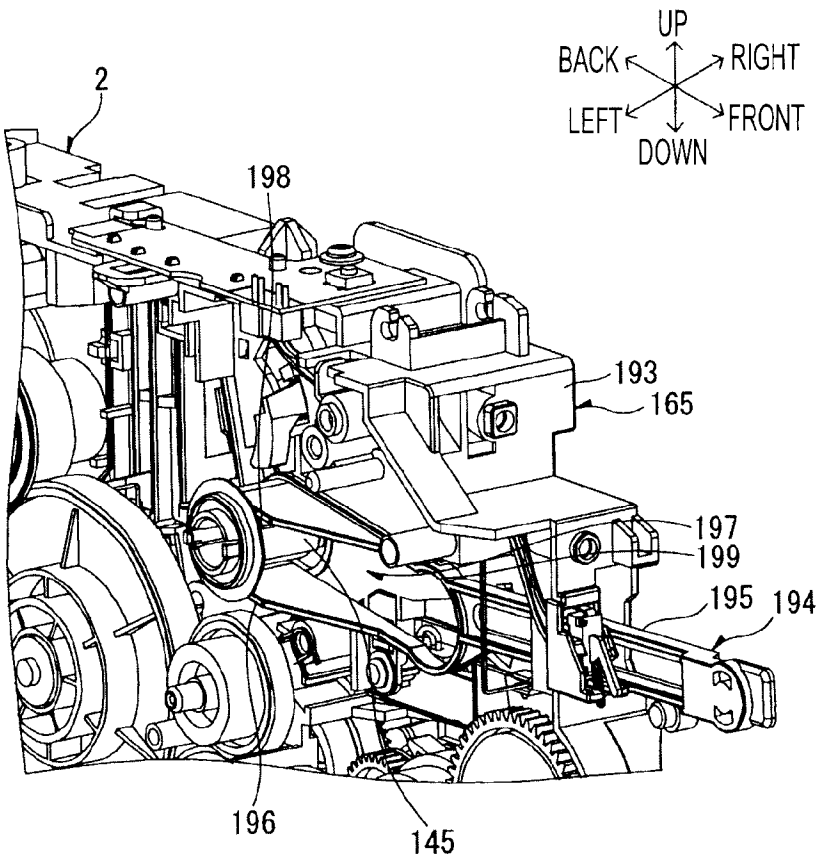
FIGS. 19A-19B show left side perspective views of the coupling input shaft and the arm in order to explain the contact condition between the coupling input shaft and the arm in FIGS. 18A-18D in accordance with aspects of the present invention.

During the insertion/removal of the drum unit 21 to/from the main body casing 2, when the front cover 7 is opened, the arm 194 moves to the front by interlocking with the opening of the front cover 163 and as shown in FIG. 19B. The safe area 198 is engaged with the coupling input shaft 145. Then, as shown in FIGS. 18B and 18D, the coupling input shaft 145 retreats from the coupling insertion hole 187 of the passive coupling gear 144 to the left side (outside in the width direction) in the rotary axis direction of the coupling input shaft 145 (width direction or left and right direction) by being placed against the pressure from the spring (not shown).

Figure 19A:
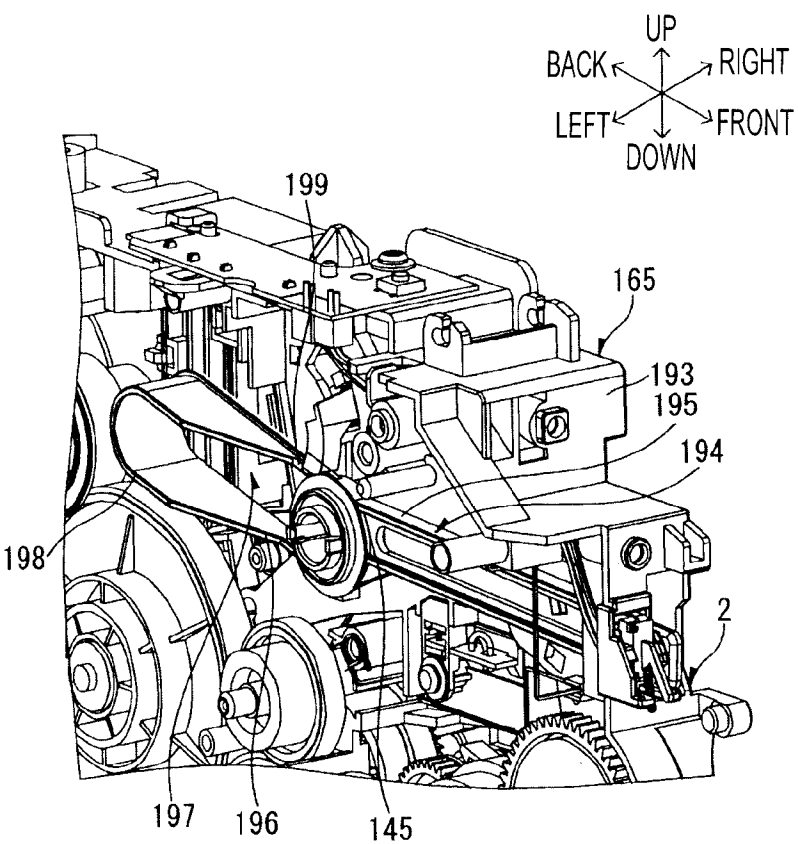

After the installation of the drum unit 21 to the main body casing 2, when the front cover 7 is closed, the arm 194 interlocks with the closing of the front cover 163 and moves backwards. As shown in FIG. 19A, the advance area 199 is engaged with the coupling input shaft 145. Then, as shown in FIGS. 18A and 18C, the coupling input shaft 145 advances on the right side (inwards in the width direction) towards the coupling insertion hole 187 of the passive coupling gear 144. The coupling input shaft 145 is connected in a relatively non-rotatable manner.

By doing so, at each of the developing cartridges 22, the driving force from the motor (not shown) is transmitted to/from the coupling input shaft 145 to the passive coupling gear 144. Accordingly, the agitator 21, supplying roller 33, developer carrier 34, and detection gear 205 are rotary driven via the gear train (not shown).

In addition, as shown in FIG. 7, terminals that are connected to the high voltage substrate (not shown) are connected to the wire electrode 80, grid electrode 81 (exposed from each of the center openings 133 which are formed on the right side plate 121), developer carrier electrodes 82 (exposed from each of the front openings 134), and the cleaning electrode 83 (exposed from the rear opening 135).

In addition a pressing release mechanism, not shown in the drawing, is provided on top of the drum housing 161 of the main body casing 2. The pressing release mechanism (not shown) allows the color printer 1 to selectively form color images (using the four drum subunits 23) and a monochrome image (using only the black drum subunit 23K) depending on the user's objectives.

More specifically, when the drum unit 21 is inserted in the drum housing 161, the front cover 163 is closed and the coupling input shaft 145 is connected to the passive coupling gear 144. Next, the selection of whether the image formation is carried out in color or monochrome is carried out by operating the operation panel (not shown).

Depending on this selection, when a color image formation is carried out, the pressing release mechanism (not shown) downwardly presses the pressing projections 211 of the four developing cartridges 22 that are mounted on the drum unit 21. At this time, the graspable portion 146 of each developing cartridge, where the pressing projections 211 are provided, moves towards the front edge of the top wall 147 of the developing frame 31 relative to the pressure of the flexible member 210. Along with this movement, the pressure by the flexible member 210 acts on the front edge of the top wall 147 of the developing frame 31 in the direction of releasing from the front edge of the developing cartridge graspable portion 146 (downward). Because of this, the developing frame 31 of the four developing cartridges 22 moves downward. Also, the rubber rollers 46 of the developer carrier 34 (supported by each of the developing frames 31) is pressed against the surface of the image carrier 24, as shown in FIG. 2. Thus, the toner from each of the developer carriers 34 is supplied to each of the image carriers 24 allowing the formation of a color image.

When a monochrome image formation is carried out, as shown in FIG. 7, the pressing release mechanism (not shown) presses downward only on the pressing projection 211 of the black developing cartridge 22K among the four developing cartridges 22 mounted on the drum unit 21. In contrast, the pressing release mechanism (not shown) presses upward on the releasing projections 212 at the developing cartridges 22 that are not the black developing cartridge 22K. Because of this the black developing cartridge 22K moves downwards, rubber roller 46 of the developer carrier 34 of the black developing cartridge 23K is pressed against the surface of the image carrier 24 of the black drum subunit 23K, the developing cartridges 22, other than the black developing cartridge 22K, move upward, and the rubber rollers 46 of the developer carrier 34 of each of the developing cartridges 22 are released from each of the image carriers 24. Therefore, the toner is supplied only to the image carrier 24 of the black drum subunit 23K from the developer carrier 34 of the developing cartridge 22K thereby allowing the formation of a monochrome image.

In addition, if paper jams in the middle of the image formation, the pressing release mechanism (not shown) supplies an upward pressure to the release projections 212 of all the developing cartridges 22. By doing so, the rubber roller 46 of the developer carriers 34 of all the developing cartridges 22 are released from the image carrier 24 allowing easy removal of the jammed paper 3.

In addition, as shown in FIG. 17 optical sensors 173 for detecting the remaining amount of toner contained in the toner container 37 and that correspond to each of the developing cartridges 22 are provided in the main body casing 2.

Each of the optical sensors 173 includes light emission element 174 and light receiving element 175. The light emission elements 174 and light receiving elements 175 face each other over the drum unit 21 (light emission element 174 on the right side and light receiving element 175 on the left side).

Light emission element 174 and light receiving element 175 are arranged so that they face with a pair of light transmission holes 123 in the width direction on the outside in the width direction of the pair of light transmission holes 123 under the condition in which the corresponding developing cartridge 22 is installed in the drum unit 21 and the drum unit 21 is installed in the drum housing 171.

Because of this, the detection light emitted from the light emitting element 174 passes through the boss 75 that fits in the right light transmission hole 123, and then is incident in the toner container 37 via the right window 142. The light then passes through the toner container 37 and then is emitted via the left window 142. Finally, the light passes through the boss 75 (that is fit in the left light transmission hole 123). The light is finally is detected by the light detection element 175.

The optical sensor 173 detects the remaining amount of toner in the toner container 37 in correspondence to the detection frequency of the detection light. When the remaining amount of the toner in the toner container 37 becomes scarce, the toner empty warning is indicated on the operation panel, etc. (not shown).

5. EFFECT

The color laser printer 1 includes a passive coupling gear 144 and feeder member 182 in the developing cartridge 22. The drum subunit 23 includes a right side frame 71 (that forms the right guiding groove 73), a center frame 72, and a left side frame 70 (that forms the left guiding groove 189).

When the passive coupling gear 144 is connected to the coupling input shaft 145, a driving force from a motor is securely supplied to the developer carrier 34 via the gear train (not shown).

In addition, when the cylinder 184 of the feeder member 182 contacts the feed coil 155 (provided on the drum subunit 23), electric power is supplied to the developer carrier 34 (and is known as developing bias). Compared to the case in which the feed coil 155 is provided somewhere other than at the drum subunit 23, the cylinder 184 can come closer to the feed coil 155. This movement allows a secure supply of electric power to the developer carrier 34. Further, the size of the cylinder 184 can be reduced.

Moreover, the passive coupling gear 144 is guided so that the passive coupling gear 144 slides on the left guiding groove 189. Also, the cylinder 184 of the feeder member 182 is guided so that the cylinder 184 slides on the right guiding groove 73. By this action, the developing cartridge 22 is inserted/removed to/from the drum subunit 23.

This arrangement allows easy replacement of the developing cartridge 22. Further, the function of guiding the developing cartridge 22 to the drum subunit 23 during the installation by the left guiding groove 189 can be added to the passive coupling gear 144. This is in addition to the original function of the passive coupling gear 144, which is the function of transmitting a driving force from the coupling input shaft 145. In addition, the function of being guided by the right guiding groove 73 during the installation of the developing cartridge 22 to the drum subunit 23 can be added to the cylinder 184. The original function of the cylinder 184 is to supply electric power from the feed coil 155.

Therefore, a new element does not need to be provided assist the guiding of the left guiding groove 189 and right guiding groove 73.

Consequently, the functionality of the developing cartridge 22 and the color laser printer 1 is improved. Further, the size of the color laser printer 1 can be reduced.

A drum unit 21, with drum subunits 23 with image carriers 24 and associated developing cartridges 22 mounted, can be inserted/removed to/from the drum housing 161 of the main body casing 2 in the rotary axis direction of the coupling input shaft 145. The rotary axis direction is the front and rear direction being perpendicular to the width (left and right) direction.

Therefore, multiple developing cartridges 22 and drum subunits 23 allow an image formation in multiple colors. In addition, when an image carrier 24 needs to be replaced, the replacement may be easily performed based on the easy insertion/removal of the multiple developing cartridges 22 and drum subunits 23.

In addition, the coupling input shaft 145 can move forward and backward in the rotary axis direction (left and right direction).

Therefore, when the coupling input shaft 145 is engaged with the advance area 199 of the arm 194, the coupling input shaft 145 advances to the right towards the coupling insertion hole 187 of the passive coupling gear 144. The coupling input shaft 145 is also connected so as to be relatively non-rotatable. In addition, when the coupling input shaft 145 is engaged with the retreating area 198 of the arm 194, the coupling input shaft 145 retreats to the left from the coupling insertion hole 187. Accordingly, the connection of the coupling input shaft 145 with the passive coupling gear 144 is released.

The connection and disconnection between the passive coupling gear 144 and the coupling input shaft 145 may be interlocked with the opening/closing of the front cover 163 during the insertion/removal of the drum unit 21 to/from the drum container 161 of the main body casing 2. This may improve the usability of the color laser printer 1.

Consequently, the functionality of the color laser printer 1 can be improved.

Furthermore, the circumference of the passive coupling gear 144 is covered by the cylinder cover 186. Thus, the passive coupling gear 144 can avoid direct contact with the left guiding groove 189 when guided by the left guiding groove 189. This may reduce the risk of collision damage to the passive coupling gear 144.

As a result, the developing cartridge 22 can be securely installed in the drum subunit 23 in an insertable/removable manner.

Moreover, the developing cartridge 22 is arranged so that the developer carrier 34 is downwardly exposed, downstream of the direction of installation of the developing cartridge 22 into the drum subunit 23. The developer carrier 34 may be exposed from the opening 36 at the bottom of the developing frame 31. Both ends of the developer carrier shaft 45 of the developer carrier 34 are covered with the collar member 50.

The developing cartridge 22 is aligned relative to the drum subunit 23 during the installation to the drum sub unit 23 when the collar member 50 contacts the deepest portion 153 of the left guiding groove 189 and the deepest portion 154 of the right guiding portion 73. This allows the the developing cartridge 22 to be installed in the drum subunit 23 with high precision. In addition, the collar member 50 is arranged adjacent to the developer carrier shaft 45 on the downstream side in the installation direction. The developer carrier 34 can securely and stably contact the image carrier 24.

Thus, when the drum subunit 23 is installed in the main body casing 2, the coupling input shaft 145 can be securely connected to the passive coupling gear 144. Thus, a driving force can be securely transmitted to the developer carrier 34. In addition, the feed coil 155 can securely contact the cylinder 184 of the feeder member 182, thereby allowing a secure supply of electric power to the developer carrier 34.

When the collar member 50 carries out alignment of the developing cartridge 22 relative to the drum subunit 23 during installation, alignment of the developer carrier 34 (as both ends of the developer carrier shaft 45 are covered by the collar member 50) can be carried out with high precision.

As a result, the developing cartridge 22 can be accurately installed to the drum subunit 23. In addition, covering both ends with collar member 50 allows a reduction of the damage to the developer carrier shaft 45. Moreover, the length of the developer carrier shaft 45 can be reduced.

Between the left edge surface and the circumference of the collar 50 of the developer carrier shaft 45, an inclined collar surface 185 is formed with a chamfered edge.

Therefore when the developing cartridge 22 is inserted/removed to/from the drum subunit 23, the friction generated by the contact between the left edge of the collar member 50 and the left guiding groove 189 of the drum subunit 23 can be reduced.

This allows developing cartridge 22 to move smoothly in the insertion/removal direction to/from the drum subunit 23. This allows secure installation of developing cartridge 22 to the drum subunit 23 in an insertable/removable manner.

The passive coupling gear 144 externally projects (to the left) from the collar member 50 in the width direction (left and right direction). The width direction is the direction perpendicular to the insertion/removal direction of the developing cartridge 22 to/from the drum subunit 23. In addition the cylinder cover 186 is level with the left edge surface of the passive coupling gear 144.

The passive coupling gear 144 and the cylinder cover 186 (covering the circumference of the passive coupling gear 144) can come close to the coupling input shaft 145. Thus, when the drum subunit 23 is inserted in the main body casing 2, the passive coupling gear 144 can securely connect to the coupling input shaft 145. This allows a driving force to be securely transmitted to the developer carrier 34.

Furthermore, as shown in FIGS. 18C and 18D, the left edge surface of the passive coupling gear 144 projects slightly inside (compared to the external (left side) edge) of the left guiding groove 189 when the developing cartridge 22 is installed in the drum unit 23. This is in comparison to the positions shown in FIGS. 18A and 18B (where the left edge surface of the passive coupling gear 144 is positioned on the inner side (right side) relative to the inside (right side) in the width direction of the left guiding 189. With respect to FIGS. 18C and 18D, the movement of the coupling input shaft 145 in the rotary axis direction (left and right direction) in order to connect to the passive coupling gear 144 can be minimized.

Accordingly, when the amount of movement of the coupling input shaft 145 in the present embodiment is X (see the arrow in FIG. 18D) and the amount of movement of the coupling input shaft 145 in the comparative example is Y (see arrow in FIG. 18B), the size of the main body casing 2 in the rotary axis (width) direction of the coupling input shaft 145 can be reduced by the amount Z. The amount Z is equivalent to the difference between the amount of movement Y and the amount of movement X. Therefore, the size of the color laser printer 1 can be reduced.

The cylinder 184 of the feeder member 182 externally projects (to the right) in the width direction. The edge surface of the outside (right side) in the width direction of the cylinder 184 is on the right compared to the edge surface of the outside (right side) in the width direction of the collar member 50.

Therefore, the cylinder 184 can come closer to the feed coil 155. This allows a secure supply of electric power to the developer carrier 34.

The passive coupling gear 144 has a larger diameter than that of the cylinder 184. This larger diameter provides greater rigidity of the passive coupling gear 144 compared to the cylinder 184.

As a result, the driving force from the input coupling shaft 145 can be stably transmitted to the passive coupling gear 144.

In addition, the passive coupling gear 144 faces the cylinder 184 in the width direction. More specifically the center axis of the passive coupling gear 144 matches the center axis of the cylinder 184 in the front and rear, and top and bottom directions.

Therefore, when the developing cartridge 22 is installed in the drum subunit 23, a driving force from the input coupling shaft 145 is transmitted to the passive coupling gear 144. This prevents a large influence from torsion on the cylinder 184 and the feeder member 182, even if such torsion was generated and centered at the passive coupling gear 144.

As a result, a positional error of the feeder material 182 can be prevented. Here, the feed coil 155 contacts the cylinder 184, thereby allowing a stable supply of electric power to the developer carrier 34.

In addition, both the passive coupling gear 144 (covered by cylinder cover 186) and the cylinder 184 of the feeder member 182 are guided individually by the right guiding groove 73 and left guiding groove 189 during the insertion/removal of the developing cartridge 22 to/from the drum subunit 23. The developing cartridge can be stably inserted/removed to/from the drum subunit 23 without losing its alignment with the rest of the system.

Consequently, this arrangement allows a secure installation of the developing cartridge 22 to the drum subunit 23 in an insertable/removable manner.

The groove width C of the left guiding groove 189 is larger than the groove width A of the right guiding groove 73. The external diameter E of the cylinder 184 guided by the right guiding groove 73 is approximately the same or slightly smaller than the groove width A of the right guiding groove 73. The external diameter F of the cylinder cover 186 (guided by the left guiding groove 189 and covering the passive coupling gear 144) is larger than the groove width A of the right guiding groove 73. The external diameter F is approximately the same or slightly smaller than the groove width C of the left guiding groove 189.

Based on such a structure, the passive coupling gear 144 and the cylinder cover 186 are smoothly guided by the left guiding groove 189. Also, the cylinder 184 is smoothly guided by the right guiding groove 73.

When the passive coupling gear 144 and cylinder cover 186 face the right guiding groove 73 and the cylinder 184 faces the left guiding groove 189, the passive coupling gear 144 and cylinder cover 186 are not guided by the right guided groove 73. Accordingly, the developing cartridge 22 cannot be installed to the drum subunit 23. Therefore, an incorrect installation of the developing cartridge 22 to the drum subunit 23 can be prevented.

Consequently, this arrangement ensures proper installation of the developing cartridge 22 to the drum subunit 23.

6. MODIFIED EXAMPLES

(1) Modified Example 1

FIG. 20 shows a left lateral view of the drum subunit and developing cartridge for which a Modified Example 1 is applied. Modified Example 1 shows the state in which the developing cartridge is inserted into/removed from the drum subunit. FIG. 21 is a right lateral view of the drum subunit and developing cartridge in which Modified Example 1 is applied. The right guiding groove is exposed for description purposes and to show the state in which the developing cartridge is inserted into/removed from the drum subunit.

In FIGS. 20 and 21, common elements described previously are labeled with the same numerals. Description for these common elements is omitted.

As shown in FIGS. 15 and 16, in this embodiment, the developing cartridge 22 is aligned relative to the drum subunit 23 during the installation to the drum subunit 23, when 1) the collar member 50 contacts the deepest portions 153 and 154, 2) the alignment projection 217 contacts the alignment roller 218, and 3) the developer carrier 34 contacts the image carrier 24.

In such an embodiment, as a modified example, the cylinder cover 186 (covering circumference of the passive coupling gear 144 and the cylinder 184 of the feeder member 182) performs an aligning role instead of the aligning role performed by collar member 50. In that case, the external diameter of the collar member 50 can be smaller than the external diameter D (compare to the diameter of collar member 50 in FIG. 11).

In that case, as shown in FIG. 20, the bottom edge of the front concave portion 69 projects towards the rear side perpendicular wall 138 at the left guiding groove 189. The amount of projection is configured so that the space between the bottom edge of the front concave portion 69 and the top edge of the rear concave portion 152 is smaller than the external diameter F of the cylinder cover 186. Additionally, the top edge of the rear concave portion 152 is positioned diagonally to the upper rear of the bottom edge of the front concave portion 69.

In addition, as shown in FIG. 21, a concave alignment portion 220 that is continuously concave from the rear side groove wall to the rear of the right guiding groove 73 is formed at the location where the rear side groove wall of the right guiding groove 73 faces the cylinder 184 when the developing cartridge 22 is installed in the drum subunit 23.

Figure 20B:
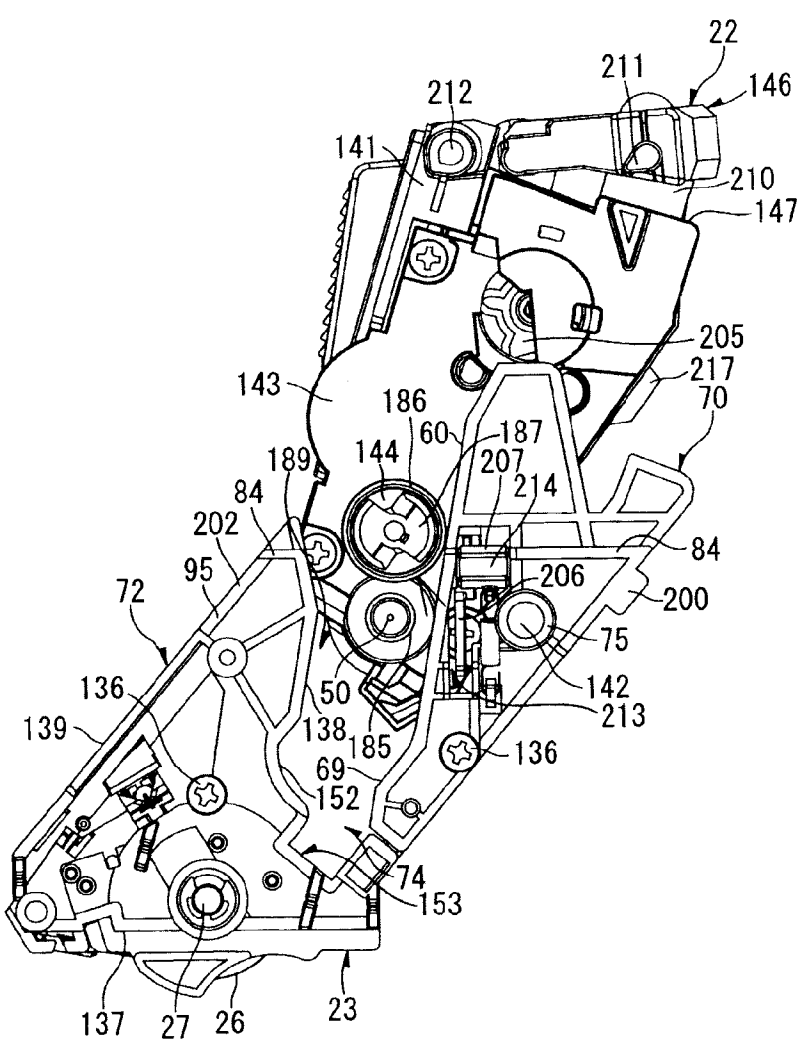
FIGS. 20A-20B show left lateral views of the drum subunit and developing cartridge according to a Modified Example 1 in accordance with aspects of the present invention.
Figure 21B:
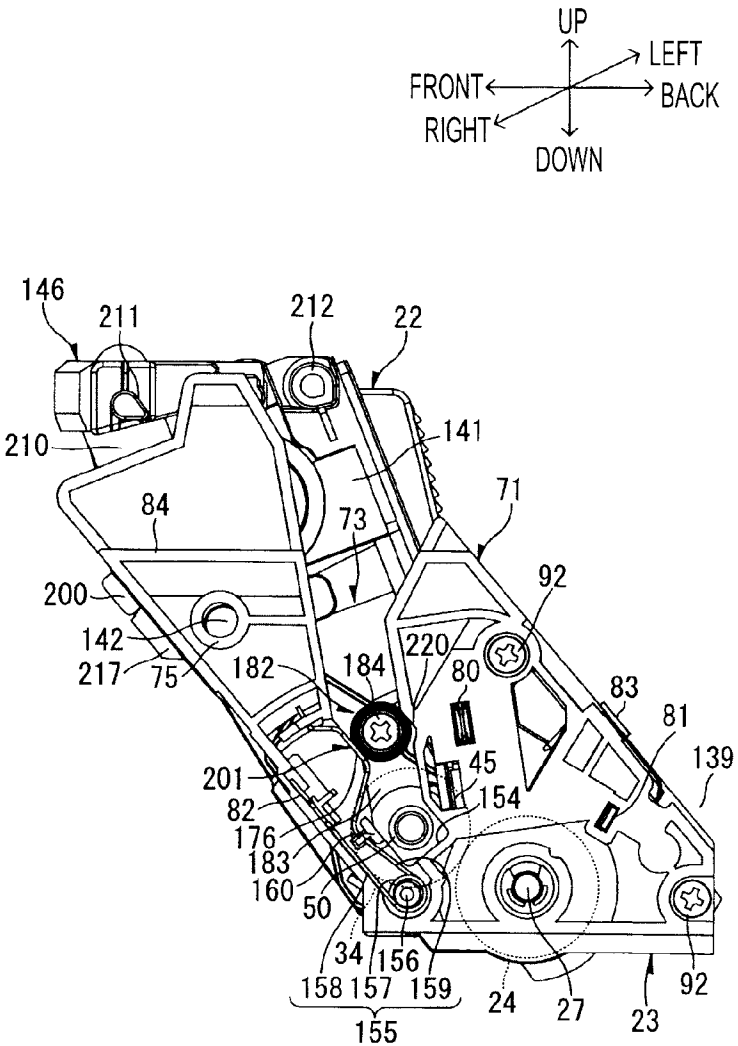
FIGS. 21A-21B show a right lateral view of the drum subunit and developing cartridge relating to Modified Example 1 in accordance with aspects of the present invention.
Figure 21A:
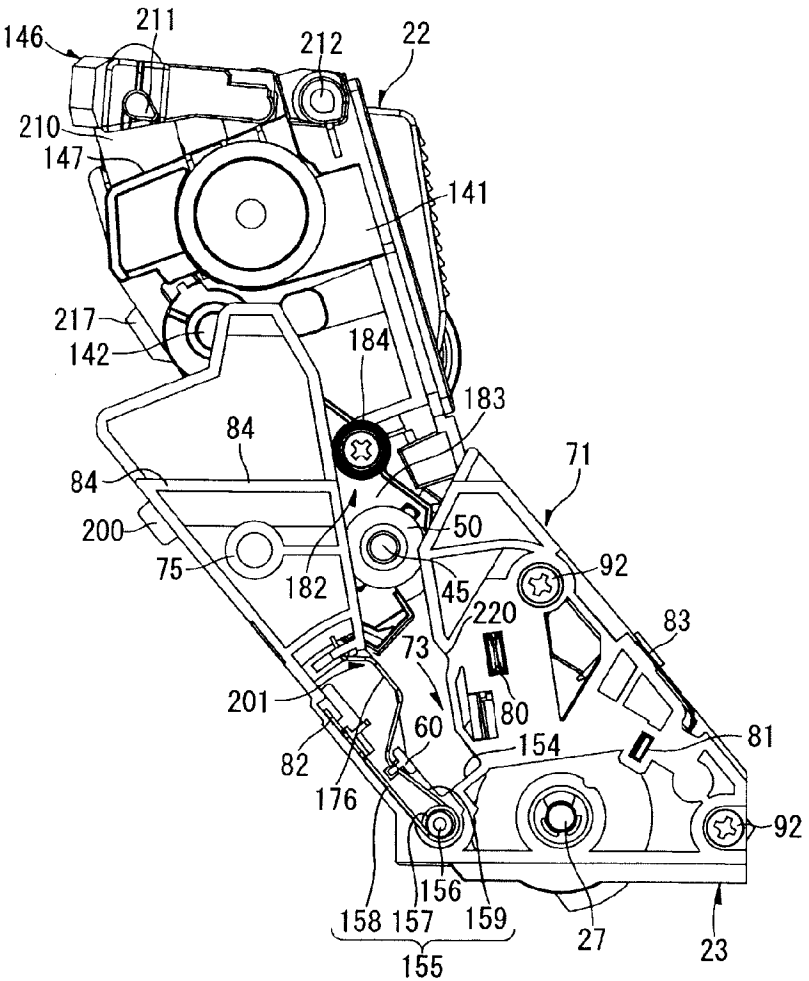

In such a drum subunit 23, as shown in FIG. 21A, the collar member 50 of the right edge in the width direction of the developer carrier 45 of the developing cartridge 22 and the cylinder 184 of the feeder member 182 are inserted in the right guiding groove 73. At the same time, as shown in FIG. 20B, the collar member 50 of the left edge in the width direction of the developer carrier 45, passive coupling gear 144, and the cylinder cover 186 that covers the circumference of the passive coupling gear 144 are inserted in the left guiding groove 189. Then, the developing cartridge 22 is pushed downwards to the drum subunit 23 so that the cylinder 184 slides along the right guiding groove 73. Also, the cylinder cover 186 that covers the passive coupling gear 144 slides along the left guiding groove 189.

Then, as shown in FIG. 21B, the cylinder 184 of the feeder member 182 diagonally contacts the upper bottom of the convex portion 176 of the feed coil 155. Because of this the cylinder 184 is pressed diagonally towards the upper rear (toward the alignment concave portion 220 from the feed coil 155). Also, the cylinder 184 is engaged at the edge of the alignment concave portion 220.

Figure 20A:
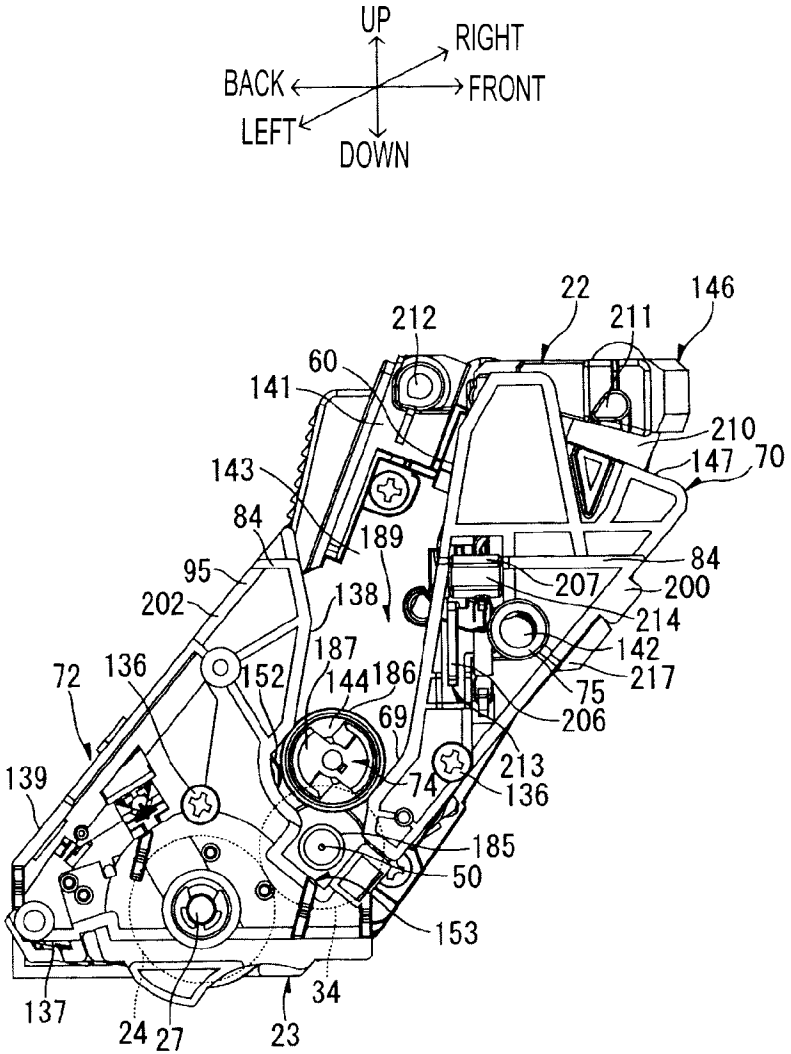

As shown in FIG. 20A, the distance between the top edge of the rear concave portion 152 and the bottom edge of the front concave portion 69 is smaller than the external diameter F of the cylinder cover 186. Therefore, the passive coupling gear 144 (whose circumference is covered by the cylinder cover 186) is engaged at the top edge of the rear concave portion 152 and the bottom edge of the front concave portion 69. At that time the passive coupling gear 144 (whose circumference is covered by the cylinder cover 186) receives pressure from the top edge of the rear concave portion 152 and the bottom edge of the front concave portion 69 in the direction that connects diagonally to the upper rear and diagonally to the lower front.

At this time, the collar member 50 is positioned at the deepest portions 153 and 154. Nonetheless, the collar member 50 does not contact the deepest portions 153 and 154.

As described above, when the cylinder 184 contacts the feed coil 155 and is engaged at the top edge of the alignment concave portion 220, and when the passive coupling gear 144 (whose circumference is covered by the cylinder cover 186) is engaged at the top edge of the rear concave portion 152 and the bottom edge of the front concave portion 69, the developing cartridge 22 is aligned against the drum subunit 23 in the direction that connects diagonally to the upper rear and diagonally to the lower front. This alignment direction is identical to the alignment direction when the collar member 50 is used for alignment.

Therefore, the cylinder 184 and the passive coupling gear 144 may align the developing cartridge 22 relative to the drum subunit 23 instead of the collar member 50.

An alignment function of the developing cartridge 22 relative to the drum subunit 23 can be added in addition to the original functions for the passive coupling gear 144 and cylinder 184 of the feeder member 182. Namely, the function to transmit a driving force from the coupling input shaft 145 at the passive coupling gear 144 and the function to feed electric power when the cylinder 184 contacts the feed coil 155 may be added.

As a result, the functionality of a developing cartridge 22 and color laser printer 1 can be improved.

(2) Modified Example 2

Figure 24:
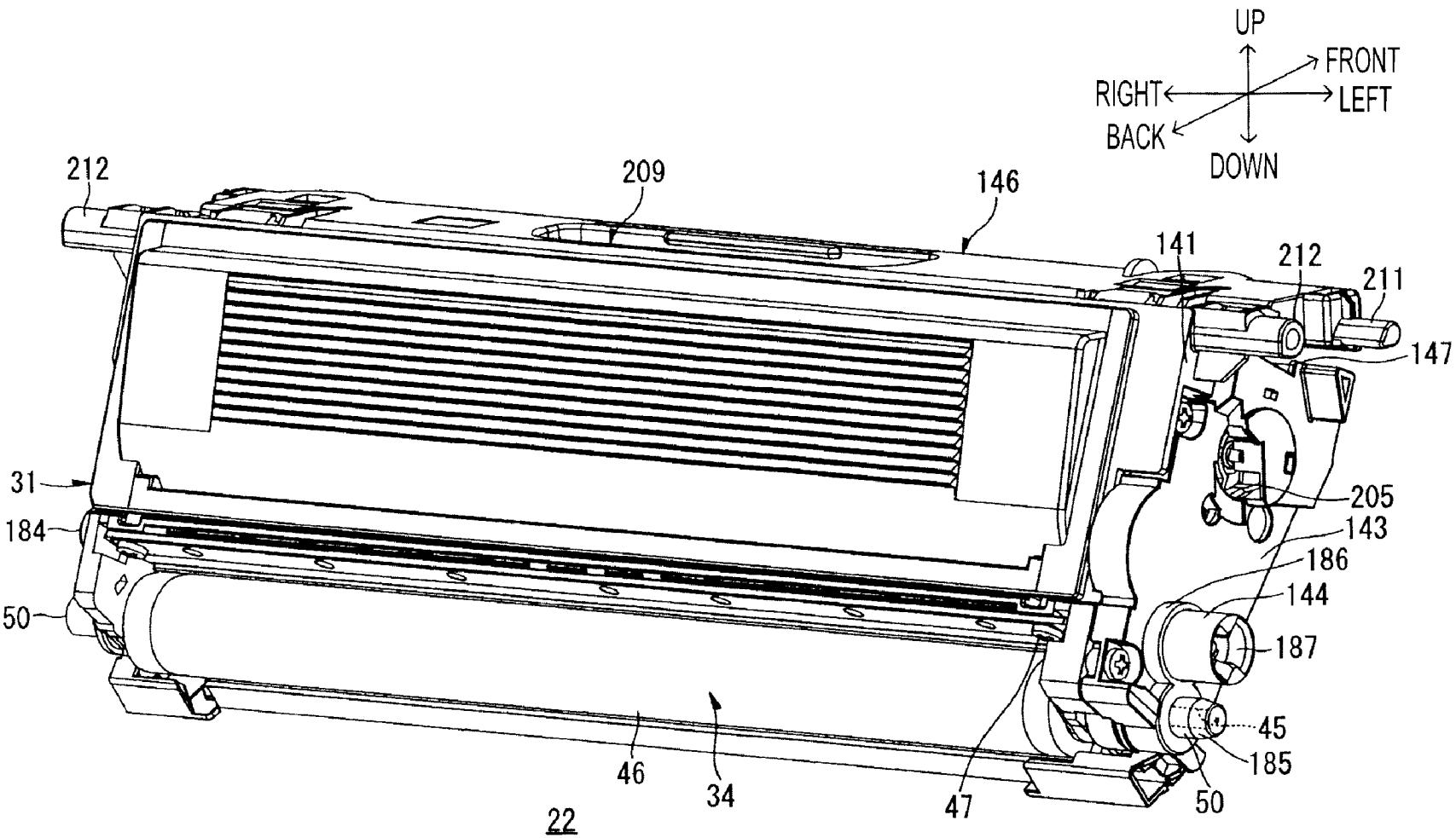
FIG. 24 is a left perspective view of the developing cartridge showing the back side of the developing cartridge relating to a Modified Example 2 in accordance with aspects of the present invention.

FIG. 24 is a left perspective view of the developing cartridge in which Modified Example 2 is applied showing the back side of the developing cartridge. In FIG. 24, common elements described previously are labeled with the same numerals. Description for these common elements is omitted.

As shown in FIG. 24, in this developing cartridge 22, the circumference of the passive coupling gear 144 can be externally exposed. More specifically, left edge of the cylinder cover 186 matches the right edge of the collar member 50 in the left and right direction.

In other words, the circumference of the portion of the passive coupling gear 144 that is on the left of the left edge of the cylinder cover 186 is not covered by the cylinder cover 186. Because of this arrangement, when the developing cartridge 22 is inserted/removed to/from the drum subunit 23, the circumference of the passive coupling gear 144 slides on the left guiding groove 189 instead of sliding on the cylinder cover 186.

(3) Modified Example 3

Figure 25:
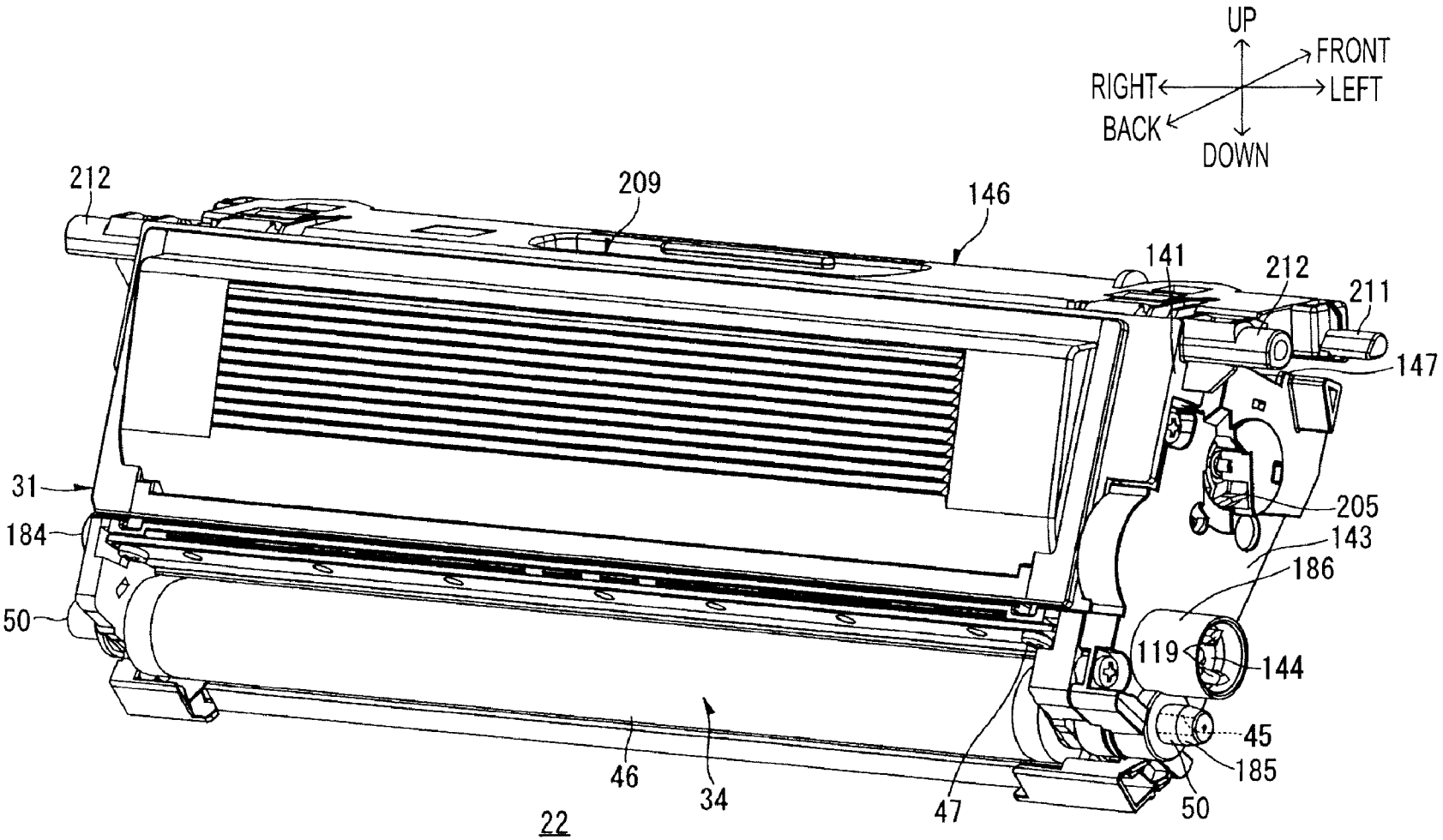
FIG. 25 is a left perspective view of the developing cartridge showing the back side of the developing cartridge relating to a Modified Example 3 in accordance with aspects of the present invention.

FIG. 25 is a left perspective view of the developing cartridge in which Modified Example 3 is applied, showing the backside of the developing cartridge. In FIG. 25, common elements described previously are labeled with the same numerals. Description for these common elements is omitted.

As shown in FIG. 25, in this developing cartridge 22, the circumference of the passive coupling gear 144 can be covered by the cylinder cover 186 so that the passive coupling gear 144 has a gap in the diameter direction relative to the internal circumference of the cylinder cover 186.

In addition, a pair of coupling connection projections 119 (facing each other over the rotary axis of the passive coupling gear 144) can be formed so that they project to the left side from the left surface of the passive coupling gear 144 on the passive coupling gear 144 instead of the coupling insertion hole 187.

The coupling connection projections 119 are formed so that their left edge matches the left edge of the cylinder cover 186 in the left and right direction. On the right edge surface (the surface that faces the passive coupling gear 144 in the left and right direction) of the coupling input shaft 145 that connects to the passive coupling gear 144, a figure eight-shaped insertion hole (not shown) is formed (the insertion hold being a concave shape from the right edge surface to the left). Therefore, when each of the coupling connection projections 119 are inserted into the insertion holes (not shown) for the coupling input shaft 145, the coupling input shaft 145 is connected to the passive coupling gear 144.

(4) Modified Example 4

Figure 26:
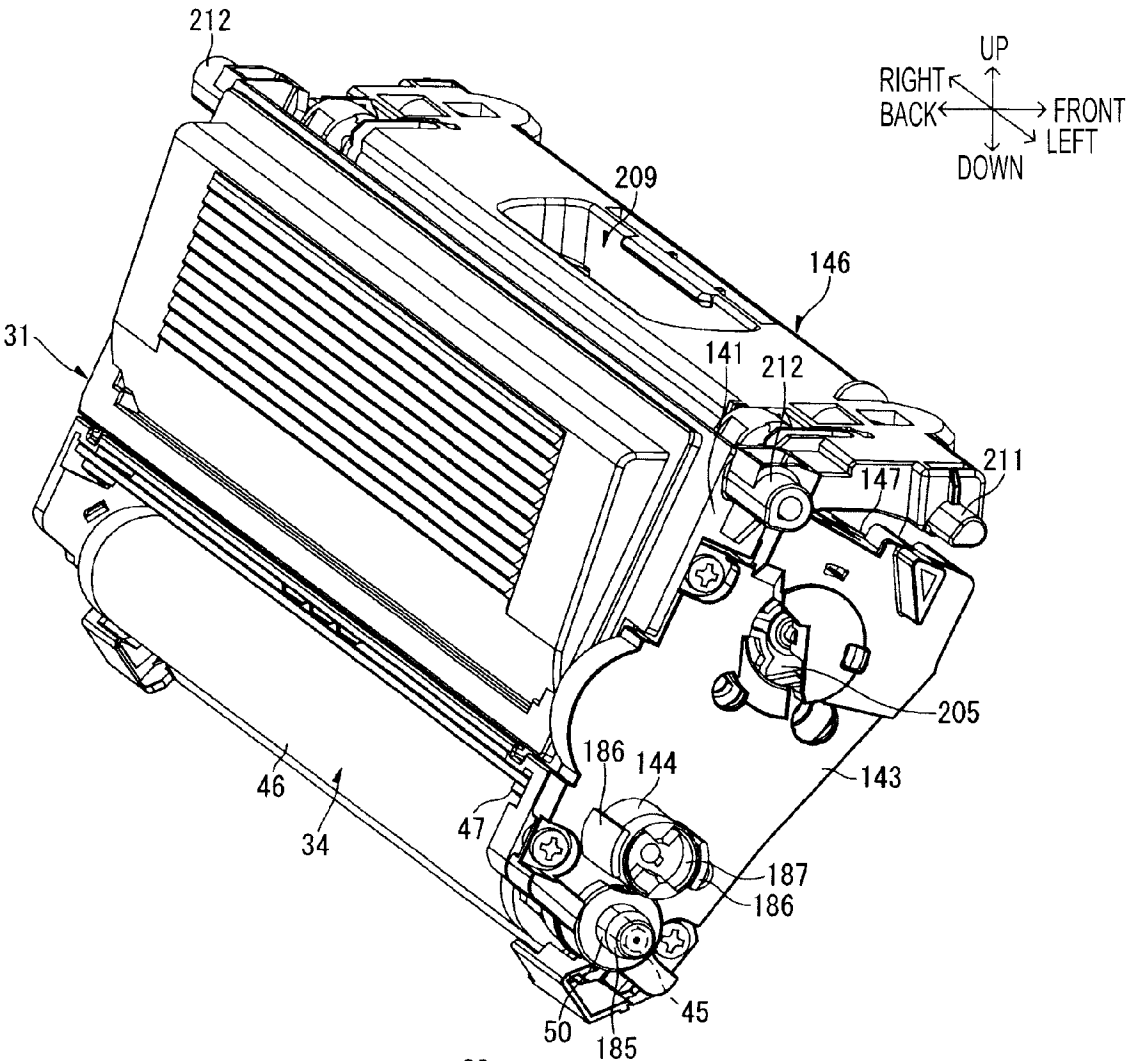
FIG. 26 is a left perspective view of the developing cartridge showing the back side of the developing cartridge relating to a Modified Example 4 in accordance with aspects of the present invention.
Figure 27:
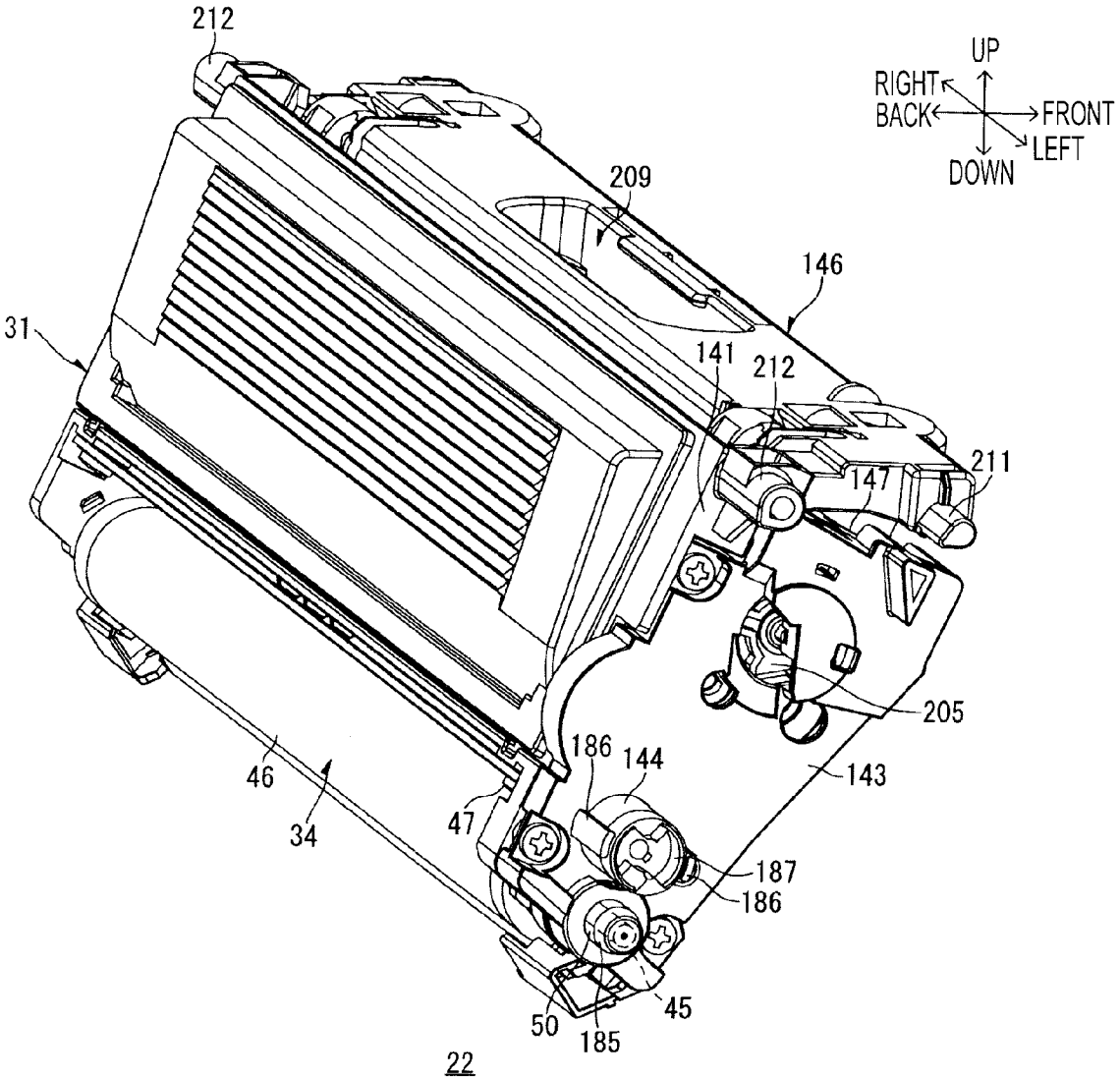
FIG. 27 is a left perspective view of the developing cartridge showing the back side of the developing cartridge where the length of the circumference of the cylinder cover is approximately half of the cylinder cover shown in FIG. 26 pertaining to Modified Example 4 in accordance with aspects of the present invention.
Figure 28:
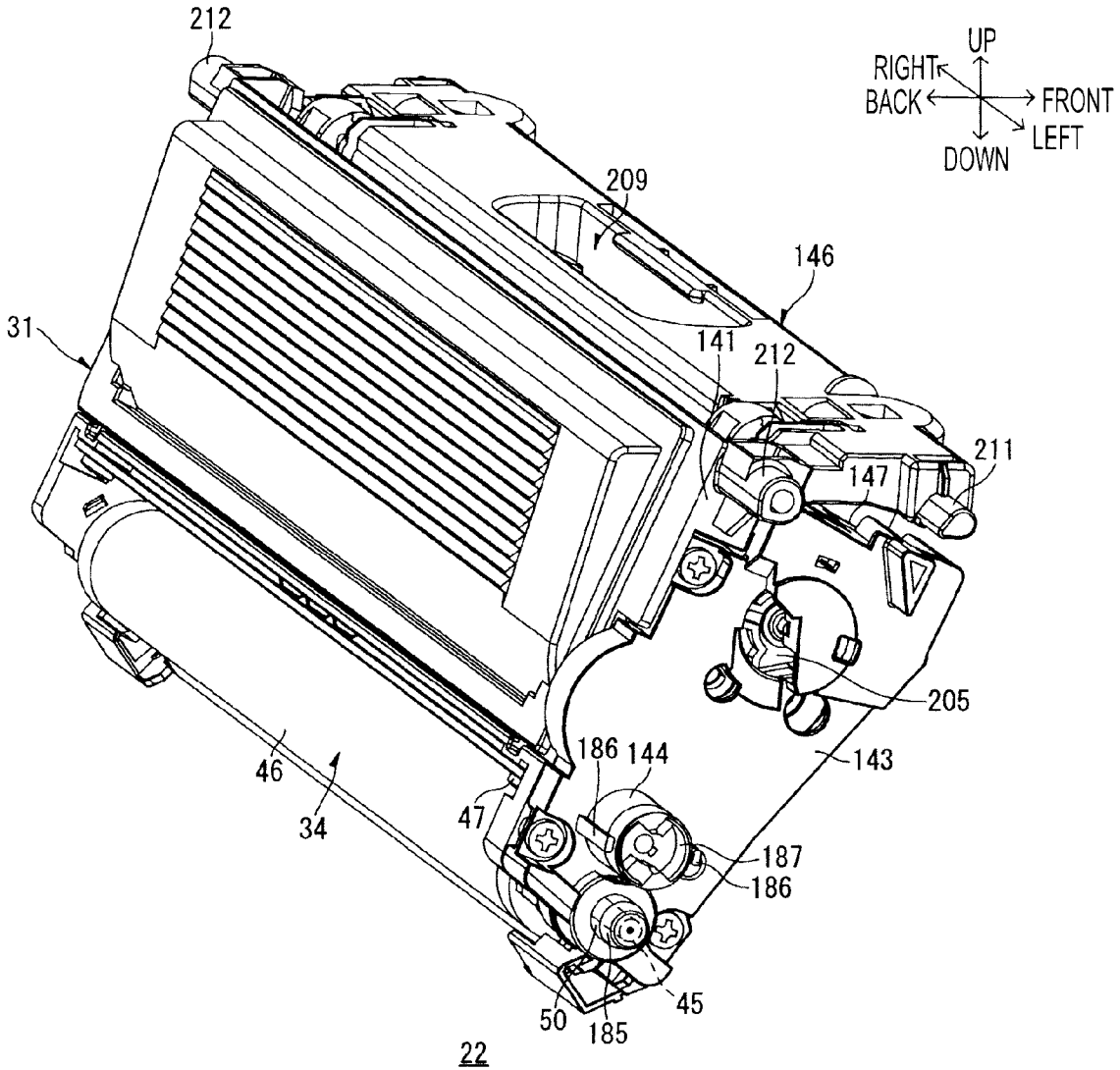
FIG. 28 is a left perspective view of the developing cartridge showing the back side of the developing cartridge where the length of the circumference of the cylinder cover is approximately half of the cylinder cover shown in FIG. 27 pertaining to Modified Example 4 in accordance with aspects of the present invention.

FIGS. 26, 27 and 28 are left perspective views of the developing cartridge in which Modified Example 4 is applied, showing the back side of the developing cartridge. In FIGS. 26, 27 and 28, common elements described previously are labeled with the same numerals. Description for these common elements is omitted.

As shown in FIG. 26, in this developing cartridge 22, the entire circumference of the passive coupling gear 144 does not need to be covered by the cylinder cover 186. More specifically, only a part of the circumference of the passive coupling gear 144 (which slides on the left guiding groove 189 during insertion and removal) is covered by the cylinder cover 186.

In other words, the cylinder cover 186 is formed as a pair of projections in an arch shape when viewed from the side that sandwiches the passive coupling gear 144 in the front and rear direction. This arch shape is in contrast to a cylinder shape. The cylinder cover 186 slides on the left guiding groove 189 when the developing cartridge 22 is inserted/removed to/from the drum subunit 23. Therefore, the cylinder cover 186 is acceptable as long as the cylinder cover 186 has a minimum size that allows sliding on the left guiding groove 189 instead of the passive coupling gear 144. As shown in FIG. 27, the length of the circumference of the cylinder cover 186 can be, for example, approximately half of the cylinder cover 186 shown in FIG. 26. Furthermore, as shown in FIG. 28, the length of the circumference of the cylinder cover 186 can be, for example approximately half of the cylinder cover 186 shown in FIG. 27.

(5) Modified Example 5

The drum unit 21 according to the above embodiments has a separate drum subunit 23 so that the developing cartridges 22 are mounted on each of the drum subunits 23 in an insertable/removable manner. Nonetheless, the developing cartridge 22 and drum subunit 23 can be formed in an integrated manner. That allows replacement of the toner that corresponds to each color, developer carrier 34, and image carrier 24 together by replacing the drum unit 21.

(6) Modified Example 6

The above embodiments show examples of a tandem-type color laser printer 1 in which a transfer of an image is directly carried out from each of the image carriers 24 to the paper 3. Nonetheless, aspects of the present invention are not limited to the above tandem-type laser printer. For example, the laser printer 1 can be a color laser printer with an intermediate transfer-type system in which the toner image in each color can be transferred to a transfer body from each of the photoconductors temporarily. Next, the combined toner images are transferred to the paper at the same time. In addition, the laser printer can be formed as a monochrome laser printer. The monochrome laser printer can include a process unit (the image forming unit) in which a single developing cartridge 22 is mounted on a single drum subunit 23.

Although the subject matter has been described in language specific to structural features and/or mechanical acts, it is to be understood that the subject matter defined in the appended claims is not necessarily limited to the specific features or acts described above. Rather, the specific features and acts described above are disclosed as example forms of implementing the claims. Numerous other embodiments, modifications, and variations within the scope and spirit of the appended claims will occur to persons of ordinary skill in the art from a review of this disclosure.

What is claimed is:

1. An image forming device comprising:

a casing;

an image carrier having an axis extending in a first direction;

an image carrier cartridge that holds the image carrier;

wherein the image carrier cartridge is configured to be installed in and removed from the casing;

a developing cartridge configured to be installed and removed with respect to the image carrier and including a developer carrier configured to carry developer to the image carrier, wherein the developing cartridge includes:

a driving input portion extending from the developing cartridge, the driving input portion transmitting a driving force to rotate the developer carrier; and an electrode that is configured to contact a power supply element, which supplies an electric bias to the electrode when the developing cartridge is installed in the image carrier cartridge;

a driving rotator configured to be connected with the driving input portion; and a guide extending in a second direction and configured to guide the driving input portion when the developing cartridge is installed and removed with respect to the image carrier, wherein the guide comprises:

a first guide wall having a first guiding groove that guides the driving input portion, the first guiding groove having a first width measured along a third direction, which is perpendicular to the first direction; and a second guide wall having a second guiding groove that guides the electrode, the second guiding groove having a second width measured along to the third direction, wherein the first width is larger than the second width.

2. An image forming device according to claim 1, wherein the guide guides the developing cartridge towards the image carrier.

3. An image forming device according to claim 1, wherein the guide guides the developing cartridge toward a seated position, and wherein, after having been seated, the developing cartridge is moved toward the image carrier.

4. An image forming device according to claim 1 wherein the driving rotator is configured to move forward and backward in the first direction.

5. An image forming device according to claim 1, wherein the guide is associated with the image carrier cartridge; and the developing cartridge is configured to be installed in and removed from the image carrier cartridge along the guide in the second direction.

6. An image forming device according to claim 1 wherein the power supply element is mounted on the image carrier cartridge.

7. An image forming device according to claim 1, wherein the power supply element is mounted on an interior wall of the casing.

8. An image forming device according to claim 1 wherein: the driving input portion and the electrode are externally projected from the developing cartridge in the first direction.

9. An image forming device according to claim 8 wherein: the first width is larger than a maximum width of the driving input portion in the third direction.

10. An image forming device according to claim 9, wherein:

the second width is larger than a maximum width of the electrode in the third direction.

11. An image forming device according to claim 9, wherein:

the maximum width of the driving input portion is larger than the maximum width of the electrode.

12. An image forming device according to claim 1, wherein the driving input portion and the electrode are provided on the developing cartridge, the driving input portion facing the electrode in the direction perpendicular to the third direction.

13. An image forming device according to claim 1, wherein the driving input portion further comprises:

a driven rotator that transmits a driving force to the developer carrier while rotating, and a cover that surrounds a circumference of the driven rotator.

14. An image forming device according to claim 1, wherein the developing cartridge further comprises:

an alignment portion that aligns the developer carrier relative to the image carrier cartridge.

15. An image forming device according to claim 14 wherein the driving input portion externally projects more than the alignment portion in first direction.

16. An image forming device according to claim 14 wherein the electrode externally projects more than the alignment portion in first direction.

17. An image forming device according to claim 14, wherein the alignment portion is attached to both edges of a shaft of the developer carrier in the third direction.

18. An image forming device according to claim 14, wherein:

the alignment portion includes a chamfered surface, which guides installation and removal of the developing cartridge with respect to the image carrier cartridge.

19. An image forming device according to claim 14, wherein the alignment portion is the driving input portion and/or the electrode.

20. A developing cartridge that is configured to be installed and removed in a first direction with respect to a casing of an image forming device, the casing having an image carrier, the developing cartridge comprising:

a developer carrier configured to carry developer; and wherein the developing cartridge comprises a driving input portion that projects in a direction perpendicular to the first direction, the driving input portion configured to be guided by a guide during installation and removal of the developing cartridge, and to receive a driving force to rotate the developer carrier;

wherein the developing cartridge further comprises an electrode that is configured to contact a power supply element when the developing cartridge is installed, the power supply element being configured to supply electrical bias to the electrode;

wherein the driving input portion and the electrode are provided on the developing cartridge, the driving input portion facing the electrode in the direction perpendicular to the first direction; and wherein a maximum width of the driving input portion in a second direction perpendicular to a direction in which the driving input portion projects is larger than a maximum width of the electrode in a third direction perpendicular to a direction in which the electrode projects.

21. A developing cartridge according to claim 20, wherein the driving input portion further comprises:

a driven rotator that communicate with the developer carrier, and a cover that surrounds a circumference of the driven rotator.

22. A developing cartridge according to claim 20, further comprises:

an alignment portion that aligns the developer carrier relative to an image carrier cartridge.

23. A developing cartridge according to claim 22, wherein the driving input portion externally projects more than the alignment portion in the direction perpendicular to the first direction.

24. A developing cartridge according to claim 22 wherein the electrode externally projects more than the alignment portion in the direction perpendicular to the first direction.

25. A developing cartridge according to claim 22, wherein the alignment portion is attached to both edges of a shaft of the developer carrier in the direction perpendicular to the first direction.

26. A developing cartridge according to claim 22, wherein: the alignment portion includes a chamfered surface, which is configured to guide installation and removal of the developing cartridge with respect to the image carrier cartridge.

27. A developing cartridge according to claim 22, wherein: the alignment portion is the driving input portion and/or the electrode.

* * * * *